US007026905B2

(12) United States Patent
Haugs et al.

(10) Patent No.: US 7,026,905 B2
(45) Date of Patent: Apr. 11, 2006

(54) MAGNETICALLY CONTROLLED INDUCTIVE DEVICE

(75) Inventors: Espen Haugs, Sperrebotn (NO); Frank Strand, Moss (NO)

(73) Assignee: Magtech AS, Moss (NO)

( * ) Notice: Subject to any disclaimer, the term of this patent is extended or adjusted under 35 U.S.C. 154(b) by 185 days.

(21) Appl. No.: 10/685,345

(22) Filed: Oct. 14, 2003

(65) Prior Publication Data

US 2004/0135661 A1 Jul. 15, 2004

Related U.S. Application Data

(63) Continuation-in-part of application No. 10/278,908, filed on Oct. 24, 2002, now Pat. No. 6,933,822, which is a continuation of application No. PCT/NO01/00217, filed on May 23, 2001.

(60) Provisional application No. 60/330,562, filed on Oct. 25, 2001.

(30) Foreign Application Priority Data

May 24, 2000 (NO) ..... 20002652

(51) Int. Cl.
*H01F 17/04* (2006.01)

(52) U.S. Cl. ..... 336/220; 336/221; 336/222

(58) Field of Classification Search ..... 336/188, 336/223, 220–222, 214; 29/902.01
See application file for complete search history.

(56) References Cited

U.S. PATENT DOCUMENTS

| | | | | |
|---|---|---|---|---|
| 2,284,406 | A | 5/1942 | D'Entremont | 175/358 |
| 2,333,015 | A | 10/1943 | Kramer et al. | 171/242 |
| 2,716,736 | A | 8/1955 | Rex | 336/155 |
| 2,825,869 | A | 4/1958 | Eckert, Jr. et al. | 323/89 |
| 2,883,604 | A | 4/1959 | Mortimer | |
| 3,351,860 | A | 11/1967 | Wolff | |
| 3,403,323 | A | 9/1968 | Wanlass | |
| 3,409,822 | A | 11/1968 | Wanlass | 323/22 |
| 3,612,988 | A | 10/1971 | Wanlass | |
| 3,757,201 | A | 9/1973 | Cornwell | 323/44 R |
| 4,002,999 | A | 1/1977 | Hesler et al. | 331/113 A |
| 4,004,251 | A | 1/1977 | Hesler et al. | 331/113 A |
| 4,020,440 | A | 4/1977 | Moerman | |

(Continued)

FOREIGN PATENT DOCUMENTS

DE 100 62 091 C1 7/2002

(Continued)

OTHER PUBLICATIONS

Hubert et al., "Magnetic Domains: the Analysis of Magnetic Microstructures," *Springer-Verlag*, (2000), pp. 416-417, 522, 533.

(Continued)

*Primary Examiner*—Anh T. Mai
(74) *Attorney, Agent, or Firm*—Kirkpatrick & Lockhart Nicholson Graham LLP

(57) ABSTRACT

A controllable inductor, comprising first and second coaxial and concentric pipe elements, where said elements are connected to one another at both ends by means of magnetic end couplers, a first winding wound around both said elements, and a second winding wound around at least one of said elements, where the winding axis for the first element is perpendicular to the elements' axes and the winding axis of the second winding coincides with the elements' axes, characterized in that said first and second magnetic elements are made from anisotropic magnetic material such that the magnetic permeability in the direction of a magnetic field introduced by the first of said windings is significantly higher than the magnetic permeability in the direction of a magnetic field introduced by the second of said windings.

8 Claims, 62 Drawing Sheets

U.S. PATENT DOCUMENTS

| | | | | |
|---|---|---|---|---|
| 4,163,189 | A | 7/1979 | Smutny | 323/6 |
| 4,202,031 | A | 5/1980 | Hesler et al. | 363/97 |
| 4,210,859 | A | 7/1980 | Meretsky et al. | 323/44 R |
| 4,307,334 | A * | 12/1981 | Peil et al. | 323/351 |
| 4,308,495 | A | 12/1981 | Yasumura | |
| 4,347,449 | A | 8/1982 | Beau | |
| 4,393,157 | A | 7/1983 | Roberge et al. | 323/355 |
| 4,595,843 | A * | 6/1986 | DelVecchio et al. | 307/83 |
| 5,404,101 | A | 4/1995 | Logue | |
| 5,672,967 | A | 9/1997 | Jensen et al. | 324/253 |
| 5,936,503 | A | 8/1999 | Holmgren et al. | 336/60 |
| 6,232,865 | B1 | 5/2001 | Zinders et al. | 336/212 |
| 6,307,468 | B1 | 10/2001 | Ward, Jr. | |
| 6,429,765 | B1 | 8/2002 | Valdemarsson et al. | |
| 6,486,393 | B1 * | 11/2002 | Matsuba et al. | 174/35 R |
| 6,617,950 | B1 * | 9/2003 | Gilmore et al. | 336/229 |

FOREIGN PATENT DOCUMENTS

| | | |
|---|---|---|
| EP | 0 018 296 A1 | 10/1980 |
| FR | 2 344 109 | 10/1977 |
| GB | 1 209 253 | 10/1970 |
| GB | 2 361 107 A | 10/2001 |
| JP | 01231305 | 9/1989 |
| JP | 07201587 | 8/1995 |
| JP | 07201588 | 8/1995 |
| JP | 07201590 | 8/1995 |
| RU | 2125310 C1 | 1/1999 |
| SU | 441601 | 6/1975 |
| SU | 877631 | 11/1981 |
| WO | WO 94/11891 | 5/1994 |
| WO | WP 97/34210 | 9/1997 |
| WO | WO 98/31024 | 7/1998 |
| WO | 01/90835 | 5/2001 |
| WO | 02/27898 | 9/2001 |
| WO | WO 02/059918 A1 | 8/2002 |
| WO | 04/040598 | 10/2003 |
| WO | 04/053615 | 12/2003 |

OTHER PUBLICATIONS

Fiorillo et al., "Comprehensive Model of Magnetization Curve, Hysteresis Loops, and Losses in Any Direction in Grain-Oriented Fe-Si," *IEEE Transactions of Magnetics*, vol. 38, No. 3 (May 2002), pp. 1467-1476.

Copy of Search Report for GB 0324092.6, mailed Feb. 26, 2004.

Copy of International Search Report PCT/NO 01/00217, Mailing Date Aug. 31, 2001.

Copy of Norwegian Search Report 2001 5689, Mailing Date Jul. 10, 2002.

Copy of International Search Report PCT/NO 02/00434, Mailing Date Mar. 4, 2003.

Copy of Norwegian Search Report 2000 2652, Mailing Date Apr. 30, 2002.

Copy of Norwegian Search Report 2000 2652, Mailing Date Nov. 12, 2000.

Copy of International Search Report PCT/NO 02/00435, Mailing Date Mar. 6, 2003.

Copy of International Search Report PCT/NO 02/00004, Mailing Date May 16, 2003.

Copy of Norwegian Search Report 2002 5268, Mailing Date Jun. 30, 2003.

Copy of International Search Report PCT/NO 03/00417, Mailing Date Apr. 13, 2004.

Copy of International Preliminary Examination Report PCT/NO 02/00434, Mailing Date Mar. 16, 2004.

Copy of International Preliminary Examination Report PCT/NO 02/00435, Mailing Date Mar. 16, 2004.

Copy of PCT Written Opinion PCT/NO 03/00417, Mailing Date Sep. 9, 2004.

Copy of PCT International Search Report PCT/NO 04/000308, Mailing Date Apr. 2, 2005.

* cited by examiner

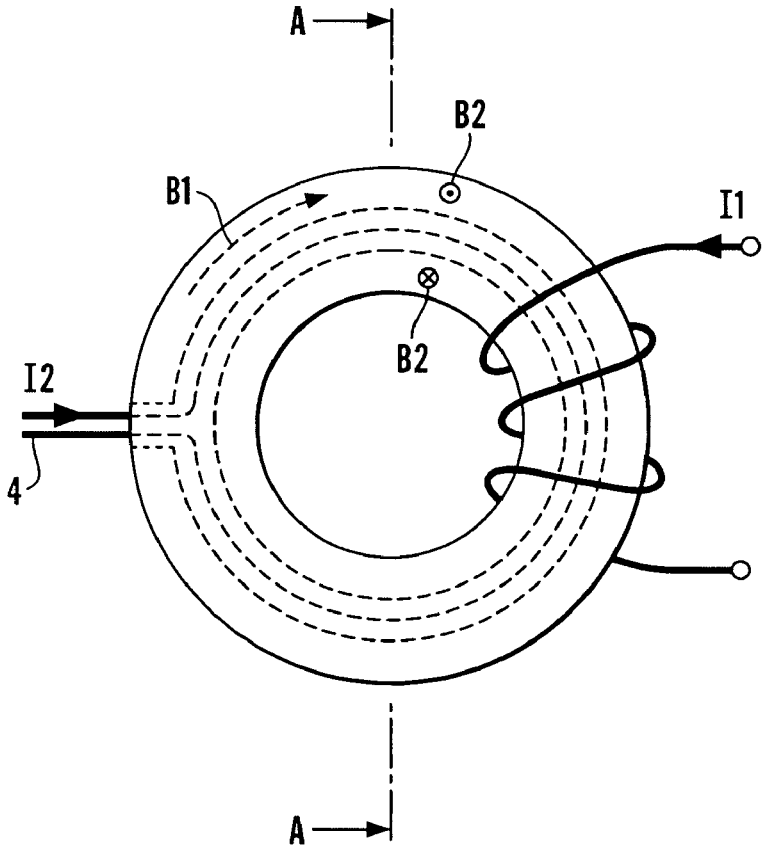
Fig.2a
Fig.2b
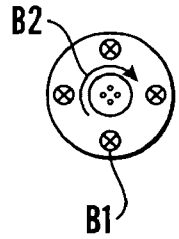
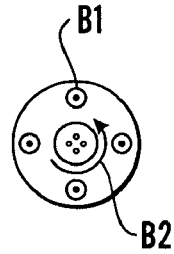
Fig.2c

A-A

MAGNETICALLY CONTROLLED INDUCTIVE DEVICE

CROSS-REFERENCE TO RELATED APPLICATIONS

This application is a continuation-in-part of currently application Ser. No. 10/278,908, filed on Oct. 24, 2002, now U.S. Pat. No. 6,933,822, which claims priority to U.S. Provisional Application No. 60/330,562, filed Oct. 25, 2001, and which is a continuation of PCT International Application No. PCT/NO01/00217, filed May 23, 2001, which claims priority to Norwegian Patent Application No. 2000 2652, filed May 24, 2000, the contents of each of these applications are incorporated herein by reference.

FIELD OF THE INVENTION

The present invention relates to a controllable inductive device, and more particularly a controllable inductive device comprising an anisotropic material.

BACKGROUND OF THE INVENTION

There is a long standing interest in using a control field to control a main field in an inductive device. For example, U.S. Pat. No. 4,210,859 describes a device comprising an inner cylinder and an outer cylinder joined to one another at the ends by means of connection elements. In this device the main winding is wound around the core and passes through the cylinder's central aperture. The winding axis follows a path along the cylinder's periphery. This winding creates an annular magnetic field in the cylinder's wall and circular fields in the connection elements. The control winding is wound around the cylinder's axis. It will thus create a field in the cylinder's longitudinal direction. The core's permeability is changed by the action of a control current applied to the control winding. Because the cylinders and the connection elements are made of the same material, the rate of change of permeability is the same in both types of elements. Consequently, the magnitude of the control field must be limited to prevent saturation of the core and decomposition of the control field. As a result, the control range of this inductor is limited, and the device, in U.S. Pat. No. 4,210,859, has a relatively small volume that limits the device's power handing capability.

Other devices include controlled permeability of only part of the main flux path. However, such an approach dramatically limits the control range of the device. For example, U.S. Pat. No. 4,393,157 describes a variable inductor made of anisotropic sheet strip material. This inductor comprises two ring elements joined perpendicularly to one another with a limited intersection area. Each ring element has a winding. The part of the device where magnetic field control can be performed is limited to the area where the rings intersect. The limited controllable area is a relatively small portion of the closed magnetic circuits for the main field and the control field. Part of the core will saturate first (saturation will not be attained simultaneously for all parts of the core because different fields act upon different areas) and this saturation will result in losses generated by stray fields from the main flux. Partial saturation results in a device with a very limited control span.

Thus, the prior art lacks a means to control permeability in a core for substantial power handling capability without introducing considerable losses. The shortcomings of the prior art effect all inductive device geometries, and in particular, curved structures made of sheet strip metal because considerable eddy currents and hysteresis losses occur in these types of curved structures.

SUMMARY OF THE INVENTION

The invention addresses these shortcomings and can be implemented in a low loss controllable inductive device suitable for high power applications. Generally, the invention can be used to control the magnetic flux conduction in a rolling direction by controlled domain displacement in a transverse direction.

In one aspect, the invention controls the permeability of grain-oriented material in the rolling direction by employing a control field in the transverse direction. In one embodiment, a controllable inductive device of grain-oriented steel is magnetized in the transverse direction. In another embodiment, a controllable inductor comprising first and second coaxial and concentric pipe elements is provided. The elements are connected to one another at both ends by means of magnetic end couplers. A first winding is wound around both said elements, and a second winding is wound around at least one of said elements. The winding axis for the first winding is perpendicular to the elements' axes and the winding axis of the second winding coincides with the elements' axes. The first and second magnetic elements are made from an anisotropic magnetic material such that the magnetic permeability in the direction of a magnetic field introduced by the first of the windings is significantly higher than the magnetic permeability in the direction of a magnetic field introduced by the second of the windings. In a version of this embodiment, the anisotropic material is selected from a group consisting of grain-oriented silicon steel and domain controlled high permeability grain oriented silicon steel.

In one embodiment, the magnetic end couplers are made of anisotropic material and provide a low permeability path for the magnetic field created by the first winding and a high permeability path for the magnetic field created by the second winding. The controllable inductor may also include a thin insulation sheet situated between magnetic pipe element edges and the end couplers.

In a further embodiment, the invention provides a controllable magnetic structure that includes a closed magnetic circuit. The closed magnetic circuit includes a magnetic circuit first element, and a magnetic circuit second element. Each of the magnetic circuit elements is manufactured from an anisotropic material having a high permeability direction. The controllable magnetic structure also includes a first winding which is wound around a first portion of the closed magnetic circuit, and a second winding which is oriented orthogonal to the first winding. The first winding generates a first magnetic field in the high permeability direction of the first circuit element and the second winding generates a second field in a direction orthogonal to the first field direction when the respective windings are excited (i.e., energized).

In a version of this embodiment, the controllable magnetic structure includes a first circuit element that is a pipe member and a magnetic circuit second element that is an end coupler that connects a first pipe member to a second pipe member. In a version of this embodiment, the first pipe member and the second pipe member are located coaxially around an axis and the high permeability direction is an annular direction relative to the axis. Additionally, the second high permeability direction can be in a radial direction relative to the axis. In another version of this embodiment, the controllable magnetic structure is manufactured from grain-oriented material. In yet another version of this embodiment, the controllable magnetic structure is an inductor.

In another embodiment, insulation is located in the closed magnetic circuit between the magnetic circuit first element and the magnetic second element. In another embodiment, the magnetic circuit second element has a volume that is 10% to 20% of the volume of the magnetic circuit first element.

In still another embodiment of the invention, a core is provided for a magnetic controllable inductor. The core includes first and second coaxial and concentric pipe elements and each pipe element is manufactured from an anisotropic magnetic material. An axis is defined by each pipe element and the pipe elements are connected to one another at both ends by means of magnetic end couplers. In addition, the core presents a first magnetic permeability in a first direction parallel to the axes of the elements that is significantly higher than a second magnetic permeability in a second direction orthogonal to the elements' axes. In a version of this embodiment, first and second pipe elements are made of a rolled sheet material comprising a sheet end and a coating of an insulation material. In another version, the first pipe element includes a gap in the third direction parallel to the axes of the elements and the first and second pipe elements are joined together by means of a micrometer thin insulating layer in a joint located between the first and second pipe elements. In a further version, an air gap extends in an axial direction in each pipe element and a first reluctance of a first element equals a second reluctance of the second element. In one embodiment, the insulation material is selected from a group consisting of MAGNETITE-S and UNISIL-H. Further, the controllable inductor can include a third magnetic permeability that exists in the couplers in an annular direction relative to the axes of the elements and a fourth magnetic permeability that exists in the coupler in a radial direction relative to the axes of the elements. In a version of this embodiment, the fourth magnetic permeability is substantially greater than the third magnetic permeability.

In another aspect of the invention, a magnetic coupler device is provided to connect first and second coaxial and concentric pipe elements to one another to provide a magnetic core for a controllable inductor. The magnetic end couplers are manufactured from anisotropic material and provide a low permeability path for magnetic field created by the first winding and a high permeability path for magnetic field created by a second winding. In a version of this embodiment, the magnetic coupler includes grain-oriented sheet metal with a transverse direction that corresponds to the grain-oriented direction of pipe elements in an assembled core. In addition, the grain-oriented direction corresponds to the transverse direction of the pipe elements in the assembled core to assure that the end couplers get saturated after the pipe elements. In a version of this embodiment, the magnetic end couplers are manufactured from a single wire of magnetic material. In another version of this embodiment, the magnetic end couplers are manufactured from stranded wires of magnetic material.

The magnetic end couplers may be produced by a variety of means. In one embodiment, the end couplers are produced by rolling a magnetic sheet material to form a toroidal core. The core is sized and shaped to fit the pipe elements, and the cores are divided into two halves along a plain perpendicular to the material's Grain Orientation (GO) direction. Additionally, the end coupler width is adjusted to make the segments connect the first pipe element to the second pipe element at the pipe element ends. In another embodiment, the magnetic end couplers are produced from either stranded or single wire magnetic material wound to form a torus and the torus is divided into two halves along a plane perpendicular to all the wires.

In another embodiment, the invention implements a variable inductive device with low remanence, so that the device can easily be reset between working cycles in AC operation and can provide an approximately linear, large inductance variation.

The invention will now be described in detail by means of examples illustrated in the following drawings.

BRIEF DESCRIPTION OF THE DRAWINGS

FIGS. 1 and 2 illustrate the basic principle of the invention and a first embodiment thereof.

DETAILED DESCRIPTION

The invention will now be explained in principle in connection with FIGS. 1*a* and 1*b*.

In the entire description, the arrows associated with magnetic field and flux will substantially indicate the directions thereof within the magnetic material. The arrows are drawn on the outside for the sake of clarity.

Figure 1A:
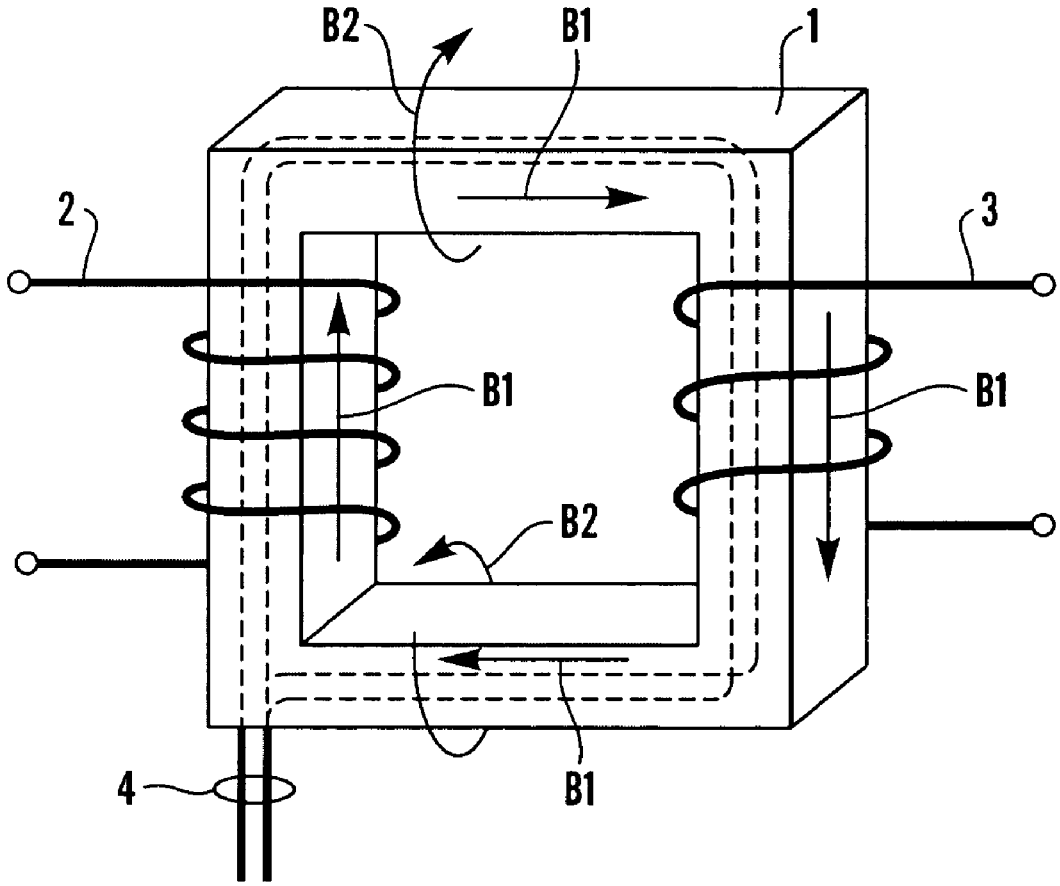
Figure 1B:
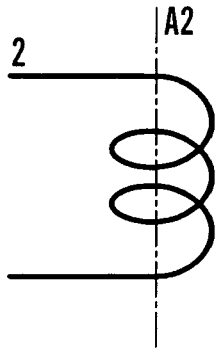
Figure 1C:
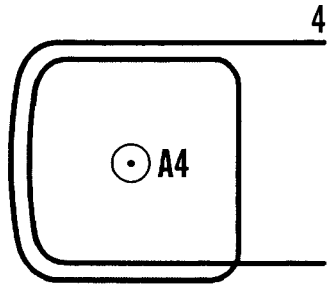
Figure 1D:
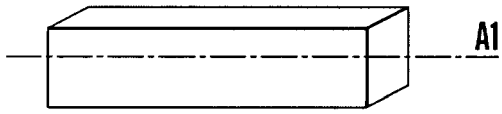
Figure 1E:
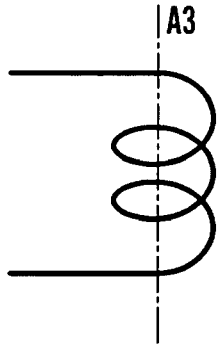
Figure 1F:
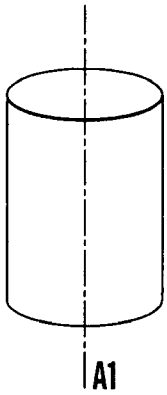
Figure 1G:
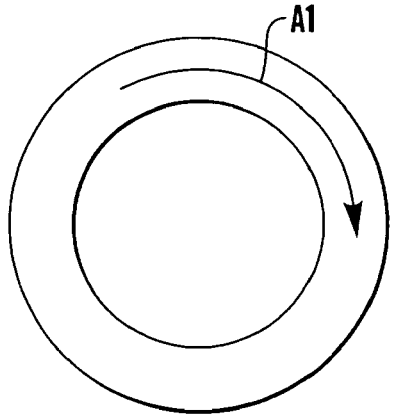
Figure 3:
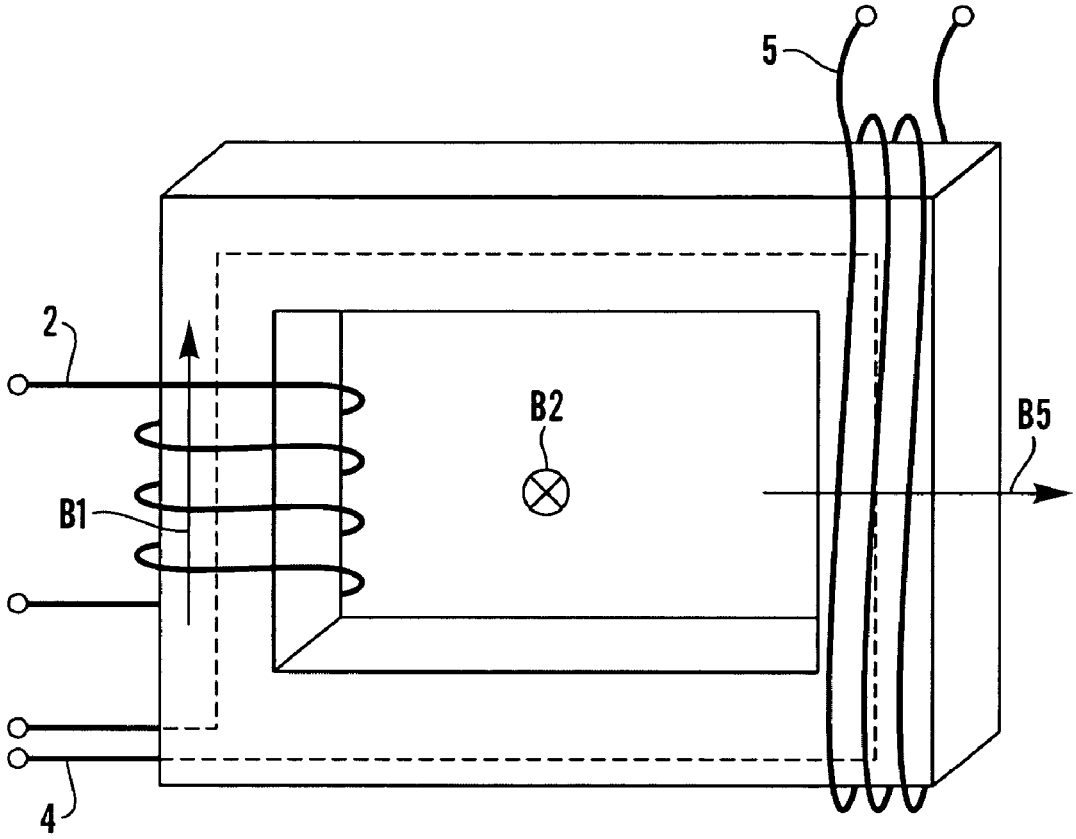
FIG. 3 is a schematic illustration of an embodiment of the device according to an embodiment of the invention.

FIG. 1*a* illustrates a device comprising a body 1 of a magnetisable material which forms a closed magnetic circuit. This magnetisable body or core 1 may be annular or of another suitable shape. Round the body 1 is wound a first main winding 2, and the direction of the magnetic field H1 (corresponding to the direction of the flux density B1) which will be created when the main winding 2 is excited will follow the magnetic circuit. The main winding 2 corresponds to a winding in an ordinary transformer. In an embodiment the device includes a second main winding 3 which in the same way as the main winding 2 is wound round the magnetisable body 1 and which will thereby provide a magnetic field which extends substantially along the body 1 (i.e. parallel to H1, B1). The device finally includes a third main winding 4 which in a preferred embodiment of the invention extends internally along the magnetic body 1. The magnetic field H2 (and thus the magnetic flux density B2) which is created when the third main winding 4 is excited will have a direction which is at right angles to the direction of the fields in the first and the second main winding (direction of H1, B1). The invention may also include a fourth main winding 5 which is wound round a leg of the body 1. When the fourth main winding 5 is excited, it will produce a magnetic field with a direction which is at right angles both to the field in the first (H1), the second and the third main winding (H2) (FIG. 3). This will naturally require the use of a closed magnetic circuit for the field which is created by the fourth main winding. This circuit is not illustrated in the Figure, since the Figure is only intended to illustrate the relative positions of the windings.

In the topologies which are considered to be preferred in the present description, however, it is the case that the turns in the main winding follow the field direction from the control field and the turns in the control winding follow the field direction to the main field.

FIGS. 1*b*–1*g* illustrate the definition of the axes and the direction of the different windings and the magnetic body. With regard to the windings, we shall call the axis the perpendicular to the surface which is restricted by each turn. The main winding 2 will have an axis A2, the main winding 3 an axis A3 and the control winding 4 an axis A4.

With regard to the magnetisable body, the longitudinal direction will vary with respect to the shape. If the body is elongated, the longitudinal direction A1 will correspond to the body's longitudinal axis. If the magnetic body is square as illustrated in FIG. 1*a*, a longitudinal direction A1 can be defined for each leg of the square. Where the body is tubular, the longitudinal direction A1 will be the tube's axis, and for an annular body the longitudinal direction A1 will follow the ring's circumference.

The invention is based on the possibility of altering the characteristics of the magnetisable body 1 in relation to a first magnetic field by altering a second magnetic field which is at right angles to the first. Thus, for example, the field H1 can be defined as the working field and control the body's 1 characteristics (and thereby the behaviour of the working field H1) by means of the field H2 (hereinafter called control field H2). This will now be explained in more detail.

The magnetisation current in an electrical conductor which is enclosed by a ferromagnetic material is limited by the reluctance according to Faraday's Law. The flux which has to be established in order to generate counter-induced voltage depends on the reluctance in the magnetic material enclosing the conductor.

The extent of the magnetisation current is determined by the amount of flux which has to be established in order to balance applied voltage.

In general the following steady-state equation applies for sinusoidal voltage:

1) Flux:

$$\Phi = -j\frac{1}{N\cdot\omega}\cdot E$$

E=applied voltage
ω=angular frequency
N=number of turns for winding where the flux Φ through the magnetic material is determined by the voltage E. The current required in order to establish necessary flux is determined by:

2) Current $$I = \Phi\cdot\frac{Rm}{N} \quad \Phi = \frac{I}{Rm}\cdot N$$

3) Reluctance (flux resistance)

$$Rm = \frac{1j}{\mu_0\cdot\mu r\cdot Aj}$$

lj=length of flux path
μr=relative permeability
μo=permeability in vacuum
Aj=cross-sectional area of the flux path Where there is low reluctance (iron enclosure), according to expression 2) above, little current will be required in order to establish the necessary flux, and supplied voltage will overlay the connector. In the case of high reluctance (air) on the other hand, a large current will be required in order to establish the necessary flux. In this case the current will then be limited by the voltage over the load and the voltage induced in the connector. The difference between reluctance in air and reluctance in magnetic material may be of the order of 1.000–900.000.

The magnetic induction or flux density in a magnetic material is determined by the material's relative permeability and the magnetic field intensity. The magnetic field intensity is generated by the current in a winding arranged round or through the material.

For the systems which have to be evaluated the following applies:

The Field Intensity $$\int \overline{H}.\overline{ds}=I.N$$

$\overline{H}$=field intensity
s=the integration path
I=current in winding
N=number of windings Flux density or induction:

$$\overline{\beta}=\mu_0\cdot\mu r\overline{H}$$

$\overline{H}$=magnetic field intensity

The ratio between magnetic induction and field intensity is non-linear, with the result that when the field intensity increases above a certain limit, the flux density will not increase and on account of a saturation phenomenon which is due to the fact that the magnetic domains in a ferromagnetic material are in a state of saturation. Thus it is desirable to provide a control field H2 which is perpendicular to a working field H1 in the magnetic material in order to control the saturation in the magnetisable material, while avoiding magnetic connection between the two fields and thereby avoiding transformative or inductive connection. Transformative connection means a connection where two windings "share" a field, with the result that a change in the field from one winding will lead to a change in the field in the other winding.

One will avoid increasing H to saturation as by a transformative connection where the fluxes will have a common path and will be added together. If the fluxes are orthogonal they will not be added together. For example, by providing the magnetic material as a tube where the main winding or the winding which carries the working current is located inside the tube and is wound in the tube's longitudinal direction, and where the control winding or the winding which carries the control current is wound round the circumference of the tube, the desired effect is achieved. Depending on the tube dimensions, a small area for the control flux and a large area for the working flux are thereby also achieved.

In the said embodiment, the working flux will travel in the direction along the tube's circumference and have a closed magnetic circuit. The control flux on the other hand will travel in the tube's longitudinal direction and will have to be connected in a closed magnetic circuit, either by two tubes being placed in parallel and a magnetic material connecting the control flux between the two tubes, or by a first tube being placed around a second tube, with the result that the control winding is located between the two tubes, and the end surfaces of the tubes are magnetically interconnected, thereby obtaining a closed path for the control flux. These solutions will be described in greater detail later.

The parts which provide magnetic connection between the tubes or the core parts will hereinafter be called magnetic field connectors or magnetic field couplings.

The total flux in the material is given by $$\Phi=B\cdot Aj \qquad 4)$$

Figure 4A:
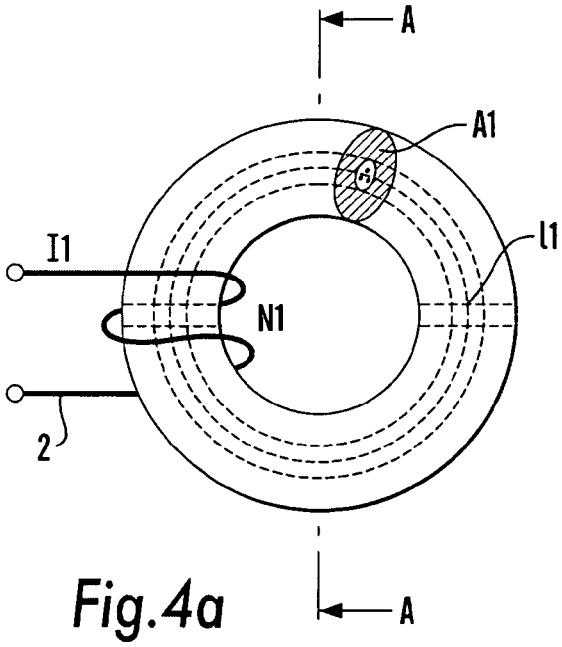
FIG. 4 illustrates the areas of the different magnetic fluxes which form part of the device according to an embodiment of the invention.
Figure 4B:
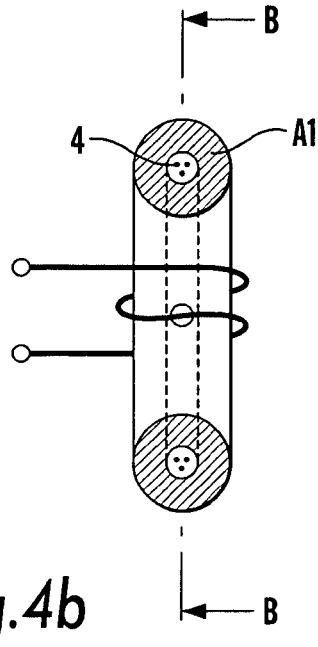
Figure 4C:
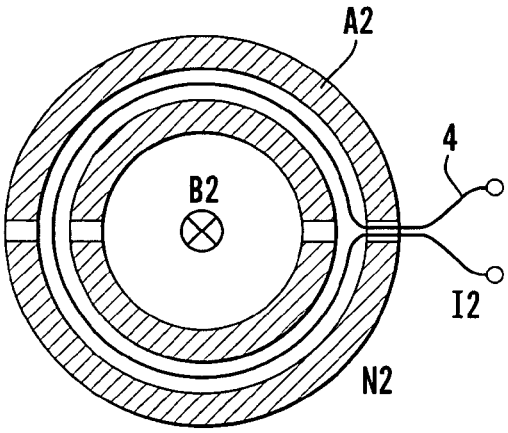
Figure 4D:
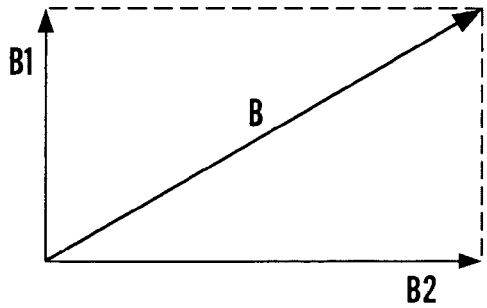

The flux density B is composed of the vector sum of B1 and B2 (FIG. 4*d*). B1 is generated by the current I1 in the first main winding 2, and B1 has a direction tangentially to the conductors in the main winding 2. The main winding 2 has N1 turns and is wound round the magnetisable body 1. B2 is generated by the current I2 in the control winding 4 with N2 number of turns and where the control winding 4 is wound round the body 1. B2 will have a direction tangentially to the conductors in the control winding 4.

Since the windings 2 and 4 are placed at 90° to each other, B1 and B2 will be orthogonally located. In the magnetisable body 1, B1 will be oriented transversally and B2 longitudinally. In this connection we refer particularly to what is illustrated in FIGS. 1–4.

$$\overline{B}=\overline{B}_1+\overline{B}_2 \quad 5)$$

It is considered an advantage that the relative permeability is higher in the working field's (H1) direction than in the control field's (H2) direction, i.e. the magnetic material in the magnetisable body 1 is anisotropic, but of course this should not be considered limiting with regard to the scope of the invention.

The vector sum of the fields H1 and H2 will determine the total field in the body 1, and thus the body's 1 condition with regard to saturation, and will also determine the magnetisation current and the voltage which is divided between a load connected to the main winding 2 and the connector. Since the sources for B1 and B2 will be located orthogonally to each other, none of the fields will be able to be decomposed into the other. This means that B1 cannot be a function of B2 and vice versa. However, B, which is the vector sum of B1 and B2 will be influenced by the extent of each of them.

B2 is the vector which is generated by the control current. The cross-sectional surface A2 for the B2 vector will be the transversal surface of the magnetic body 1, cf. FIG. 4*c*. This may be a small surface limited by the thickness of the magnetisable body 1, given by the surface sector between the internal and external diameters of the body 1, in the case of an annular body. The cross-sectional surface A1 (see FIGS. 4*a, b*) for the B1 field on the other hand is given by the length of the magnetic core and the rating of applied voltage. This surface will be able to be 5–10 times larger than the surface of the control flux density B2, without this being considered limiting for the invention.

When B2 is at saturation level, a change in B1 will not result in a change in B. This makes it possible to control which level on B1 gives saturation of the material, and thereby control the reluctance for B.

The inductance for the control winding 4 (with N2 turns) will be able to be rated at a small value suitable for pulsed control of the regulator, i.e. enabling a rapid reaction (of the order of milliseconds) to be provided.

$$Ls = N2^2 \cdot \mu_{r-sat} \cdot \mu_0 \cdot \frac{A2}{l2} \quad 6)$$

N2=Number of turns for control winding

A2=Area of control flux density B2 l2=Length of flux path for control flux

A simplified mathematical description will now be given of the invention and its applications, based on Maxwell's equations.

For simple calculations of magnetic fields in electrical power technology, Maxwell's equations are used in integral form.

In a device of the type which will be analysed here (and to some extent also in the invention), the magnetic field has low frequency.

The displacement current can thus be neglected compared with the current density.

Maxwell's equation $$curl(\overline{H}) = \overline{J} + \frac{d}{dt}\overline{D} \quad 7)$$

is simplified to $$curl(\overline{H})=\overline{J} \quad 8)$$

The integral form is found in Toke's theorem:

$$\int(\overline{H})\overline{dl}=I \quad 9)$$

presents a solution for the system in FIG. 4, where the main winding 2 establishes the H1 field. The calculations are performed here with concentrated windings in order to be able to focus on the principle and not an exact calculation.

The integration path coincides with the field direction and an average field length 11 is chosen in the magnetisable body 1. The solution of the integral equation then becomes:

$$H_1 l_1 = N_1 \cdot I_1 \quad 11)$$

This is also known as the magnetomotive force MMK.

$$F_1 = N_1 \cdot I_1 \quad 12)$$

The control winding 4 will establish a corresponding MMK generated by the current I2:

$$H_2 \cdot I_2 = N_2 I_2 \quad 13)$$

$$F_2 = N_2 I_2 \quad 14)$$

The magnetisation of the material under the influence of the H field which is generated from the source windings 2 and 4 is expressed by the flux density B. For the main winding 2:

$$\overline{B}_1 = \mu_0 \mu r_1 \cdot \overline{H}_1 \quad 15)$$

For the control winding 4:

$$\overline{B}_2 = \mu_0 \mu r_2 \cdot \overline{H}_2 \quad 16)$$

The permeability in the transversal direction is of the order of 1 to 2 decades less than for the longitudinal direction. The permeability for vacuum is:

$$\mu_0 = 4 \cdot \pi \cdot 10^{-7} \cdot \frac{H}{m} \quad 17)$$

The capacity to conduct magnetic fields in iron is given by $\mu_r$, and the magnitude of $\mu$ is from 1000 to 100.000 for iron and for the new METGLAS materials up to 900.000.

By combining equations 11) and 15), for the main winding 2 we get:

$$B_1 = \mu_0 \cdot \mu_r \cdot \frac{N_1 \cdot I_1}{l_1} \quad 18)$$

The flux in the magnetisable body 1 from the main winding 2 is given by equation:

$$\Phi_1 = \int_{Aj}^{o} \overline{B}_1 \cdot \overline{n} ds \quad 19)$$

Assuming the flux is constant over the core cross section:

$$\Phi_1 = B_1 \cdot A_1 = \mu_0 \cdot \mu_r \frac{N_1 I_1 A_1}{l_1} \quad 20)$$

Here we recognise the expression for the flux resistance Rm or the reluctance as given under 3):

$$\Phi_1 = \frac{N_1 I_1}{Rml} \quad 21)$$

$$Rm_1 = \frac{l_1}{\mu_0 \cdot \mu_r \cdot A_1} \quad 22)$$

In the same way we find flux and reluctance for the control winding 4:

$$\Phi_2 = \frac{N_2 \cdot I_2}{Rm_2} \quad 23)$$

$$Rm_2 = \frac{l_2}{\mu_0 \cdot \mu r_2 \cdot A_2} \quad 24)$$

The invention is based on the physical fact that the differential of the magnetic field intensity which has its source in the current in a conductor is expressed by curl to the H field. Curl to H says something about the differential or the field change of the H field across the field direction of H. In our case we have calculated the field on the basis that the surface perpendicular of the differential field loop has the same direction as the current. This means that the fields from the current-carrying conductors forming the windings which are perpendicular to each other are also orthogonal. The fact that the fields are perpendicular to each other is important in relation to the orientation of the domains in the material.

Before examining this more closely, let us introduce self-inductance which will play a major role in the application of the new magnetically controlled power components.

According to Maxwell's equations, a time-varying magnetic field will induce a time-varying electrical field, expressed by $$\int \overline{E} \cdot \overline{dl} = \frac{d}{dt}\left(\int_S \overline{B} \cdot \overline{n} ds\right) \quad 25)$$

Figure 5A:
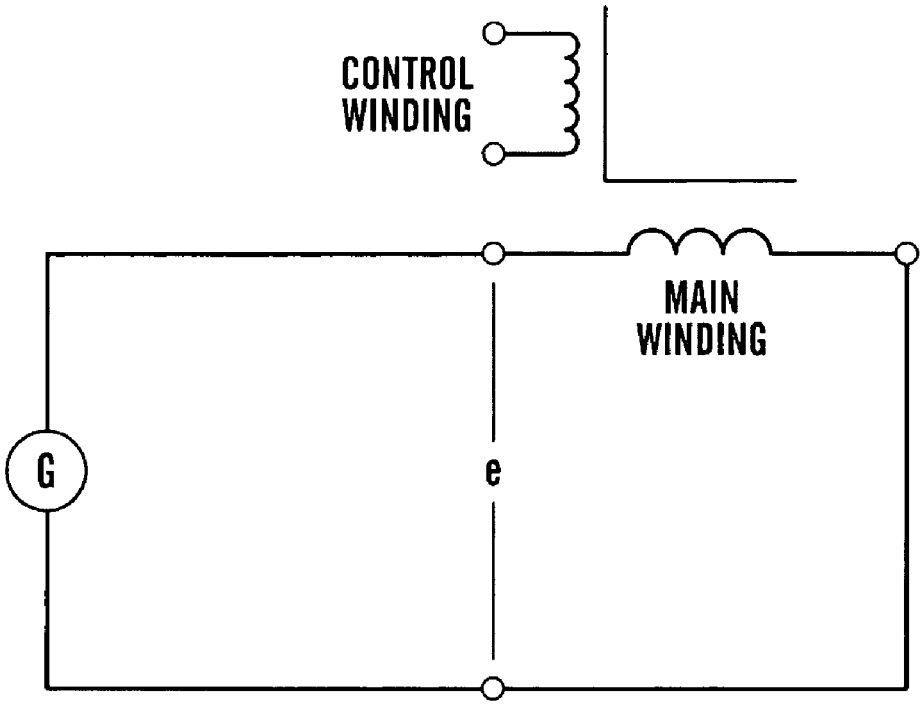
FIG. 5 illustrates a first equivalent circuit for the device according to an embodiment of the invention.
Figure 5B:
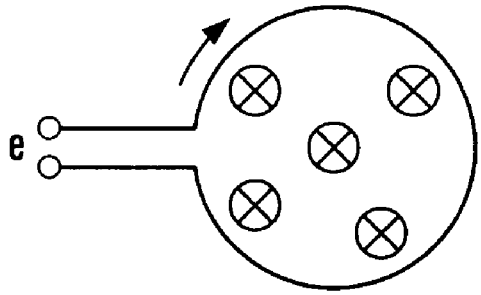

The left side of the integral is an expression of the potential equation in integral form. The source of the field variation may be the voltage from a generator and we can express Faraday's Law when the winding has N turns and all flux passes through all the turns, see FIG. 5:

$$e = N \cdot A_j \cdot \frac{d}{dt} B = N \cdot \frac{d}{dt} \Phi = \frac{d}{dt} \lambda \quad 26)$$

λ (Wb) gives an expression of the number of flux turns and is the sum of the flux through each turn in the winding. If one envisages the generator G in FIG. 5 being disconnected after the field is established, the source of the field variation will be the current in the circuit and from circuit technology we have, see FIG. 5*a*:

$$e = L \cdot \frac{di}{dt} \quad 27)$$

From equation 21 we have:

$$\Phi = k \cdot I \quad 28)$$

When L is constant, the combination of equations 26 and 27 gives:

$$\frac{d\lambda}{dt} = L \frac{di}{dt} \quad 29)$$

The solution of 29 is:

$$\lambda = L \cdot i + C \quad 30)$$

From 28 we derive that C is 0 and:

$$L = \frac{\lambda}{i} \quad 31)$$

This is an expression of self-inductance for the winding N (or in our case the main winding 2). The self-inductance is equal to the ratio between the flux turns established by the current in the winding (the coil) and the current in the winding (the coil).

The self-inductance in the winding is approximately linear as long as the magnetisable body or the core are not in saturation. However, we shall change the self-inductance through changes in the permeability in the material of the magnetisable body by changing the domain magnetisation in the transversal direction by the control field (i.e. by the field H2 which is established by the control winding 4).

From equation 21) combined with 31) we obtain:

$$L = \frac{N^2}{Rm} \quad 32)$$

The alternating current resistance or the reactance in an electrical circuit with self-inductance is given by $$X_L = jwL \quad 33)$$

By magnetising the domains in the magnetisable body in the transversal direction, the reluctance of the longitudinal direction will be changed. We shall not go into details here in the description of what happens to the domains during different field influences. Here we have considered ordinary commercial electroplate with a silicon content of approximately 3%, and in this description we shall not offer an explanation of the phenomenon in relation to the METGLAS materials, but this, of course, should not be considered limiting for the invention, since the magnetic materials with amorphous structure will be able to play an important role in some applications of the invention.

In a transformer we employ closed cores with high permeability where energy is stored in magnetic leakage fields and a small amount in the core, but the stored energy does not form a direct part in the transformation of energy, with the result that no energy conversion takes place in the sense of what occurs in an electromechanical system where electrical energy is converted to mechanical energy, but energy is transformed via magnetic flux through the transformer. In an inductance coil or choke with an air gap, the reluctance in the air gap is dominant compared to the reluctance in the core, with approximately all the energy being stored in the air gap.

In the device according to the invention a "virtual" air gap is generated through saturation phenomena in the domains. In this case the energy storage will take place in a distributed air gap comprising the whole core. We consider the actual magnetic energy storage system to be free for losses, and any losses will thus be represented by external components.

The energy description which we use will be based on the principle of conservation of energy.

Figure 6:
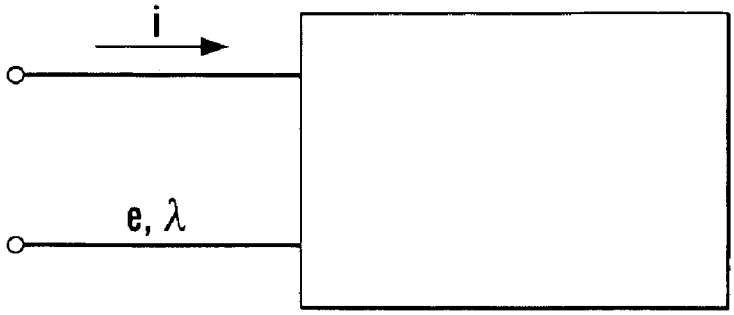
FIG. 6 is a simplified block diagram of the device according to an embodiment of the invention.

The first law of thermodynamics applied to the loss-free electromagnetic system above gives, see FIG. 6:

$$dWelin=dWfld \quad 34)$$

where dWelin=differential electrical energy supply dWfld=differential change in magnetically stored energy From equation 26) we have $$e=\frac{d}{dt}\lambda$$

Now our inductance is variable through the orthogonal field or the control field H2, and equation 31) inserted in 26) gives:

$$e=\frac{d(L\cdot i)}{dt}=L\cdot\frac{di}{dt}+i\cdot\frac{dL}{dt} \quad 35)$$

The effect within the system is $$p=i\cdot e=i\cdot\frac{d}{dt}\lambda \quad 36)$$

Thus we have $$dW_{elin}=i\cdot d\lambda \quad 37)$$

For a system with a core where the reluctance can be varied and which only has a main winding, equation 35) inserted in equation 37) will give $$dW_{elin}=i\cdot d(L\cdot i)=i\cdot(L\cdot di+i\cdot dl) \quad 38)$$

In the device according to the invention L will be varied as a function of pr, the relative permeability in the magnetisable body or the core 1, which in turn is a function of I2, the control current in the control winding 4.

When L is constant, i.e. when I2 is constant, we can disregard the section i×dL since dL is equal to 0, and thus the magnetic field energy will be given by:

$$W_{flt}=\frac{1}{2}\cdot L\cdot i^2 \quad 39)$$

When L is varied by means of I2, the field energy will be altered as a result of the altered value of L, and thereby the current I will also be altered it is associated with the field value through the flux turns λ.

From the preceding, we can draw the conclusion that the field energy and the energy distribution will be controllable via μr and influence how energy stored in the field is increased and decreased. When the field energy is decreased, the surplus portion will be returned to the generator. Or if we have an extra winding (e.g. winding 3, FIG. 1) in the same winding window as the first main winding 2 and with the same winding axis as the winding axis of main winding 2, this provides a transformative transfer of energy from the first winding 2 to the second main winding 3.

Figure 7:
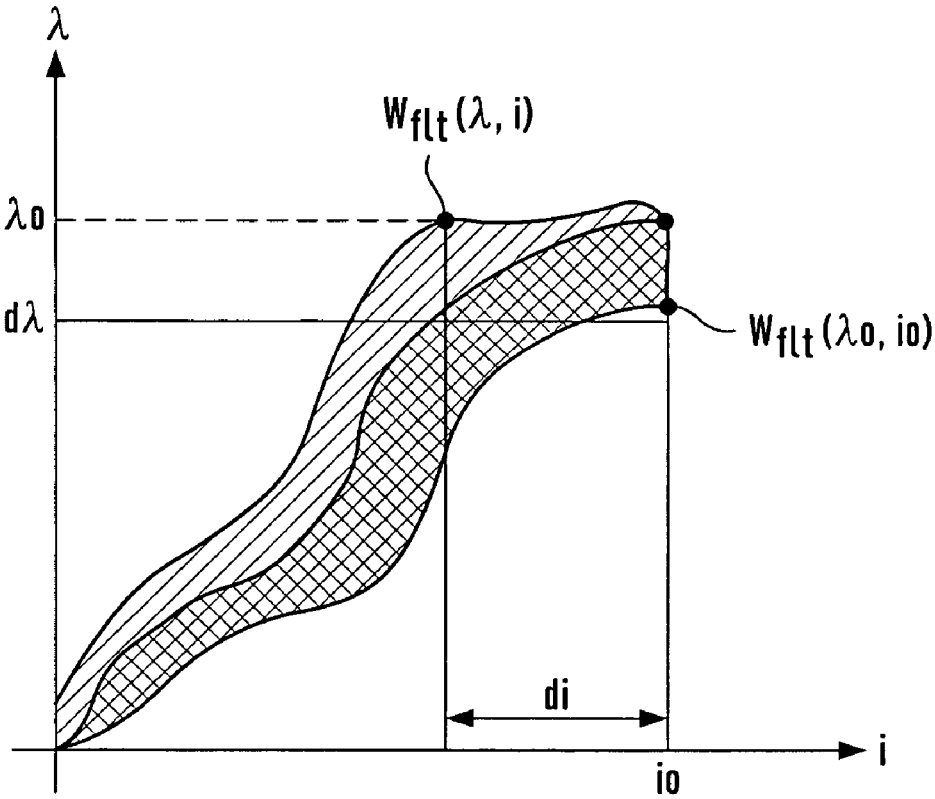
FIG. 7 is a diagram for flux versus current.
Figure 8A:
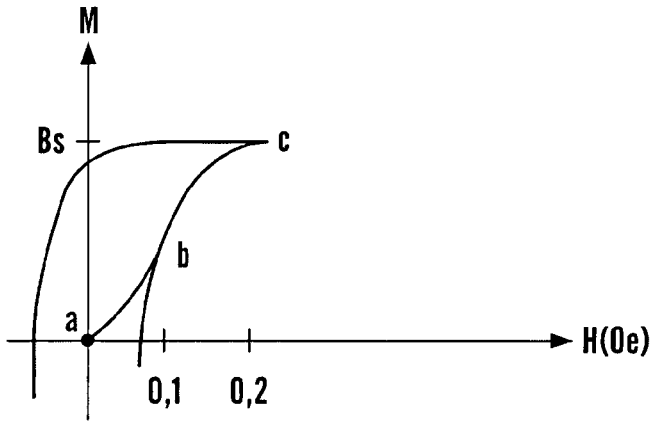
FIGS. 8 and 9 illustrate magnetisation curves and domains for the magnetic material in the device according to an embodiment of the invention.
Figure 8B:
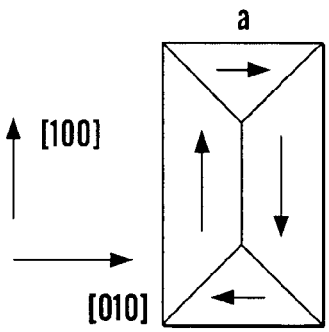
Figure 8B:
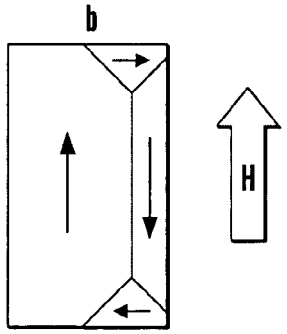
Figure 8D:
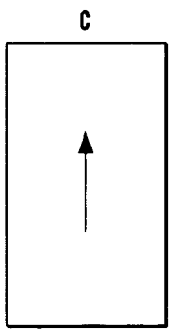

This is illustrated in FIG. 7 where an alteration of λ results in an alteration of the energy in the field Wflt which originally is Wflt(λo, io). A variation is envisaged here which is so small that i is approximately constant during the alteration of λ. In the same way an alteration of i will give an alteration of λ.

Figure 9A:
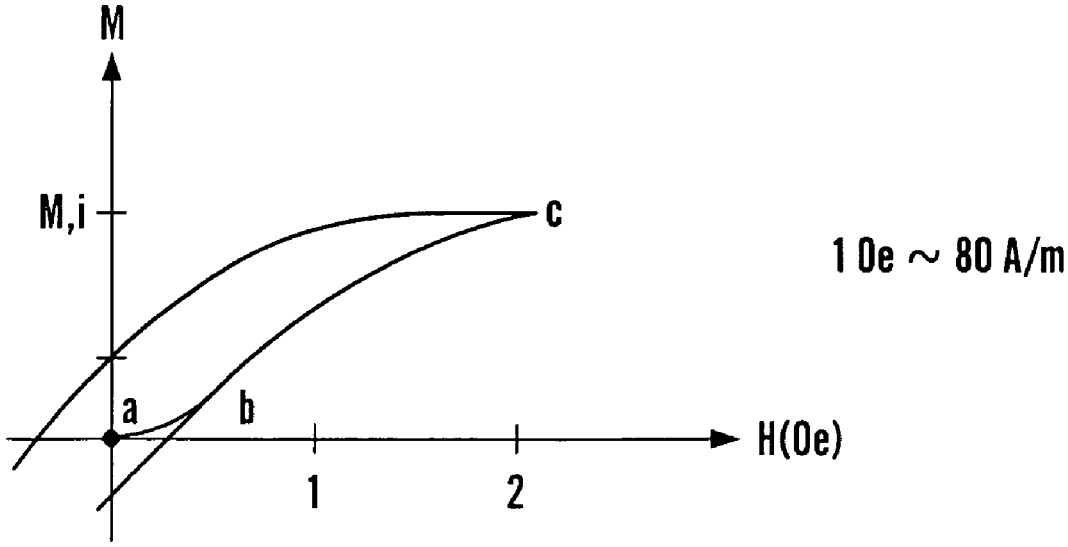
Figure 9B:
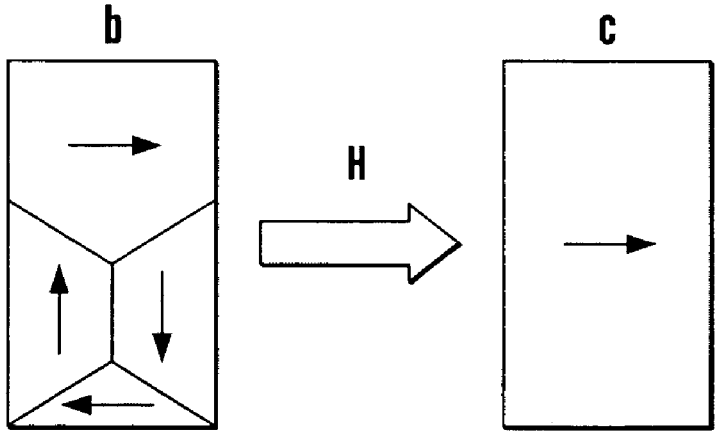

When we look at our variable inductance, therefore, we can say the following:

The substance of what takes place is illustrated in FIG. 8 and FIG. 9.

FIG. 8 illustrates the magnetisation curves for the entire material of the magnetisable body 1 and the domain change under the influence of the H1 field from the main winding 2.

FIG. 9 illustrates the magnetisation curves for the entire material of the magnetisable body 1 and the domain change under the influence of the H2 field in the direction from the control winding 4.

Figure 10A:
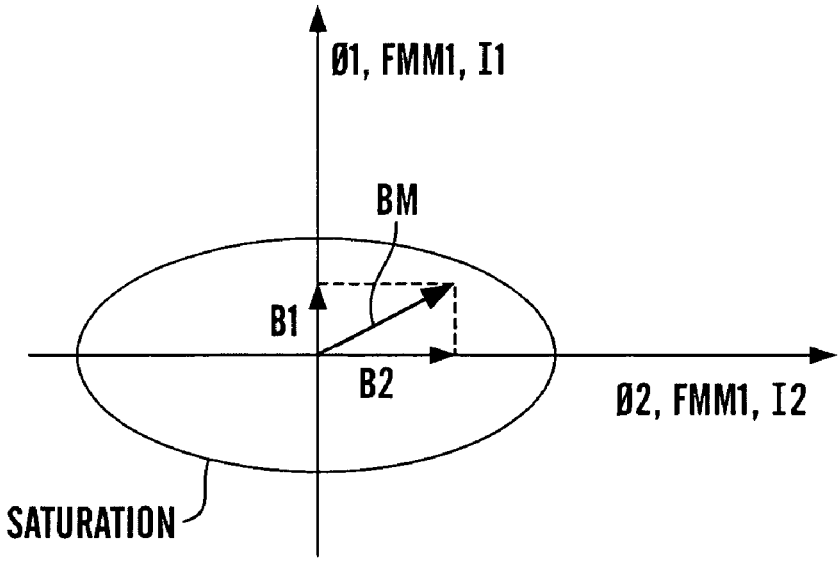
FIG. 10 illustrates flux densities for the main and control windings.
Figure 10B:
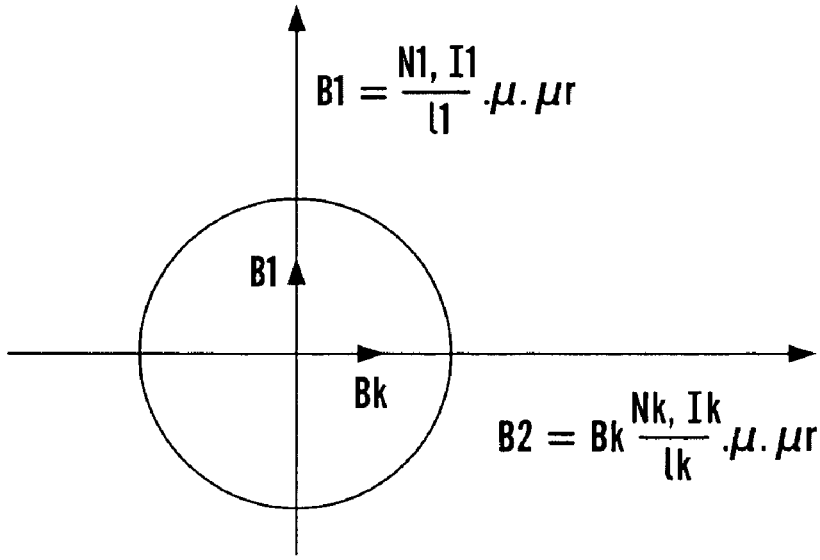

FIGS. 10*a* and 10*b* illustrate the flux densities B1 (where the field H1 is established by the working current), and B2 (corresponding to the control current). The ellipse illustrates the saturation limit for the B fields, i.e. when the B field reaches the limit, this will cause the material of the magnetisable body 1 to reach saturation. The form of the ellipse's axes will be given by the field length and the permeability of the two fields B1 (H1) and B2 (H2) in the core material of the magnetisable body 1.

By having the axes in FIG. 10 express the MMK distribution or the H field distribution, a picture can be seen of the magnetomotive force from the two currents I1 and I2.

We now refer back to FIGS. 8 and 9. By means of a partial magnetisation of the domains by the control field B2 (H2), an additional field B1 (H1) from the main winding 2 will be added vectorially to the control field B2 (H2). The domains are further magnetized and, as a result, the inductance of the main winding 2 will start from the basis given by the state of the domains under the influence of the control field B2 (H2).

The domain magnetisation, the inductance L and the alternating current resistance XL will thereby be varied linearly as a function of the control field B2.

We shall now describe the various embodiments of the device according to the invention, with reference to the remaining Figures.

Figure 11E:
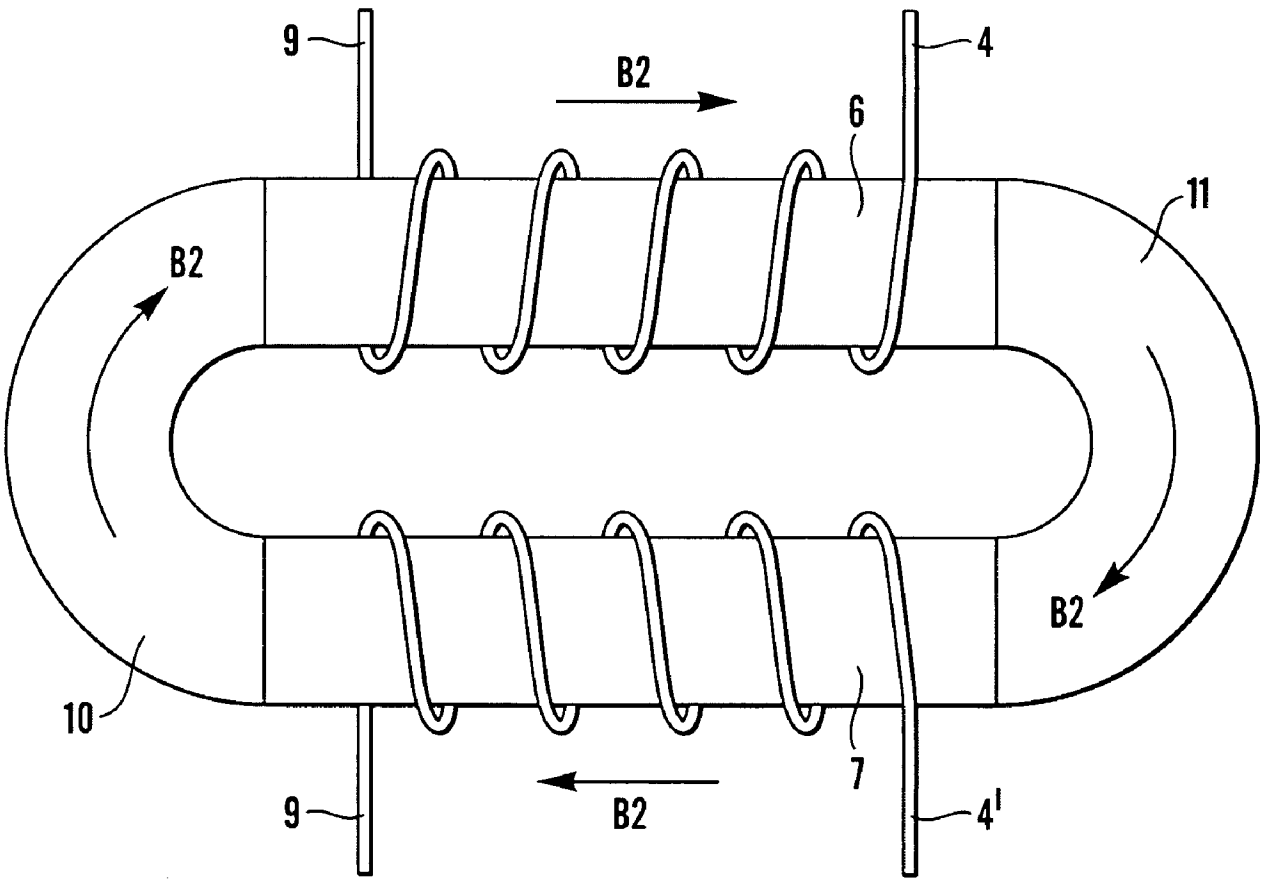
FIG. 11 illustrates a second embodiment of the invention.
Figure 11A:
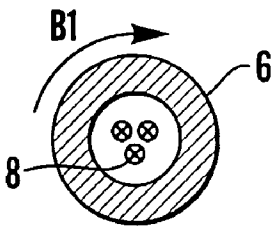
Figure 11B:
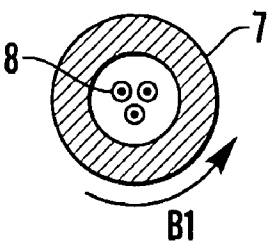

FIG. 11 is a schematic illustration of a second embodiment of the invention.

Figure 12B:
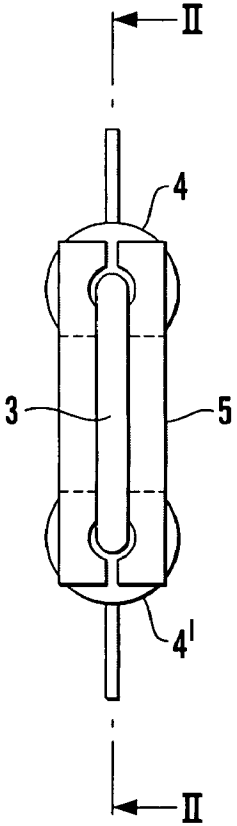
FIG. 12 illustrates the same second embodiment of the invention.
Figure 12A:
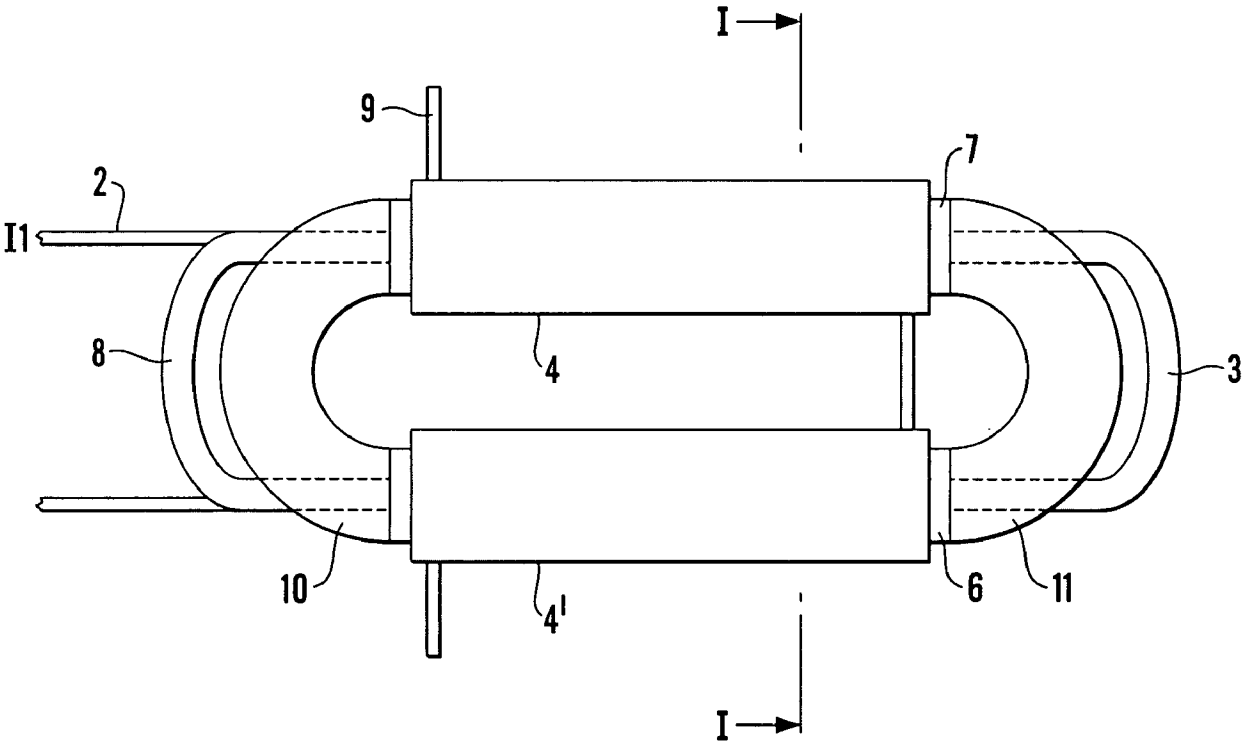

FIG. 12 illustrates the same embodiment of a magnetically influenced connector according to the invention, where FIG. 12*a* illustrates the assembled connector and FIG. 12*b* illustrates the connector viewed from the end.

Figure 13:
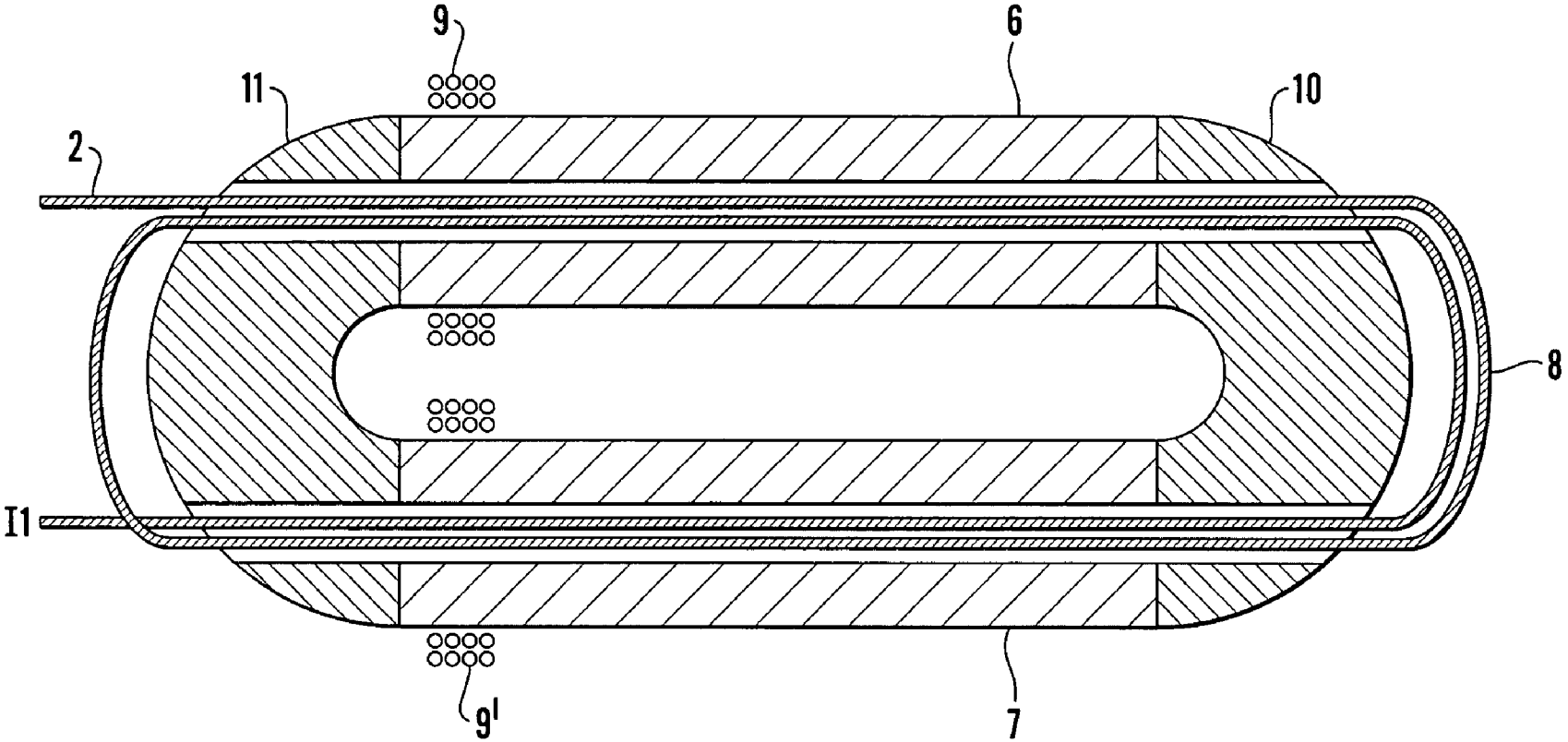
FIGS. 13 and 14 illustrate the second embodiment in section.

FIG. 13 illustrates a section along line II in FIG. 12*b*.

As illustrated in the Figures the magnetisable body 1 is composed of inter alia two parallel tubes 6 and 7 made of magnetisable material. An electrically insulated conductor 8 (FIGS. 12*a*, 13) is passed continuously in a path through the first tube 6 and the second tube 7 N number of times, where N=1, . . . r, forming the first main winding 2, with the conductor 8 extending in the opposite direction through the two tubes 6 and 7, as is clearly illustrated in FIG. 13. Even though the conductor 8 is only shown extending through the first tube 6 and the second tube 7 twice, it should be self-explanatory that it is possible for the conductor 8 to extend through respective tubes either only once or possibly several times (as indicated by the fact that the winding number N can vary from 0 to r), in order to create a magnetic field H1 in the parallel tubes 6 and 7 when the conductor is excited. A combined control and magnetisation winding 4, 4', composed of the conductor 9, is wound round the first tube and the second tube (6 and 7 respectively) in such a manner that the direction of the field H2 (B2) which is created in the said tubes when the winding 4 is excited will be oppositely directed, as indicated by the arrows for the field B2 (H2) in FIG. 11. The magnetic field connectors 10, 11 are mounted at the ends of the respective pipes 6, 7 in order to interconnect the tubes fieldwise in a loop. The conductor 8 will be able to carry a load current I1 (FIG. 12*a*). The tubes' 6, 7 length and diameter will be determined on the basis of the power and voltage which have to be connected. The number of turns N1 on the main winding 2 will be determined by the reverse blocking ability for voltage and the cross-sectional area of the extent of the working flux $\phi$2. The number of turns N2 on the control winding 4 is determined by the fields required for saturation of the magnetisable body 1, which comprises the tubes 6, 7 and the magnetic field connectors 10, 11.

Figure 14:
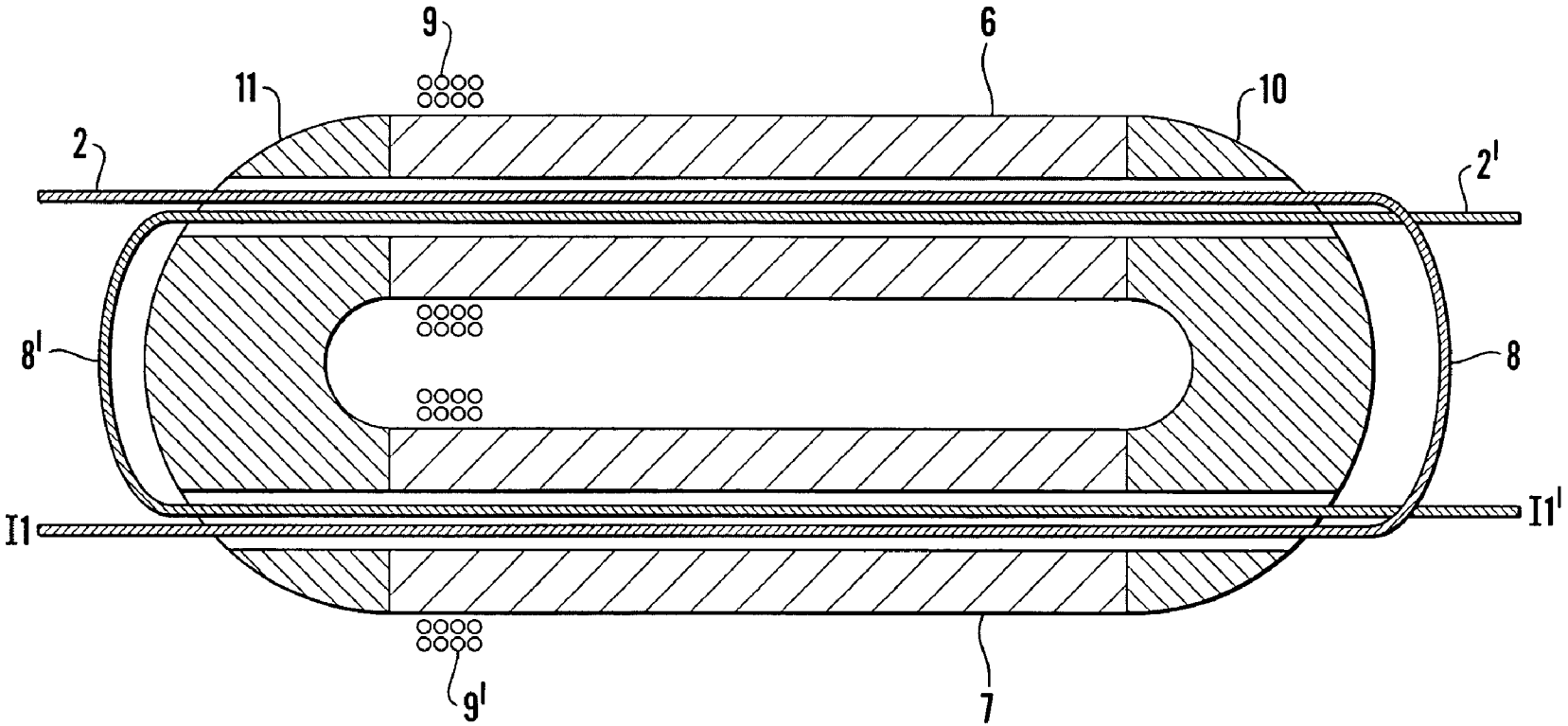

FIG. 14 illustrates a special design of the main winding 2 in the device according to the invention. In reality, the solution in FIG. 14 differs from that illustrated in FIGS. 12 and 13 only by the fact that instead of a single insulated conductor 8 which is passed through the pipes 6 and 7, two separate oppositely directed conductors, so-called primary conductors 8 and secondary conductors 8' are employed, in order thereby to achieve a voltage converter function for the magnetically influenced device according to the invention. This will now be explained in more detail. The design is basically similar to that illustrated in FIGS. 11, 12 and 13. The magnetisable body 1 comprises two parallel tubes 6 and 7. An electrically insulated primary conductor 8 is passed continuously in a path through the first tube 6 and the second tube 7 N1 number of times, where N1=1, . . . r, with the primary conductor 8 extending in the opposite direction through the two tubes 6 and 7. An electrically insulated secondary conductor 8' is passed continuously in a path through the first tube 6 and the second tube 7 N1' number of times, where N1'=1, . . . r, with the secondary conductor 8' extending in the opposite direction relative to the primary conductor 8 through the two tubes 6 and 7. At least one combined control and magnetisation winding 4 and 4' is wound round the first tube 6 and the second tube 7 respectively, with the result that the field direction created on the said tube is oppositely directed. As for the embodiment according to FIGS. 11, 12 and 13, magnetic field connectors 10, 11 are mounted on the end of respective tubes (6, 7) in order to interconnect the tubes 6 and 7 fieldwise in a loop, thereby forming the magnetisable body 1. Even though for the sake of simplicity the primary conductor 8 and the secondary conductor 8' are illustrated in the drawings with only one pass through the tubes 6 and 7, it will be immediately apparent that both the primary conductor 8 and the secondary conductor 8' will be able to be passed through the tubes 6 and 7 N1 and N1' number of times respectively. The tubes' 6 and 7 length and diameter will be determined on the basis of the power and voltage which have to be converted. For a transformer with a conversion ratio (N1:N1') equal to 10:1, in practice ten conductors will be used as primary conductors 8 and only one secondary conductor 8'.

Figure 15A:
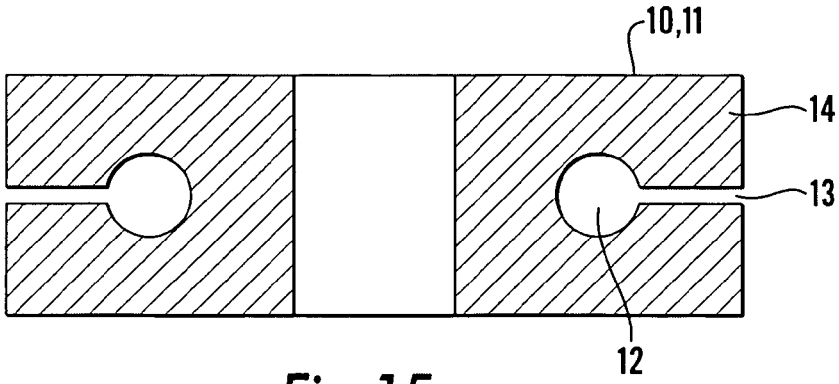
FIGS. 15–18 illustrate different embodiments of the magnetic field connectors in the said second embodiment of the invention.
Figure 15B:
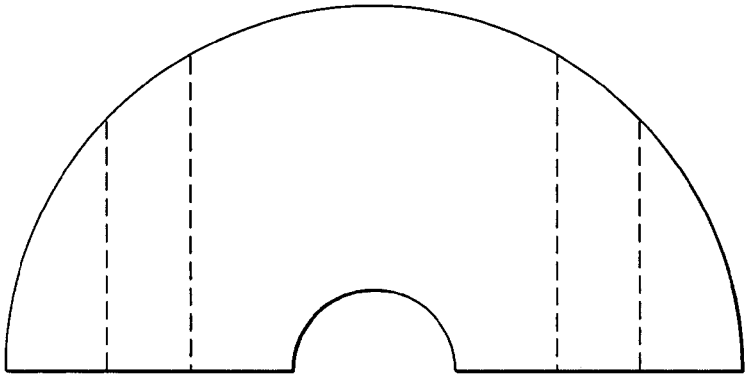
Figure 15C:
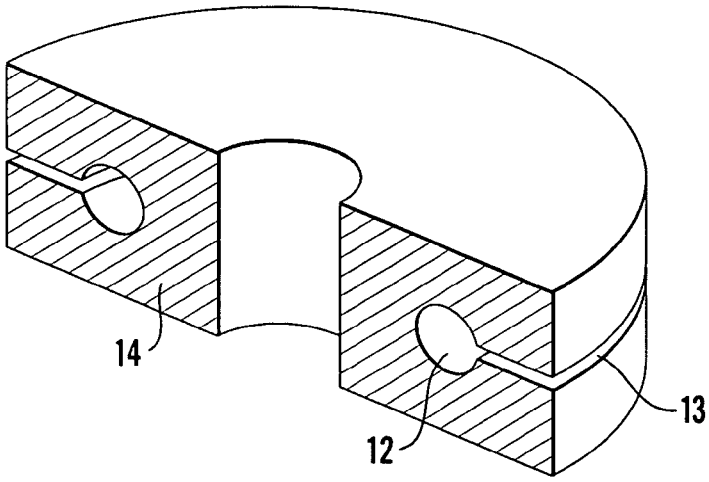

An embodiment of magnetic field connectors 10 and/or 11 is illustrated in FIG. 15. A magnetic field connector 10, 11 is illustrated, composed of a magnetically conducting material, wherein two preferably circular apertures 12 for the conductor 8 in the main winding 2 (see, e.g. FIG. 13) are machined out of the magnetic material in the connectors 10, 11. Moreover, there is provided a gap 13 which interrupts the magnetic field path of the conductor 8. End surface 14 is the connecting surface for the magnetic field H2 from the control winding 4 consisting of conductors 9 and 9' (FIG. 13).

Figure 16:
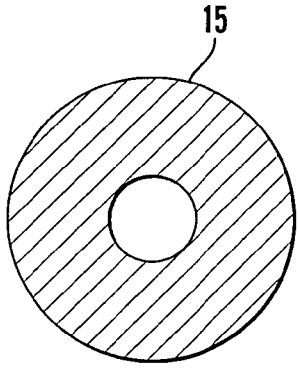

FIG. 16 illustrates a thin insulating film 15 which will be placed between the end surface on tubes 6 and 7 and the magnetic field connector 10, 11 in a preferred embodiment of the invention.

Figure 17A:
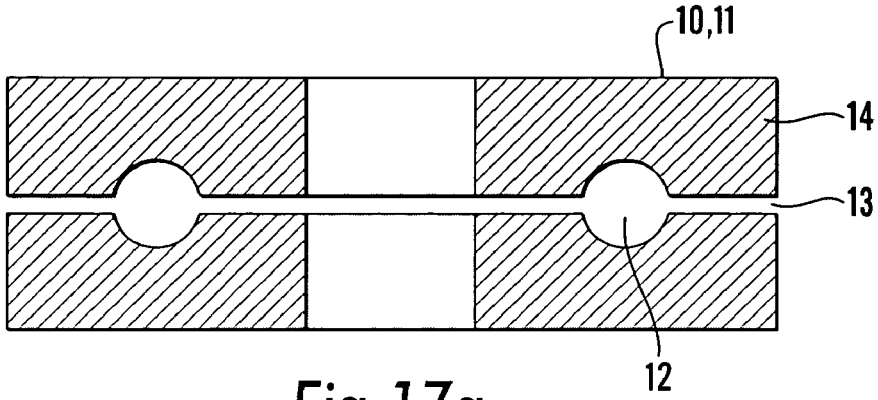
Figure 17B:
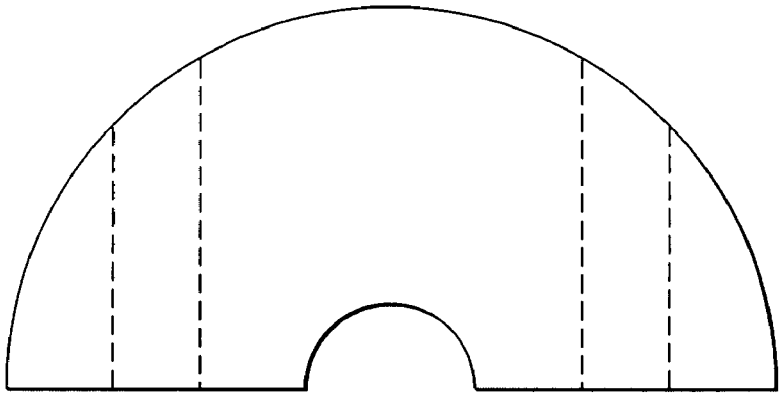
Figure 17C:
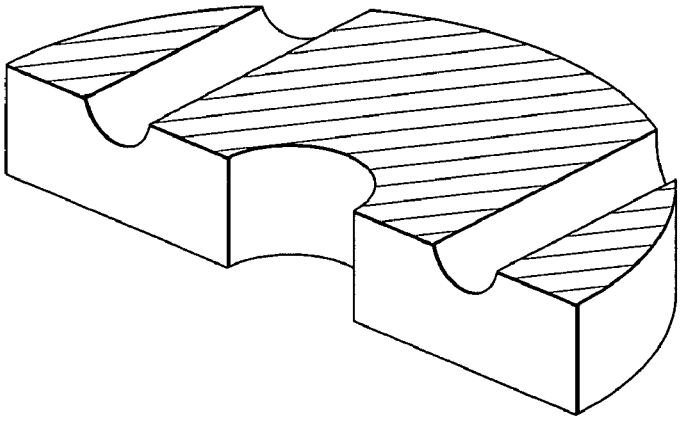
Figure 18A:
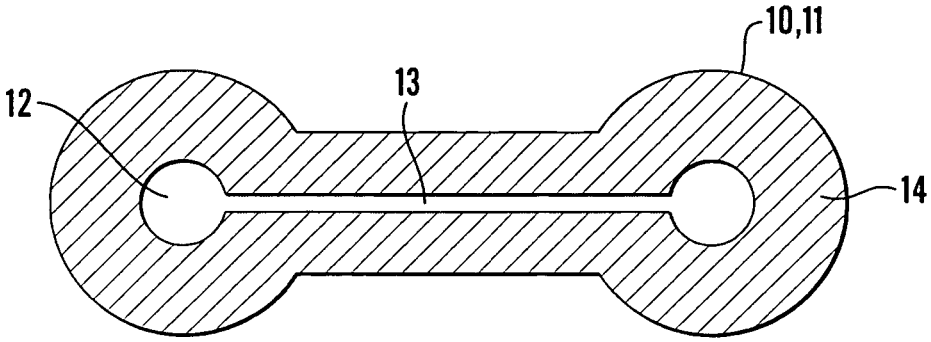
Figure 18B:
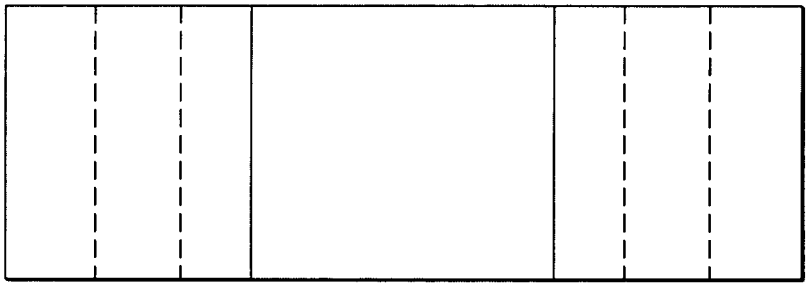
Figure 18C:
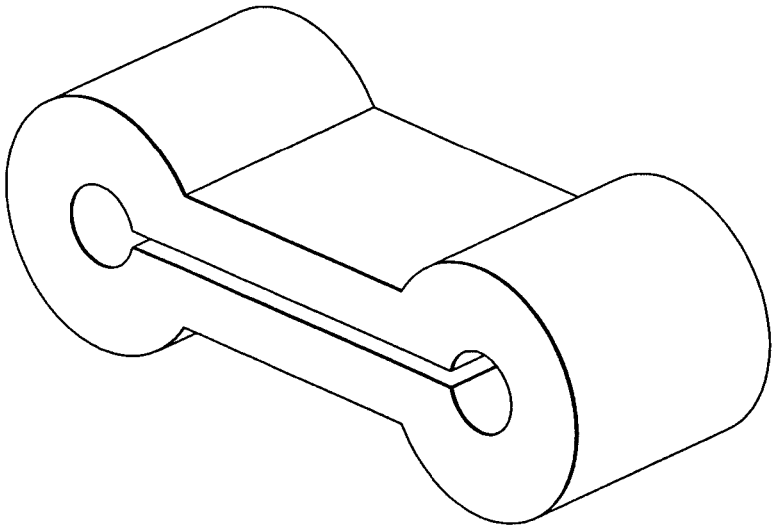

FIGS. 17 and 18 illustrate other alternative embodiments of the magnetic field connectors 10, 11.

FIGS. 19–32 illustrate various embodiments of a core 16 which in the embodiment illustrated in FIGS. 12, 13 and 14 forms the main part of the tubes 6 and 7 which preferably together with the magnetic field connectors 10 and 11 form the magnetisable body 1.

Figure 19:
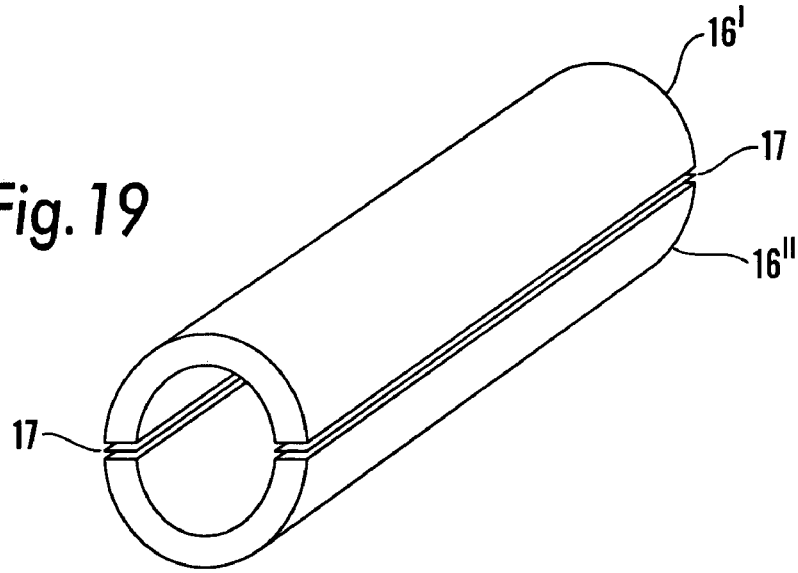
FIGS. 19–32 illustrate different embodiments of the tubular bodies in the second embodiment of the invention.

FIG. 19 illustrates a cylindrical core part 16 which is divided lengthwise as illustrated and where there are placed one or more layers 17 of an insulating material between the two core halves 16', 16".

Figure 20:
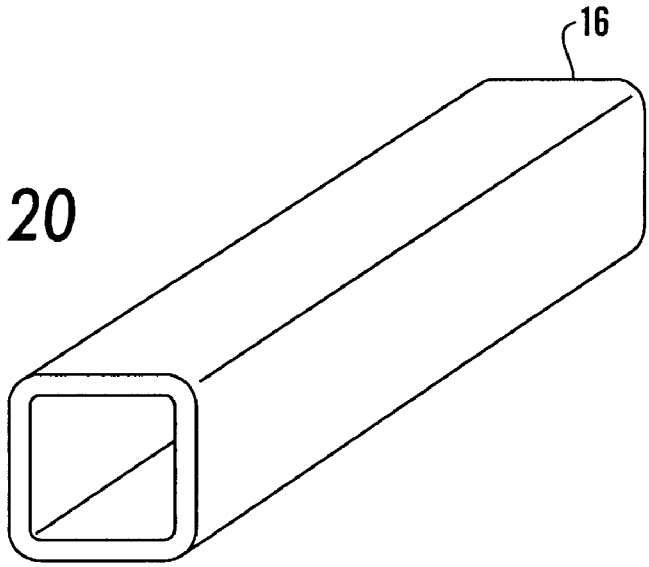
Figure 21:
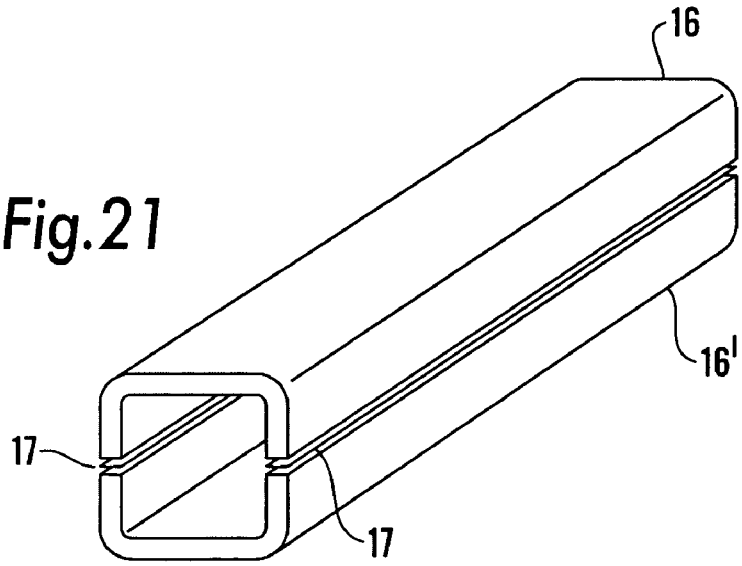
Figure 22:
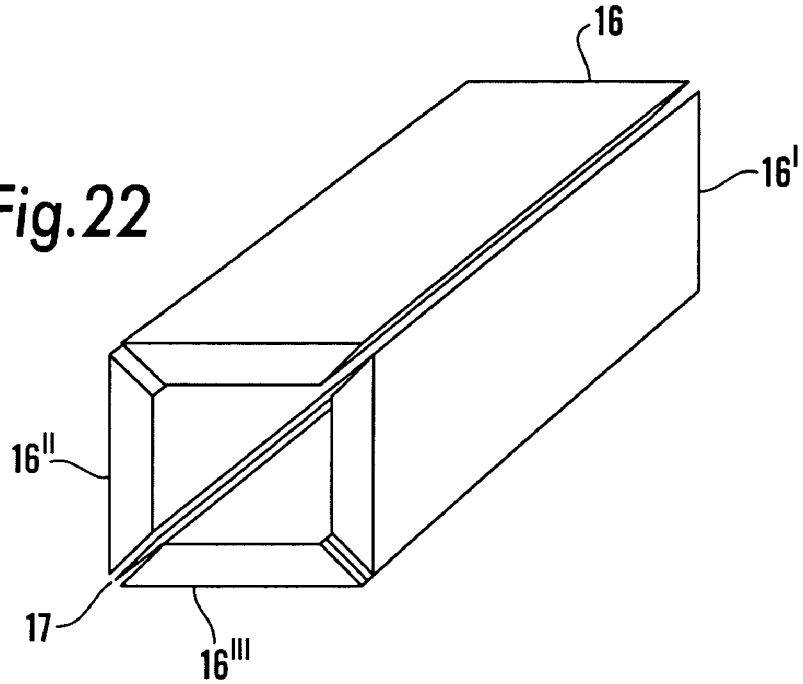

FIG. 20 illustrates a rectangular core part 16 and FIG. 21 illustrates an embodiment of this core part 16 where it is divided in two with partial sections in the lateral surface. In the embodiment illustrated in FIG. 21, one or more layers of an insulating material 17 are provided between the core halves 16, 16'. A further variant is illustrated in FIG. 22 where the partial section is placed in each corner.

Figure 23:
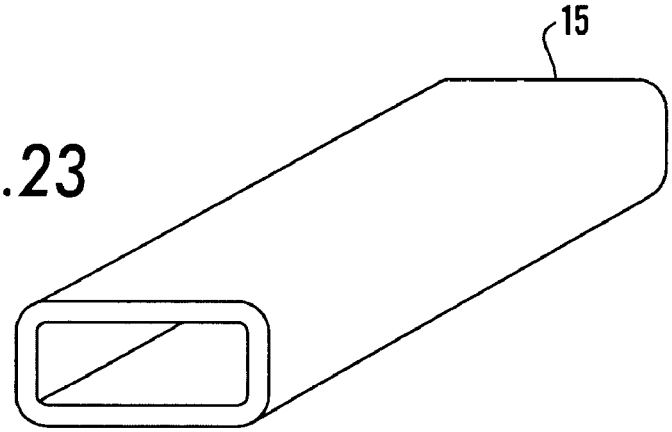
Figure 24:
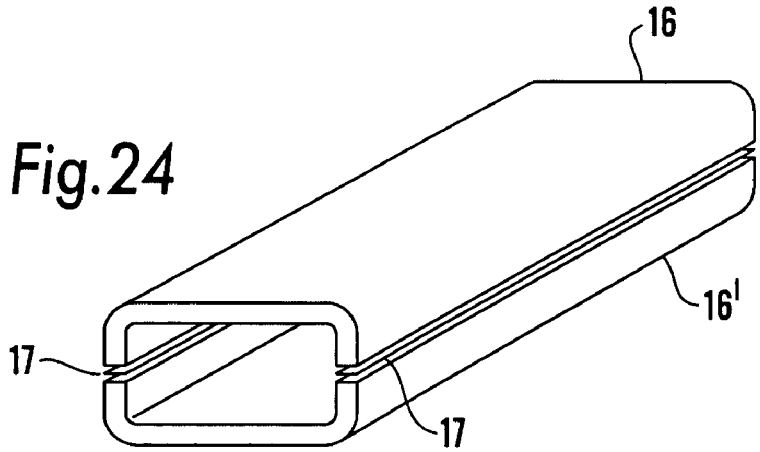
Figure 25:
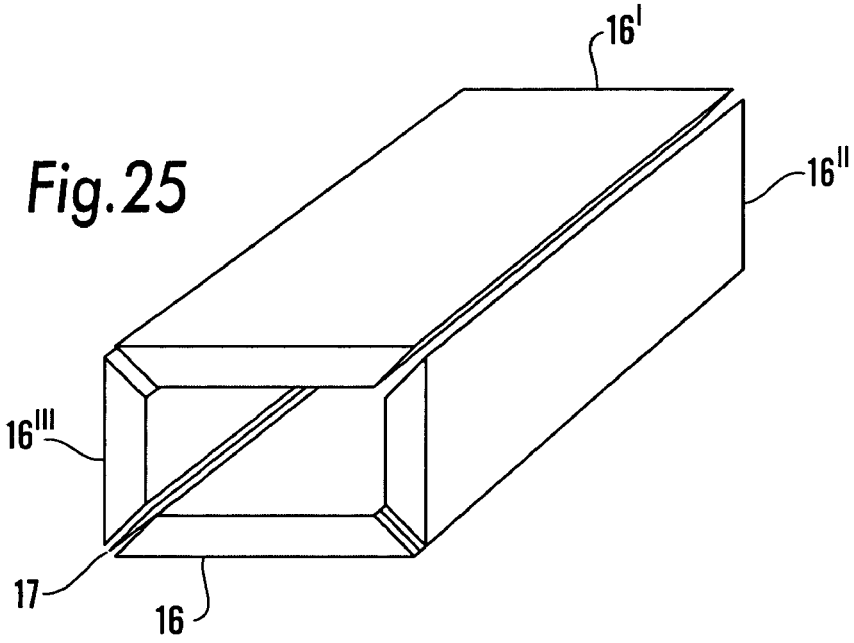
Figure 26:
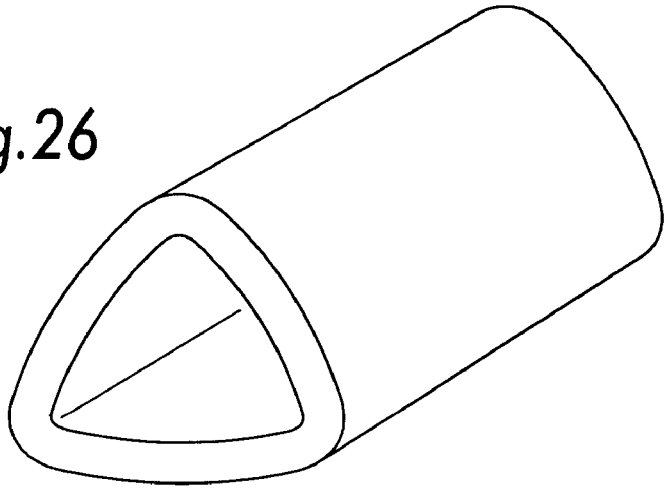
Figure 27:
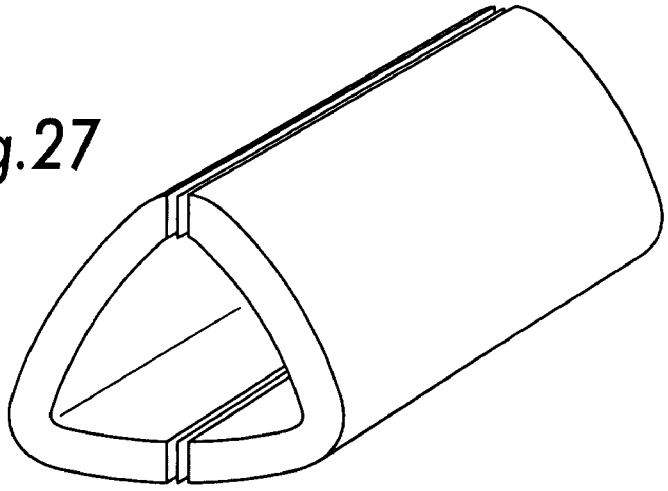
Figure 28:
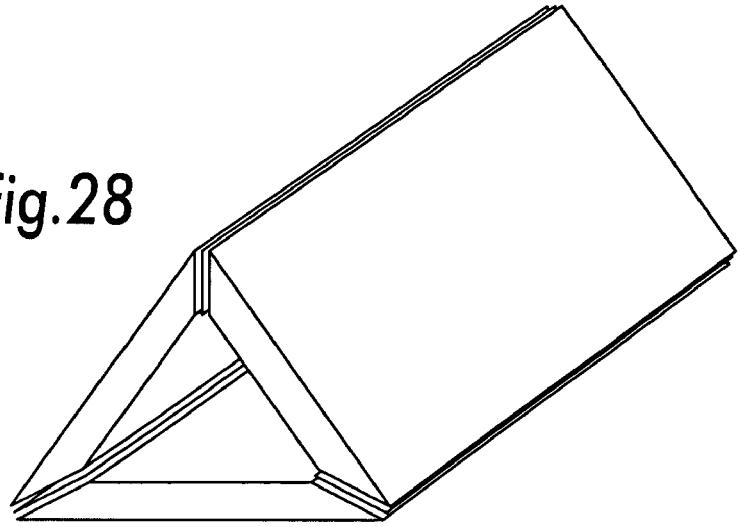
Figure 29:
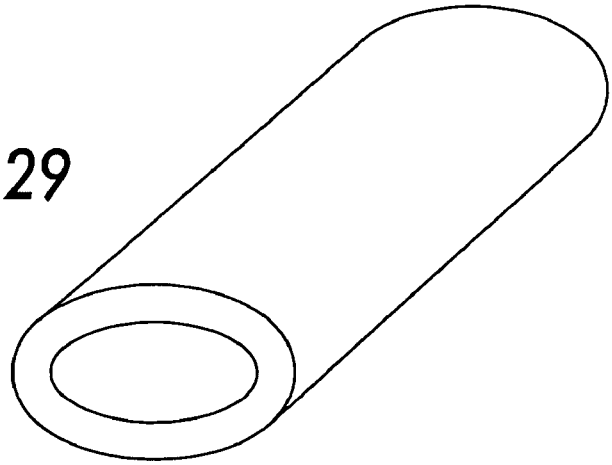
Figure 30:
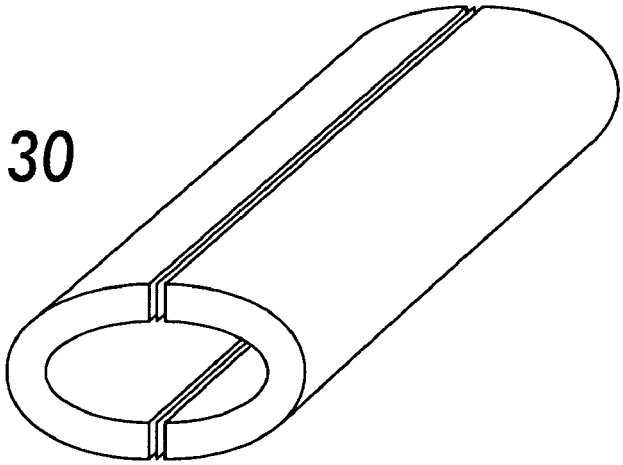
Figure 31:
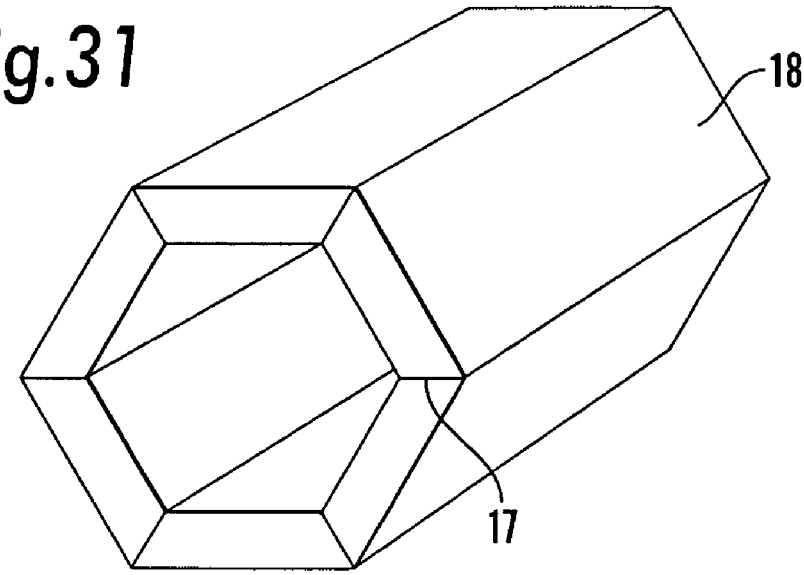
Figure 32:
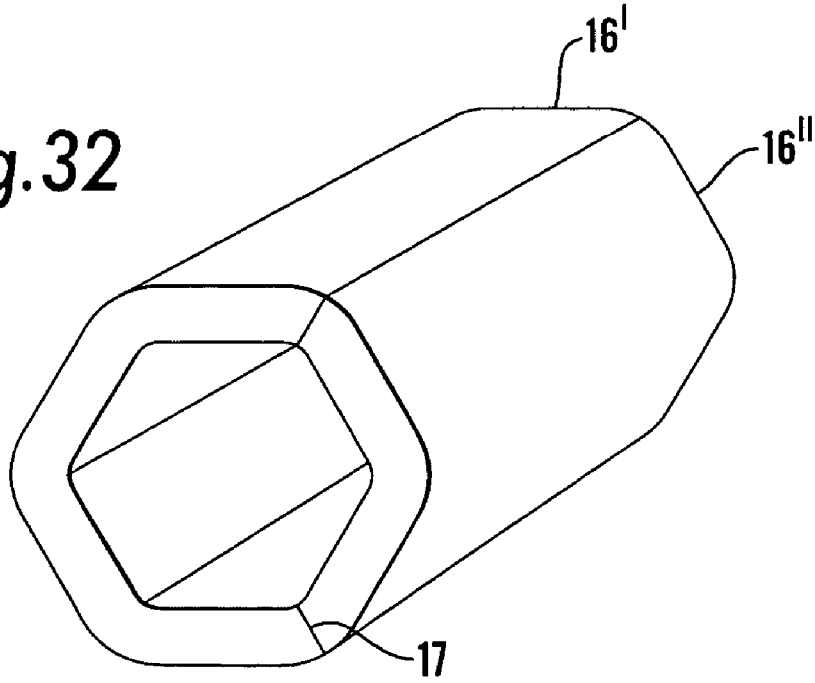
Figure 33A:
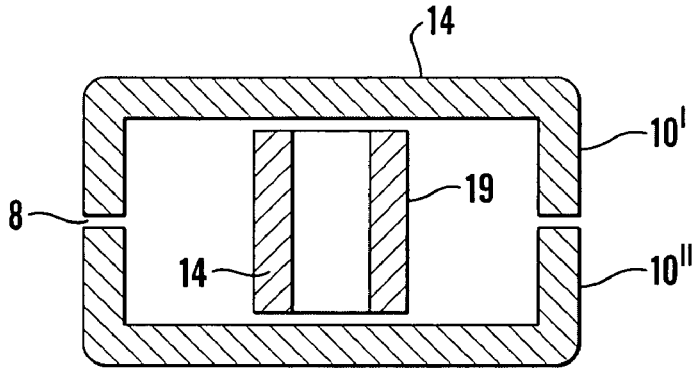
FIGS. 33–38 illustrate different aspects of the magnetic field connectors for use in the second embodiment of the invention.
Figure 33B:
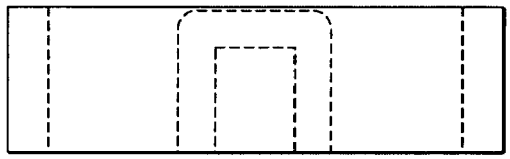
Figure 33C:
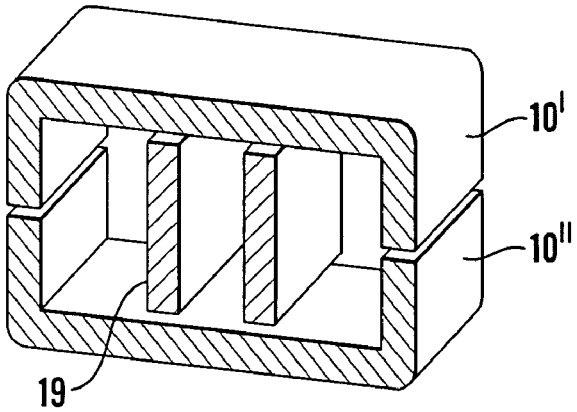
Figure 33D:
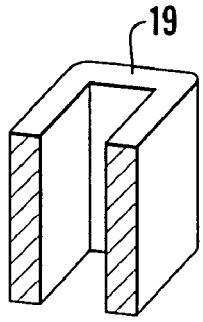

FIGS. 23, 24 and 25 illustrate a rectangular shape. FIGS. 26, 27 and 28 illustrate the same for a triangular shape. FIGS. 29 and 30 illustrate an oval variant, and finally FIGS. 31 and 32 illustrate a hexagonal shape. In FIG. 31 the hexagonal shape is composed of 6 equal surfaces 18 and in FIG. 30 the hexagon consists of two parts 16' and 16". Reference numeral 17 refers to a thin insulating film.

Figure 34:
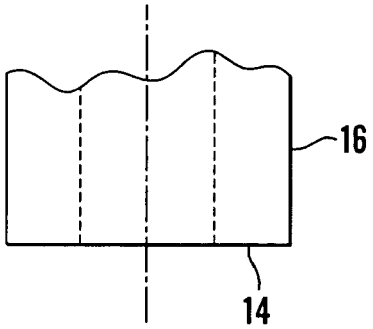

FIGS. 33 and 34 illustrate a magnetic field connector 10, 11 which can be used as a control field connector between the rectangular and square main cores 16 (illustrated in FIGS. 20–21 and 23–25 respectively). This magnetic field connector comprises three parts 10', 10" and 19.

FIG. 34 illustrates an embodiment of the core part or main core 16 where the end surface 14 or the connecting surface for the control flux is at right angles to the axis of the core part 16.

Figure 35:
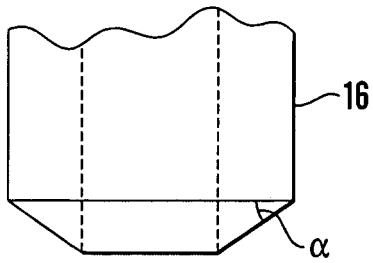

FIG. 35 illustrates a second embodiment of the core part 16 where the connecting surface 14 for the control flux is at an angle $\alpha$ to the axis of the core part 16.

Figure 36:
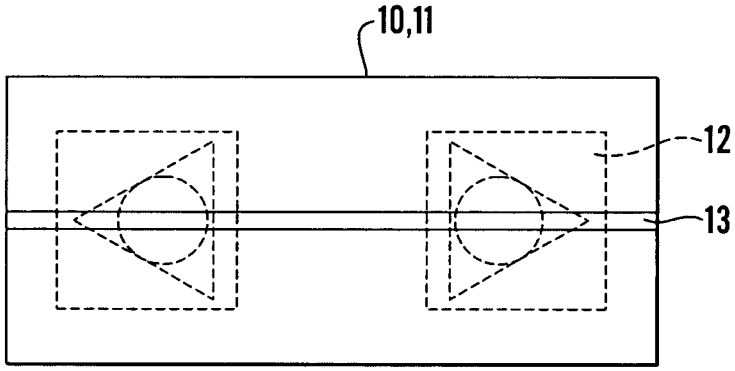
Figure 37:
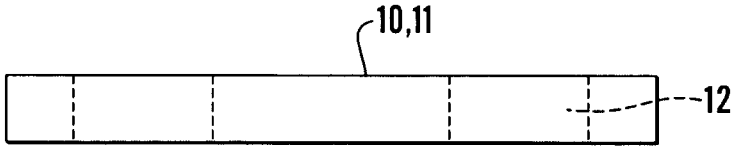
Figure 38:
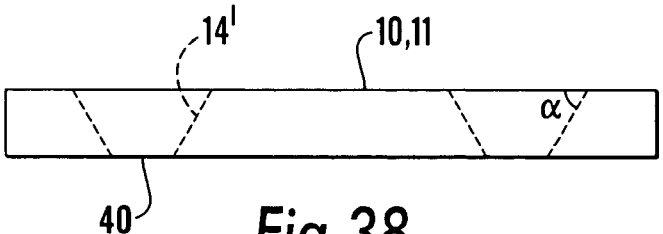

FIGS. 36–38 illustrate various designs of the magnetic field connector 10, 11, which are based on the fact that the connecting surfaces 14' of the magnetic field connector 10, 11 are at the same angle as the end surfaces 14 to the core part 16.

FIG. 36 illustrates a magnetic field connector 10, 11 in which different hole shapes 12 are indicated for the main winding 2 on the basis of the shape of the core part 16 (round, triangular, etc.).

In FIG. 37 the magnetic connector 10, 11 is flat. It is adapted for use with core parts 16 with right-angled end surfaces 14.

In FIG. 38 an angle $\alpha'$ is indicated to the magnetic field connector 10, 11, which is adapted to the angle $\alpha$ to the core part (FIG. 35), thus causing the end surface 14 and the connecting surface 14' to coincide.

Figure 39A:
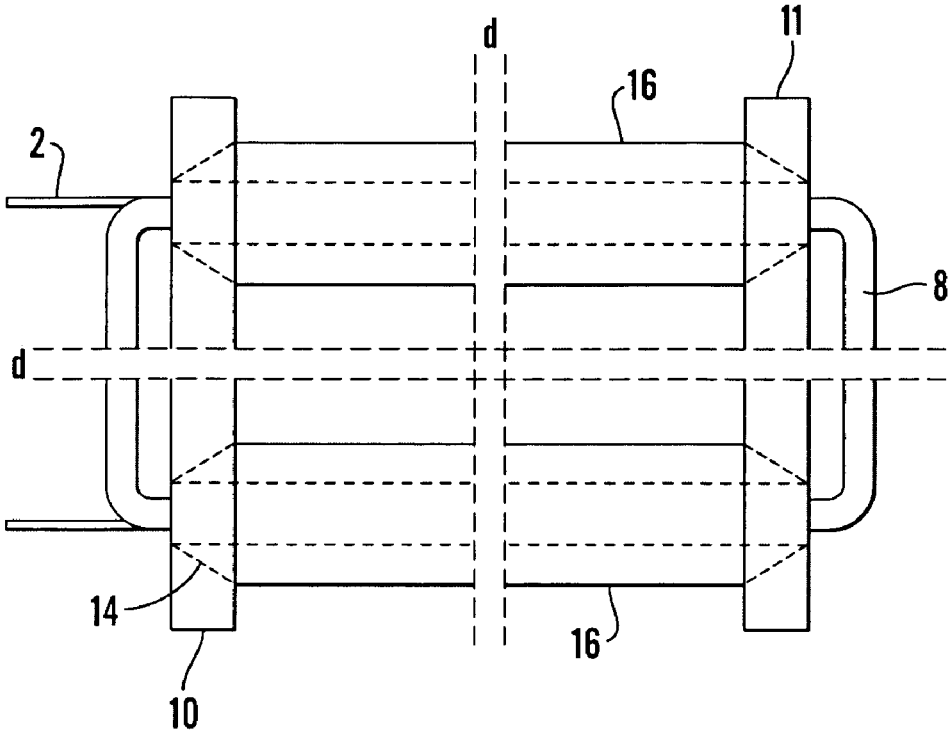
FIG. 39 illustrates an assembled device according to the second embodiment of the invention.
Figure 39B:
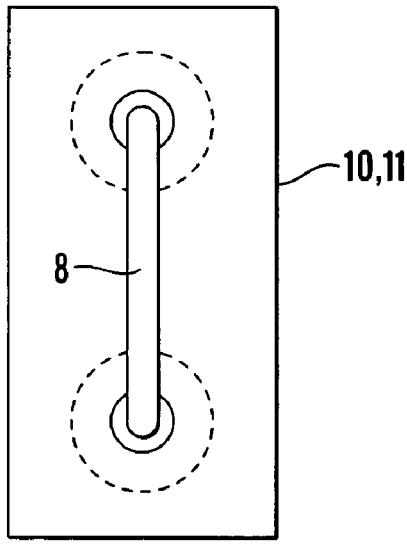

In FIG. 39 an embodiment of the invention is illustrated with an assembly of magnetic field connectors 10, 11 and core parts 16. FIG. 39*b* illustrates the same embodiment viewed from the side.

Even though only individual combinations of magnetic field connectors and core parts are described in order to illustrate the invention, it will be obvious to a person skilled in the art that other combinations are entirely possible and will thus fall within the scope of the invention.

It will also be possible to switch the positions of the control winding and the main winding.

Figure 40A:
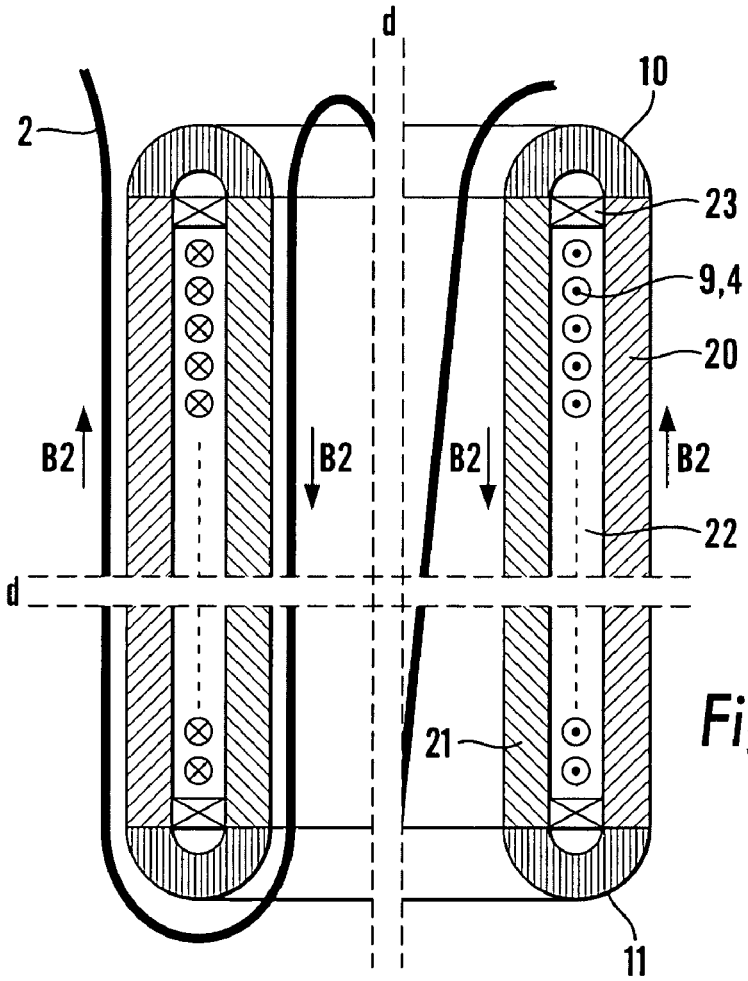
FIGS. 40 and 41 are a section and a view of a third embodiment of the invention.
Figure 40B:
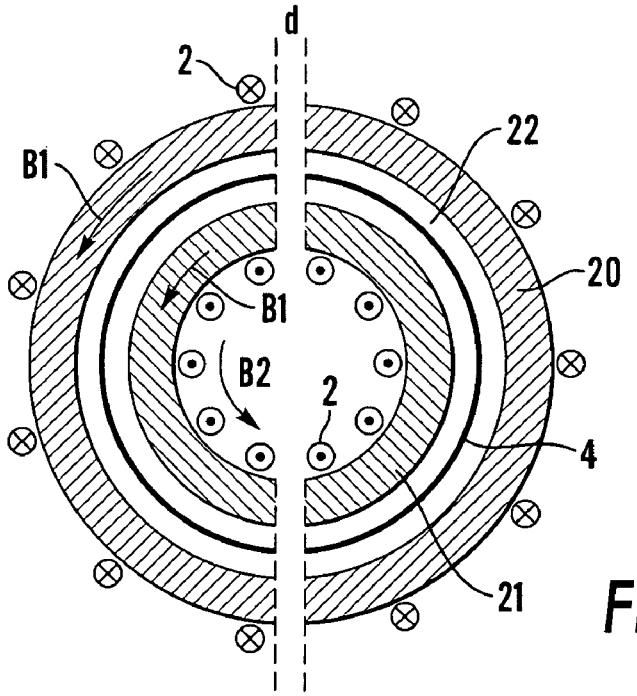
Figure 41A:
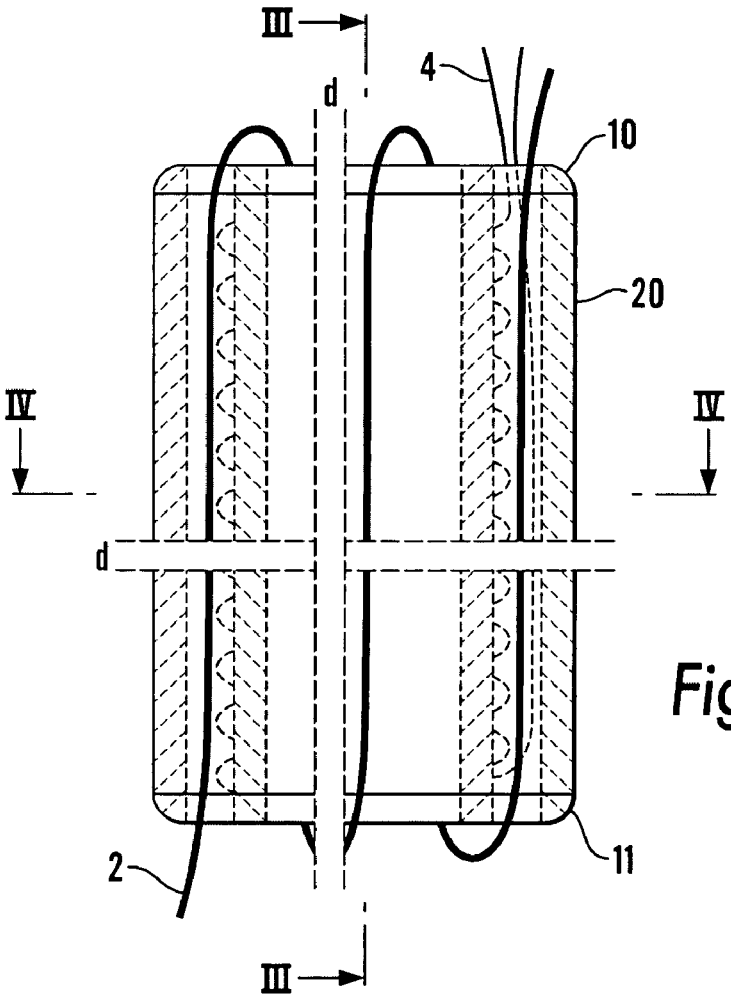
Figure 41B:
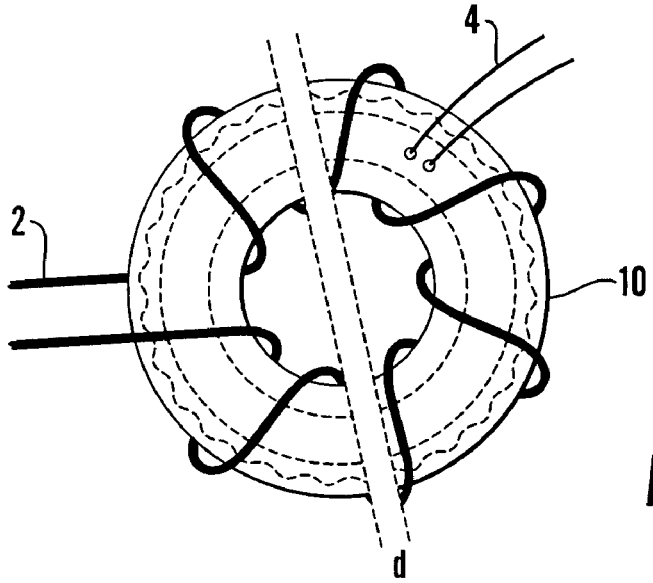

FIGS. 40 and 41 are a sectional illustration and view respectively of a third embodiment of a magnetically influenced voltage connector device. The device comprises (see FIG. 40*b*) a magnetisable body 1 comprising an external tube 20 and an internal tube 21 (or core parts 16, 16') which are concentric and made of a magnetisable material with a gap 22 between the external tube's 20 inner wall and the internal tube's 21 outer wall. Magnetic field connectors 10, 11 between the tubes 20 and 21 are mounted at respective ends thereof (FIG. 40*a*). A spacer 23 (FIG. 40*a*) is placed in the gap 22, thus keeping the tubes 20, 21 concentric. A combined control and magnetisation winding 4 composed of conductors 9 is wound round the internal tube 21 and is located in the said gap 22. The winding axis A2 for the control winding therefore coincides with the axis A1 of the tubes 20 and 21. An electrical current-carrying or main winding 2 composed of the current conductor 8 is passed through the internal tube 21 and along the outside of the external tube 20 N1 number of times, where N1=1, . . . r. With the combined control and magnetisation winding 4 in co-operation with the main winding 2 or the said current-carrying conductor 8, an easily constructed but efficient magnetically influenced voltage connector is obtained. This embodiment of the device may also be modified in such a manner that the tubes 20, 21 do not have a circular cross section, but a cross section which is square, rectangular, triangular, etc.

It is also possible to wind the main winding round the internal tube 21, in which case the axis A2 of the main winding will coincide with the axis A1 of the tubes, while the control winding is wound about the tubes on the inside of 21 and the outside of 20.

Figure 42A:
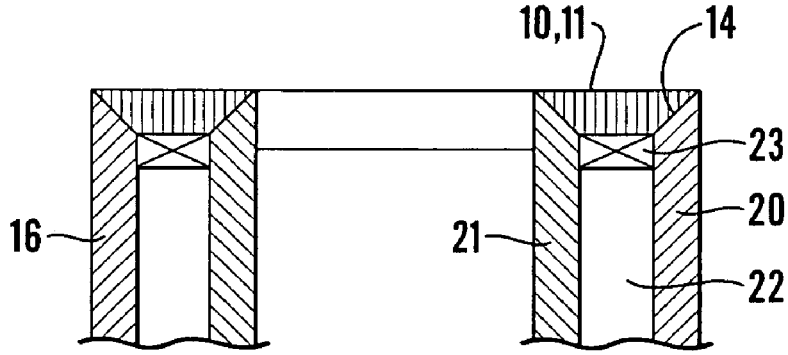
FIGS. 42, 43 and 44 illustrate special embodiments of magnetic field connectors for use in the third embodiment of the invention.
Figure 42B:
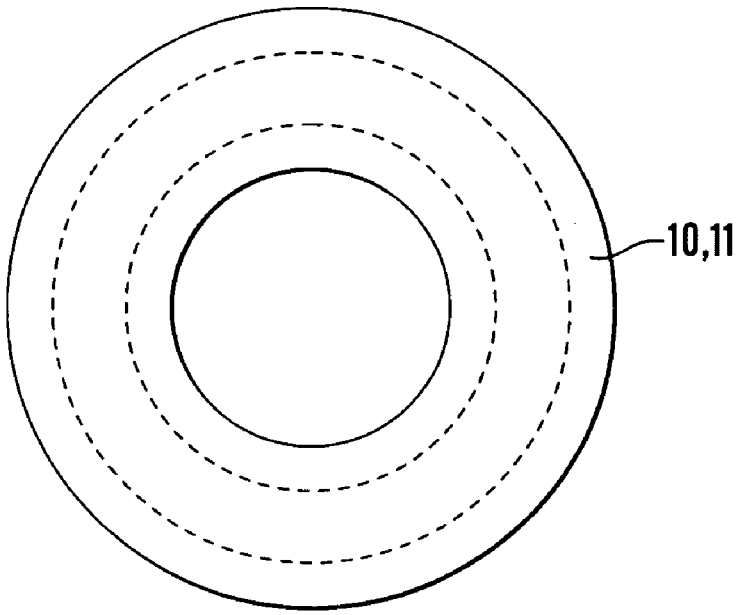
Figure 43:
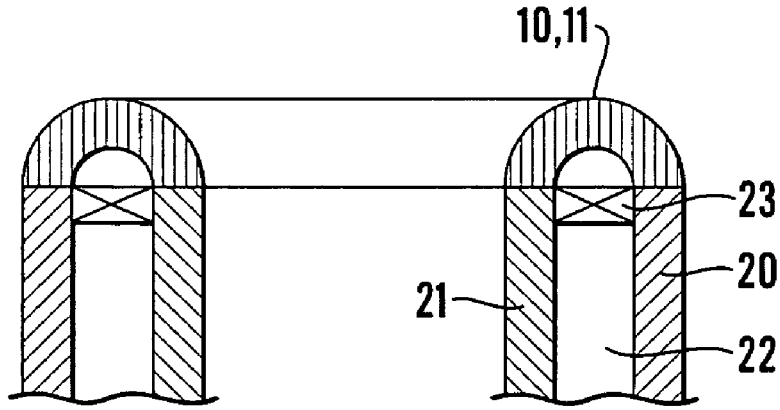
Figure 44:
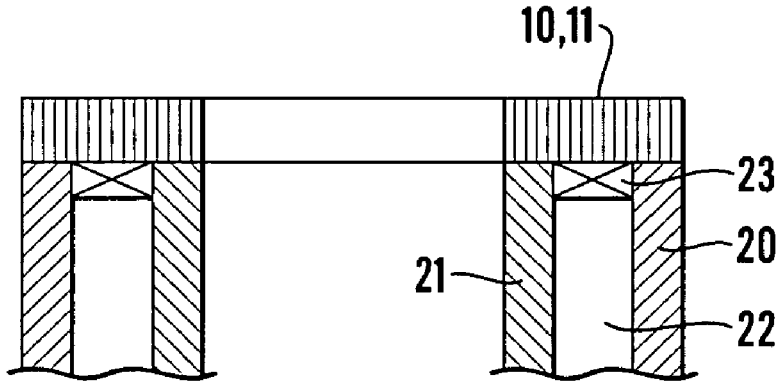

FIGS. 42–44 illustrate various embodiments of the magnetic field connector 10, 11 which are specially adapted to the latter design of the invention, i.e. as described in connection with FIGS. 40 and 41.

FIG. 42*a* illustrates in section and FIG. 42*b* in a view from above a magnetic field connector 10, 11 with connecting surfaces 14' at an angle relative to the axis of the tubes 20, 21 (the core parts 16) and it is obvious that the internal 21 and external 20 tubes should also be at the same angle to the connecting surfaces 14.

FIGS. 43 and 44 illustrate other variants of the magnetic field connector 10, 11, where the connecting surfaces 14' of the control field H2 (B2) are perpendicular to the main axis of the core parts 16 (tubes 20, 21).

FIG. 43 illustrates a hollow semi-toroidal magnetic field connector 10, 11 with a hollow semi-circular cross section, while FIG. 44 illustrates a toroidal magnetic field connector with a rectangular cross section.

Figure 45A:
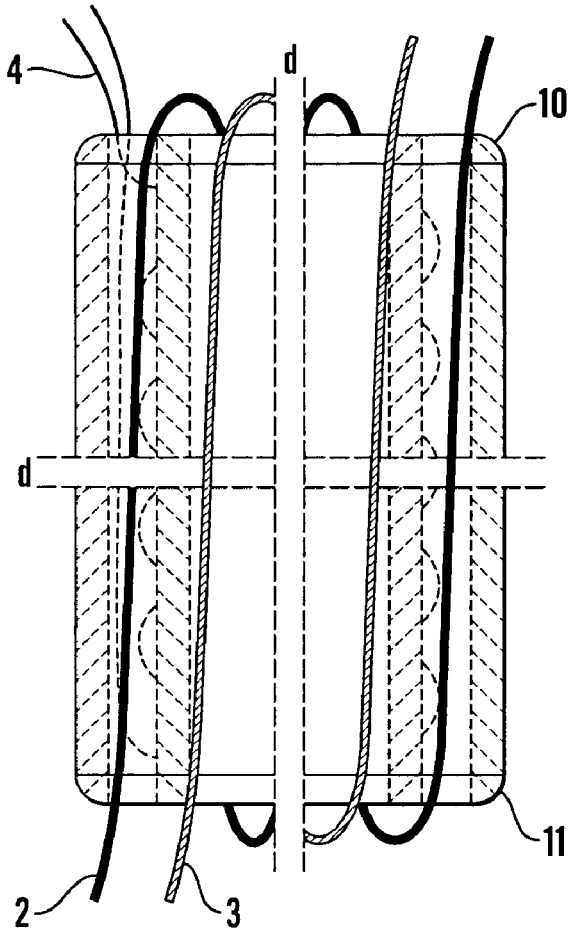
FIG. 45 illustrates the third embodiment of the invention adapted for use as a transformer.
Figure 45B:
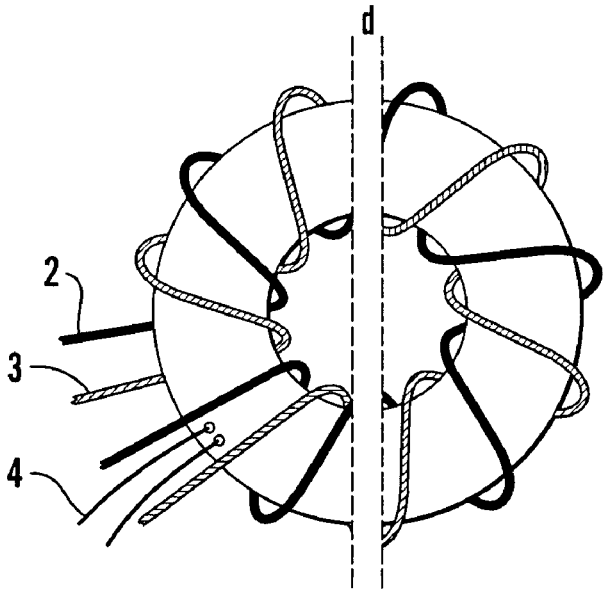

A variant of the device illustrated in FIGS. 40 and 41 is illustrated in FIG. 45, where FIG. 45*a* illustrates the device from the side while 45*b* illustrates it from above. The only difference from the voltage connector in FIGS. 40–41 is that a second main winding 3 is wound in the same course as the main winding 2. By this means an easily constructed, but efficient magnetically influenced voltage converter is obtained.

Figure 46A:
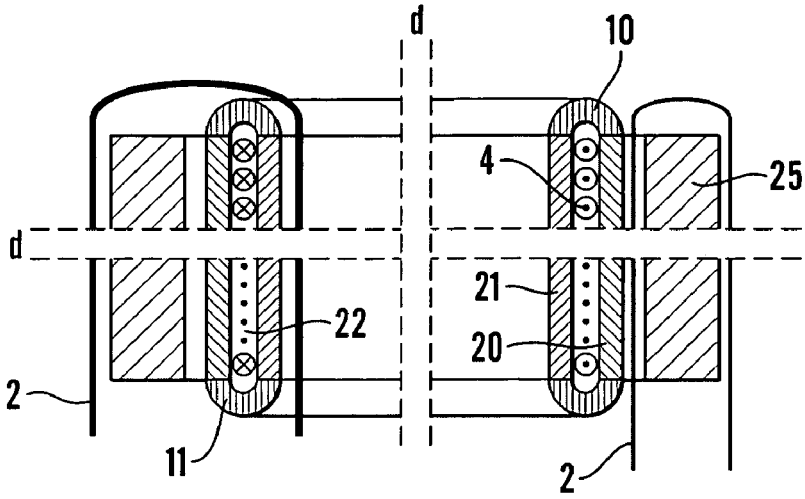
FIGS. 46 and 47 are a section and a view of a fourth embodiment of the invention for use as a reluctance-controlled, flux-connected transformer.
Figure 46B:
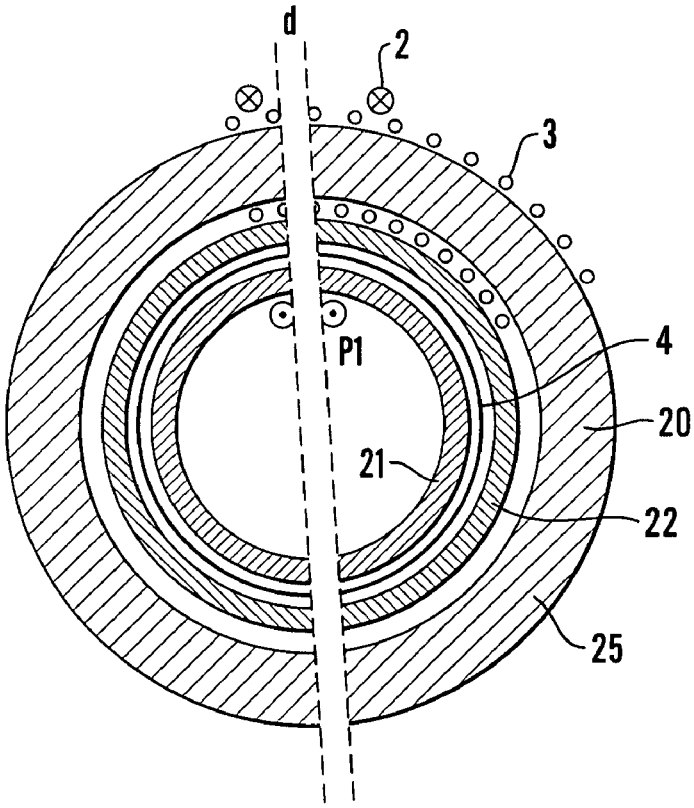
Figure 47A:
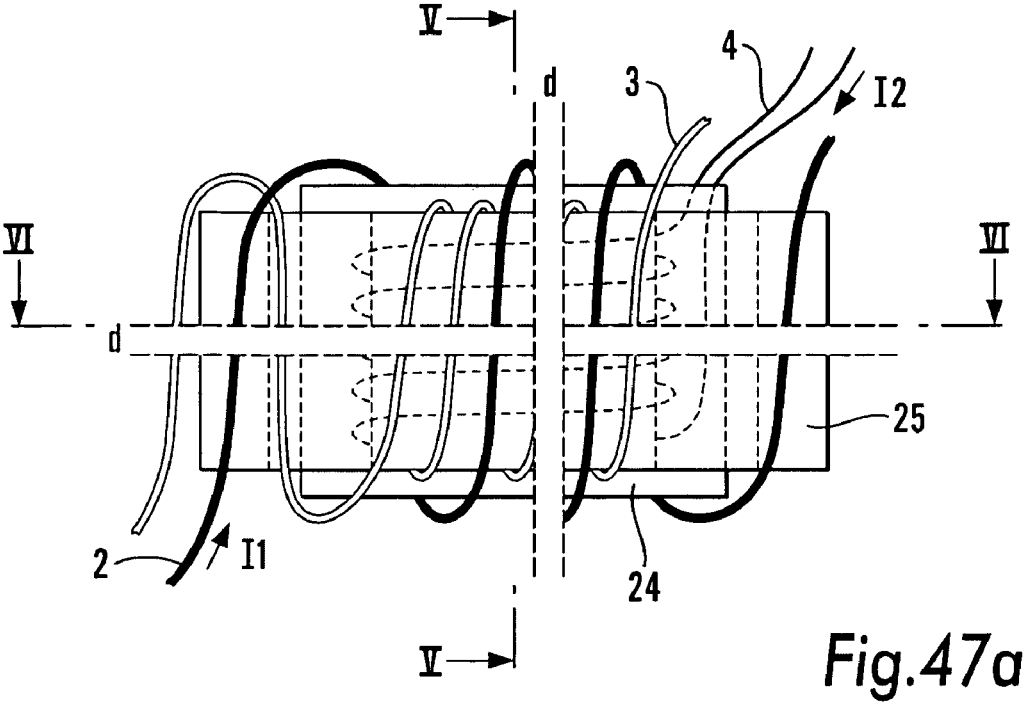
Figure 47B:
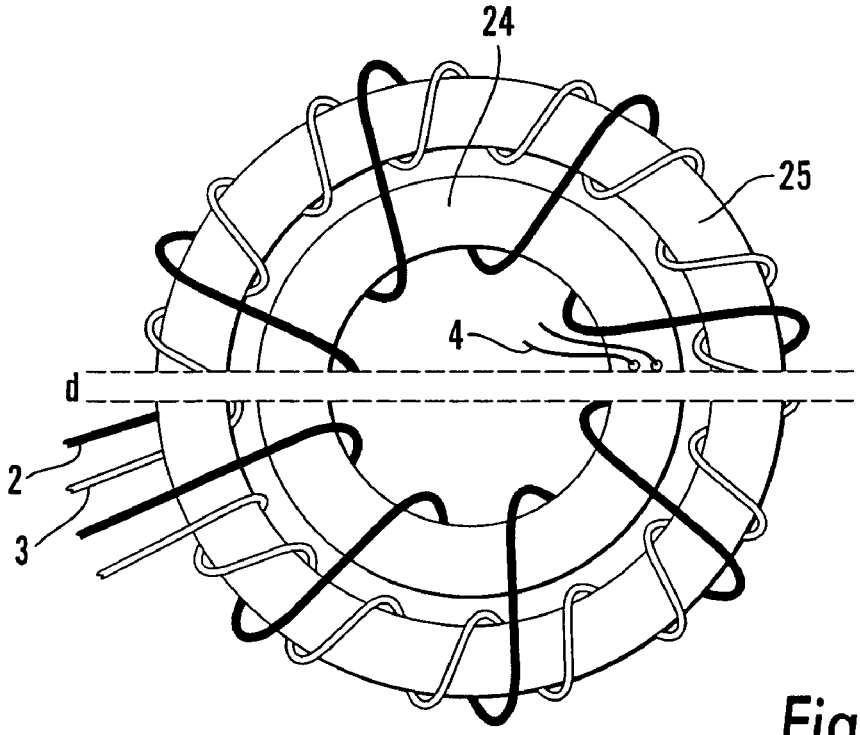

FIGS. 46 and 47 are a section and a view illustrating a fourth embodiment of the voltage connector with concentric tubes.

FIGS. 46 and 47 illustrate the voltage connector which acts as a voltage converter with joined cores. An internal reluctance-controlled core 24 is located within an external core 25 round which is wound a main winding 2. The reluctance-controlled internal core 24 has the same construction as mentioned previously under the description of FIGS. 40 and 41, but the only difference is that there is no main winding 2 round the core 24. It has only a control winding 4 which is located in the gap 22 between the inner 21 and outer parts forming the internal reluctance-controlled core 24, with the result that only core 24 is magnetically reluctance-controlled under the influence of a control field H2 (B2) from current in the control winding 4.

The main winding 2 in FIGS. 46 and 47 is a winding which encloses both core 24 and core 25.

The mode of operation of the reluctance-controlled voltage connector or converter according to the invention and described in connection with FIGS. 46 and 47 will now be described.

Figure 55:
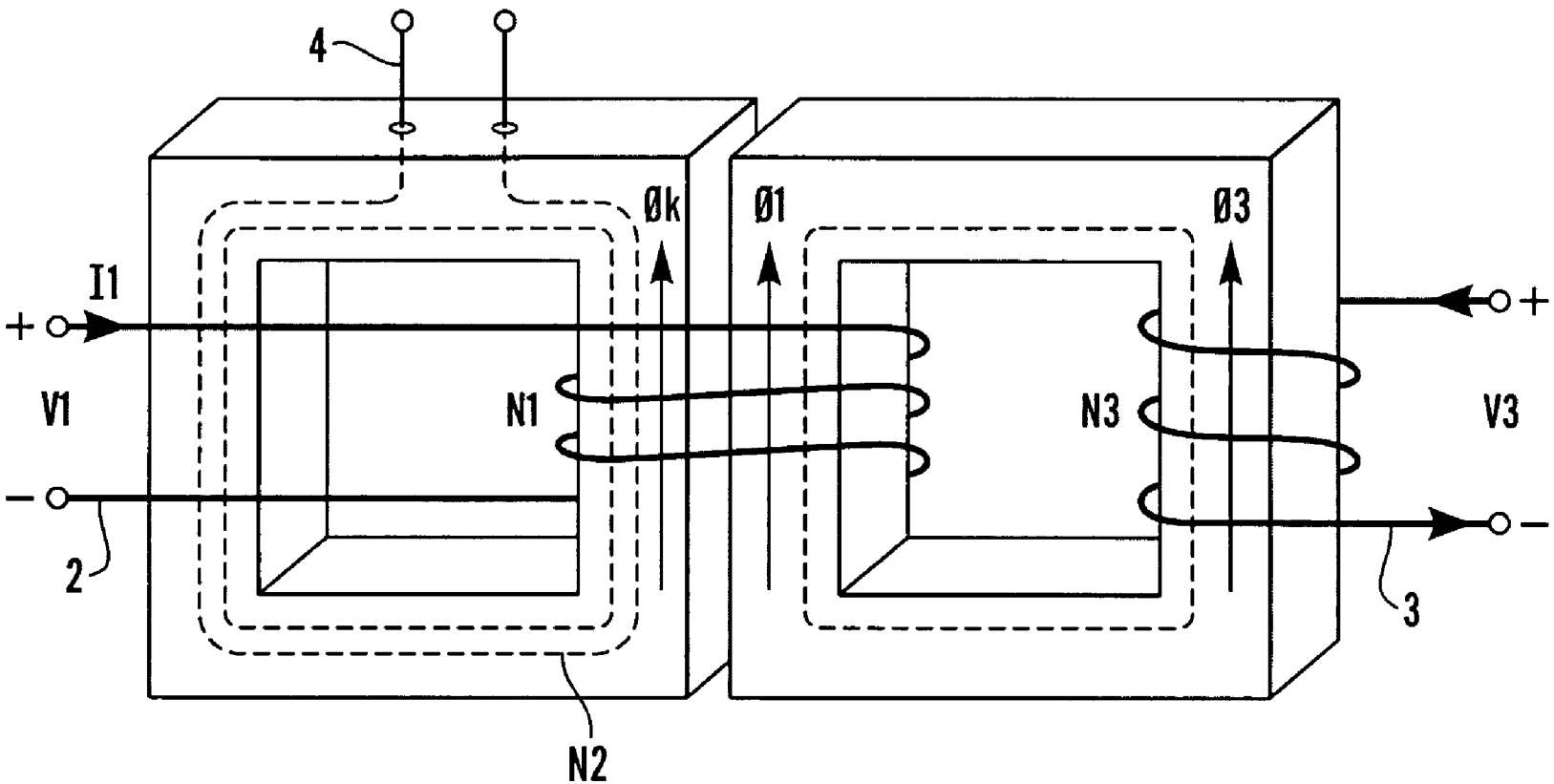
FIG. 55 illustrates a second variant of the device according to the invention together with the principle behind a possibility for transformer connection.
Figure 65A:
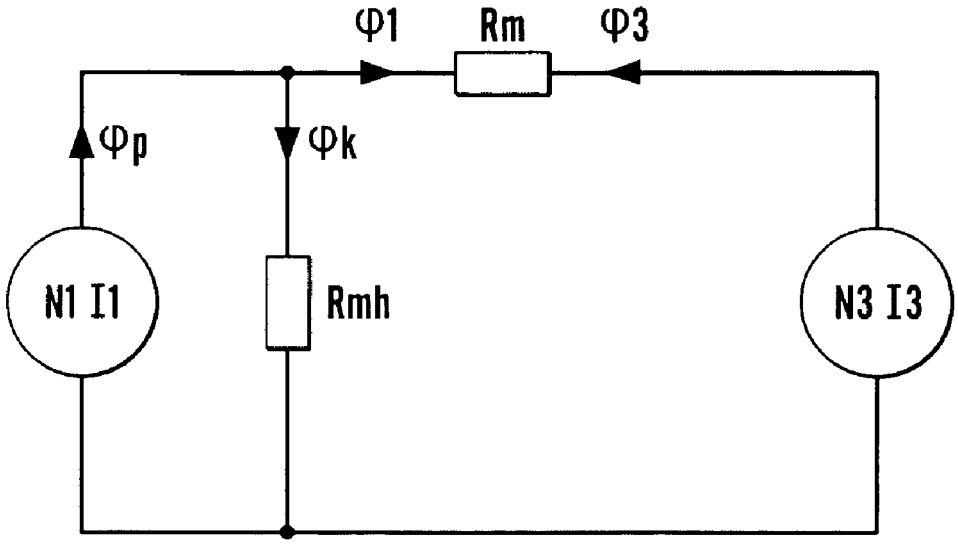
FIG. 65 illustrates a simplified reluctance model for the device according to an embodiment of the invention and a simplified electrical equivalent diagram for the connector according to an embodiment of the invention.
Figure 65B:
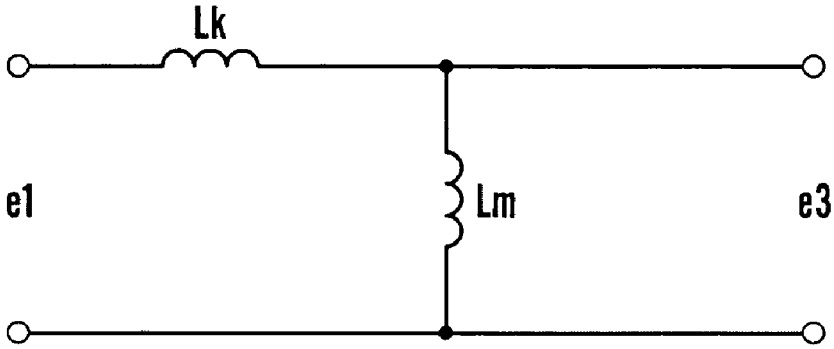

We shall also refer to FIG. 55 which illustrates the principle of the connection, FIG. 65 with a simplified equivalent diagram for the reluctance model where Rmk is the variable reluctance which controls the flux between the windings 2 and 3, and FIG. 65*b* which illustrates an equivalent electrical circuit for the connection where Lk is the variable inductance.

An alternating voltage V1 over winding 2 will establish a magnetisation current I1 in winding 2. This is generated by the flux $\phi 1+\phi 1'$ in the cores 24 and 25 which requires to be established in order to provide the bucking voltage which according to Faraday's Law is generated in 2. When there is no control current in the reluctance-controlled core 24, the flux will be divided between the cores 24 and 25 based on the reluctance in the respective cores 24 and 25.

In order to bring energy through from one winding to the other, the internal reluctance-controlled core 24 has to be supplied with control current I2.

By supplying control current I2 in the positive half-period of the alternating voltage V1 in 2, we shall obtain a half-period voltage over 2. Since the energy is transferred by flux displacement between the reluctance-controlled core 24 and the external (secondary) core 25, the reluctance-controlled core 24 will essentially be influenced by the control current I2 during the period when it is controlled in saturation, while the working flux will travel in the secondary external core 25 and interact with the primary winding 2 during the energy transfer.

When the reluctance-controlled core 24 is brought out of saturation by resetting the control flux B2 (H2) which is orthogonal to the working flux B1 (H1), the flux from the primary side will again be divided between the cores 24 and 25, and a load connected to the secondary winding 3 will only see a low reluctance and thereby high inductance and little connection between primary (VI) and secondary (V3) voltage. A voltage will be generated over the secondary winding 3, but on account of the magnitude of Lk compared to the magnetisation impedance Lm, most of the voltage (V1) from the primary winding 2 will overlay Lk. The flux from the primary winding 2 will essentially go where there is the least reluctance and where the flux path is shortest (FIG. 65*b*).

It may also be envisaged that the external core 25 could be made controllable, in addition to having a fourth main winding wound round the internal controllable core 24. This is to enable the voltage between the cores 24 and 25 to be controlled as required.

Figure 48:
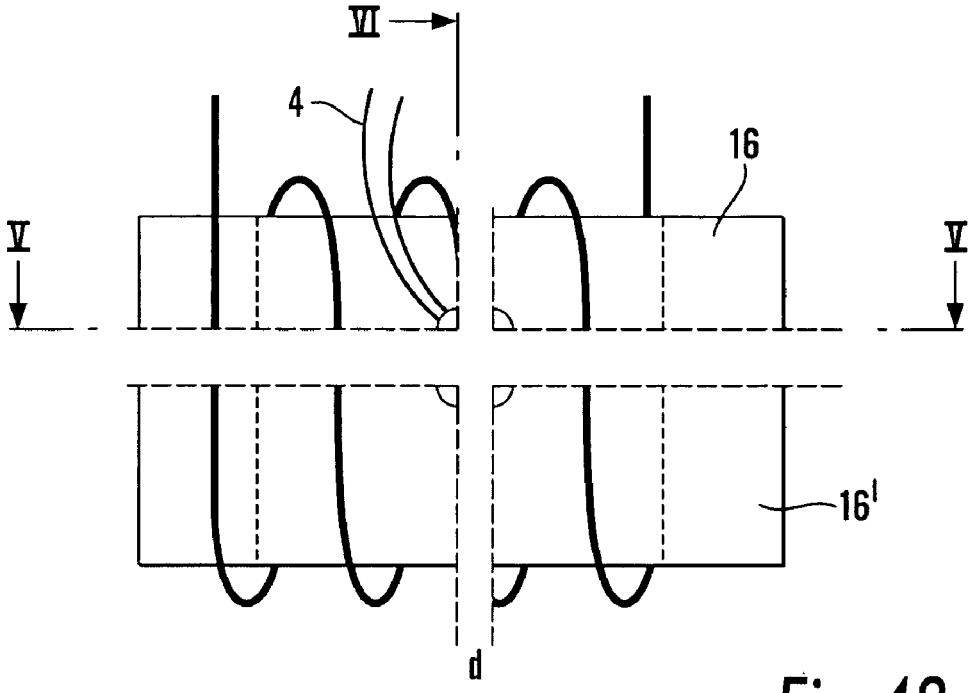
FIGS. 48 and 49 illustrate the fourth embodiment of the invention adapted to suit a powder-based magnetic material, and thereby without magnetic field connectors.

FIG. 48 describes a further variant of the fourth embodiment of a magnetically influenced voltage connector or voltage converter according to the invention, where the magnetisable body 1 is so designed that the control flux B2 (H2) is connected directly without a separate magnetic field connector through the main core 16.

FIG. 48 illustrates a voltage connector in the form of a toroid viewed from the side. The voltage connector comprises two core parts 16 and 16', a main winding 2 and a control winding 4.

Figure 49:
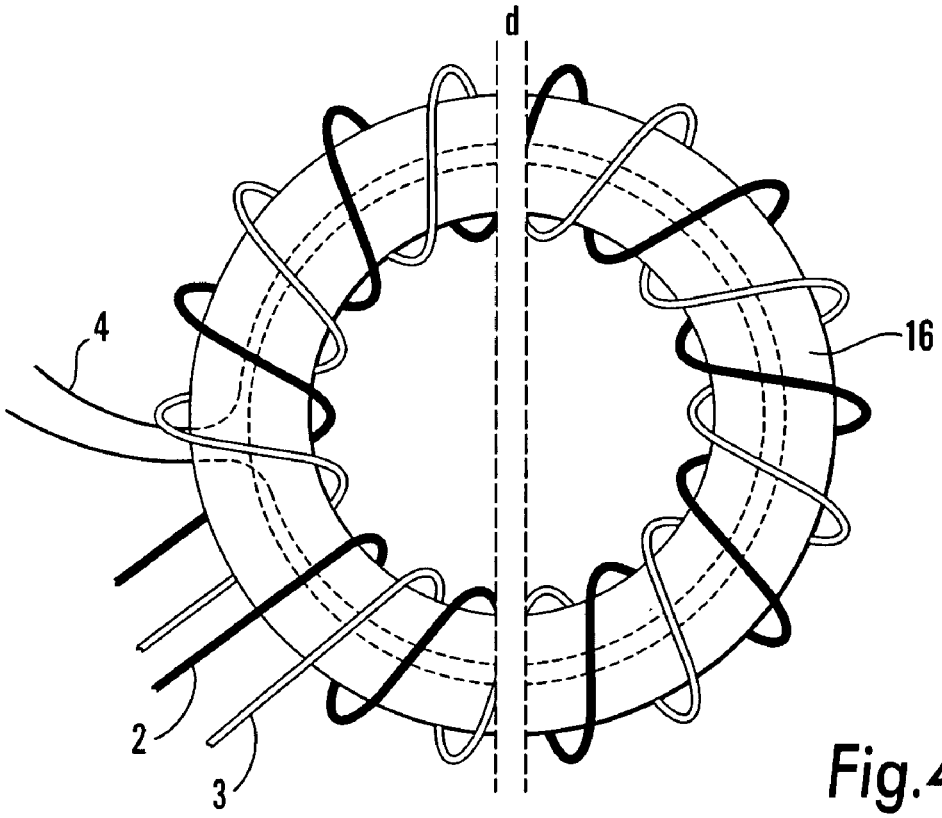

FIG. 49 illustrates a voltage connector according to the invention equipped with an extra main winding 3 which offers the possibility of converting the voltage.

Figure 50:
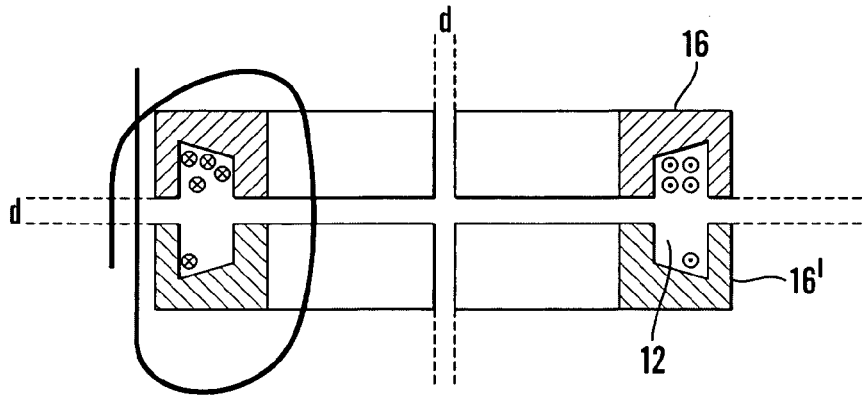
FIGS. 50 and 51 are sections along lines VI—VI and V—V in FIG. 48.
Figure 51A:
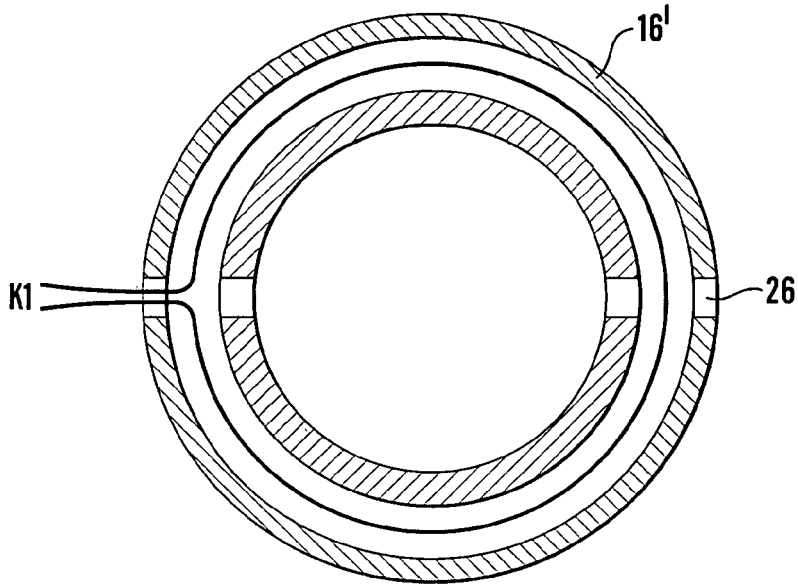
Figure 51B:
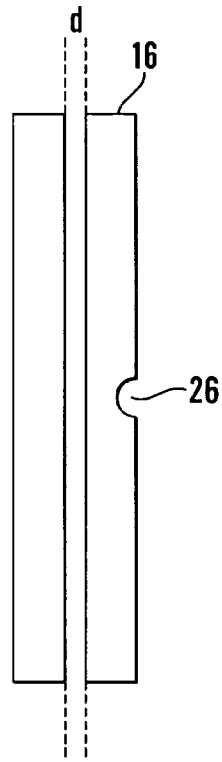

FIG. 50 illustrates the device in FIG. 48 in section along line VI—VI in FIG. 48 and FIG. 51 illustrates a section along line V—V. In FIG. 50 a circular aperture 12 is illustrated for placing the control winding 4.

FIG. 51 illustrates an additional aperture 26 for passing through wiring.

Figure 52A:
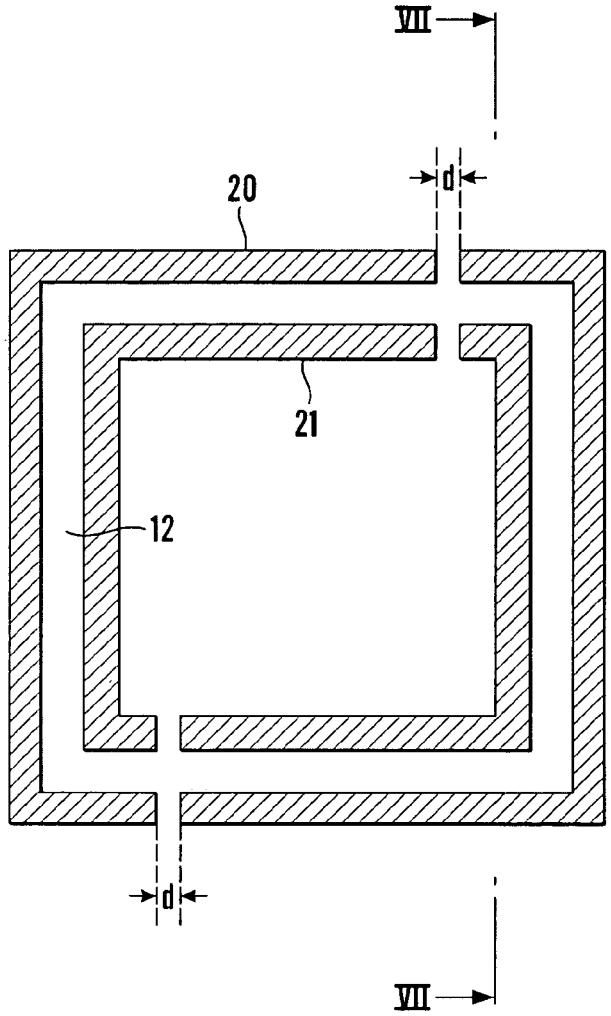
FIGS. 52 and 53 illustrate a core adapted to suit a powder-based magnetic material, and thereby without magnetic field connectors.
Figure 52B:
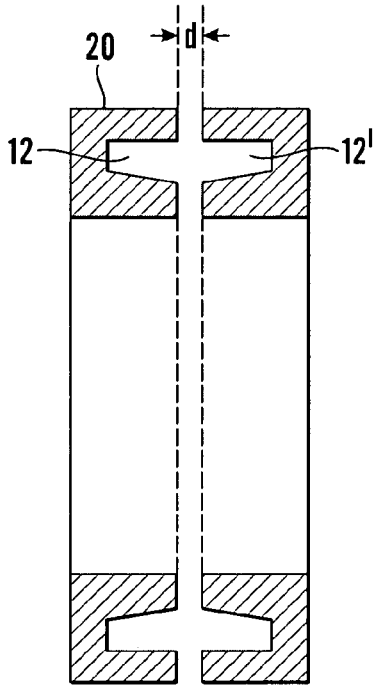
Figure 53A:
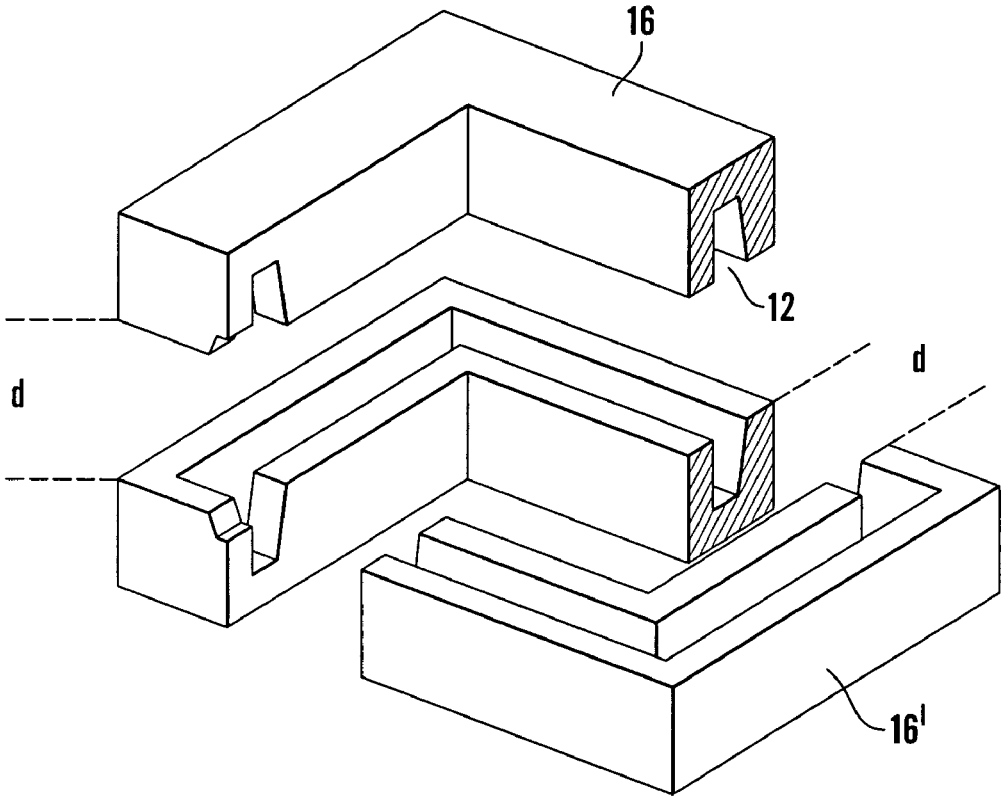
Figure 53B:
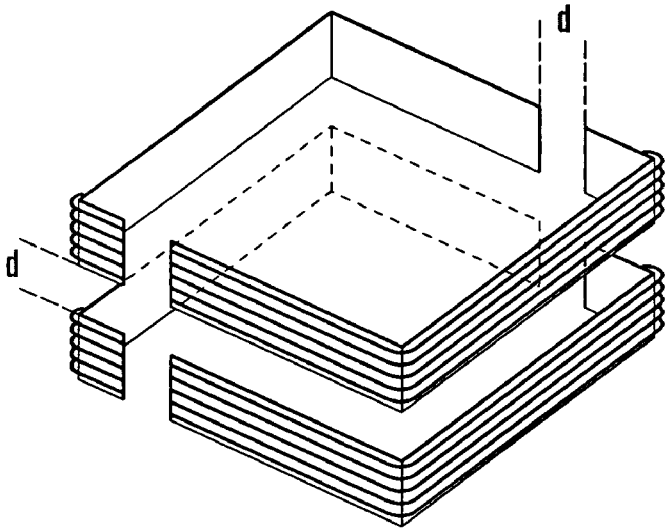

FIGS. 52 and 53 illustrate the structure of a core 16 without windings and where the core 16 is so designed that there is no need for an extra magnetic field connector for the control field. The core 16 has two core parts 16, 16' and an aperture 12 for a control winding 4. This design is intended for use where the magnetic material is sintered or compressed powder-moulded material. In this case it will be possible to insert closed magnetic field paths in the topology, with the result that what were previously separate connectors which were required for foil-wound cores form part of the actual core and are a productive part of the structure. The core, which forms the closed magnetic circuit without separate magnetic field connectors and which is illustrated in these FIGS. 52 and 53, will be able to be used in all the embodiments of the invention even though the Figures illustrate a body 1 adapted for the first embodiment of the invention (illustrated inter alia in FIGS. 1 and 2).

Figure 54:
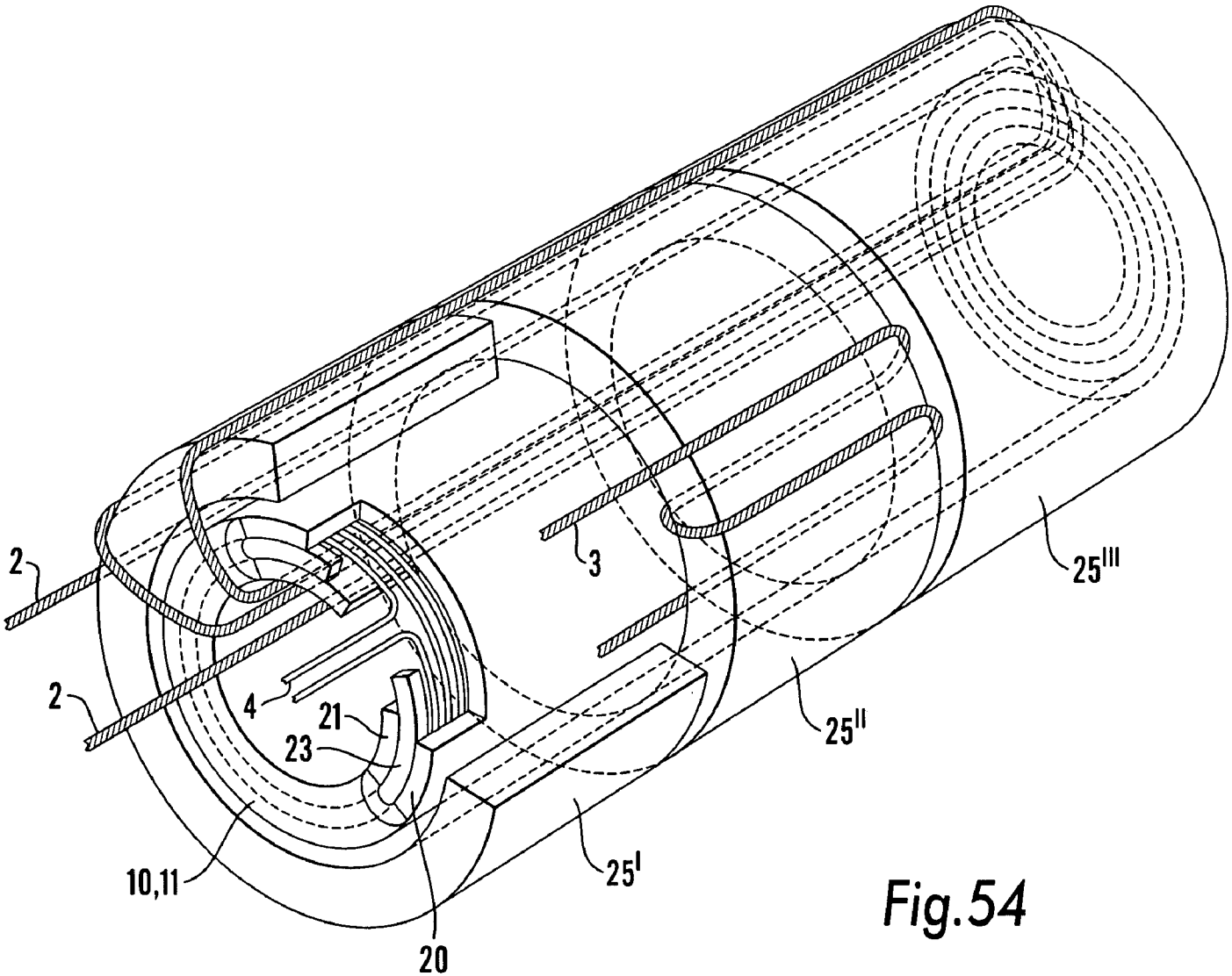
FIG. 54 is an "X-ray picture" of a variant of the fourth embodiment of the invention.

FIG. 54 illustrates a magnetically influenced voltage converter device, where the device has an internal control core 24 consisting of an external tube 20 and an internal tube 21 which are concentric and made of a magnetisable material with a gap 22 between the external tube's 20 inner wall and the internal tube's 21 outer wall. Spacers 23 are mounted in the gap between the external tube's 20 inner wall and the internal tube's 21 outer wall. Magnetic field connectors 10, 11 are mounted between the tubes 20 and 21 at respective ends thereof. A combined control and magnetisation winding 4 is wound round the internal tube 21 and is located in the said gap 22. The device further consists of an external secondary core 25 with windings comprising a plurality of ring core coils 25', 25", 25'" etc. placed on the outside of the control core 24. Each ring core coil 25', 25", 25'" etc. consists of a ring of a magnetisable material wound round by a respective second main winding or secondary winding 3, only one of which is illustrated for the sake of clarity. A first main winding or primary winding 2 is passed through the internal tube 21 in the control core 24 and along the outside of the external cores 25 N1 number of times, where N1=1, . . . r.

It is also possible to envisage the secondary core device being located within the control core 24, in which case the primary winding 2 will have to be passed through the ring cores 25 and along the outside of the control core 24.

FIG. 55 is a schematic illustration of a second embodiment of the magnetically influenced voltage regulator according to the invention with a first reluctance-controlled core 24 and a second core 25, each of which is composed of a magnetisable material and designed in the form of a closed, magnetic circuit, the said cores being juxtaposed. At least one first electrical conductor 8 is wound on to a main winding 2 about both the first and the second core's cross-sectional profile along at least a part of the said closed circuit. At least one second electrical conductor 9 is mounted as a winding 4 in the reluctance-controlled core 24 in a form which essentially corresponds to the closed circuit. In addition, at least one third electrical conductor 27 is wound round the second core's 25 cross-sectional profile along at least a part of the closed circuit. The field direction from the first conductor's 8 winding 2 and the second conductor's 9 winding is orthogonal. By means of this solution, the first conductor 8 and the third conductor 27 form a primary winding 2 and a secondary winding 3 respectively.

Figure 56:
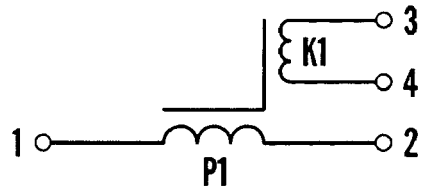
FIG. 56 illustrates a proposal for an electro-technical schematic symbol for the voltage connector according to the invention.
Figure 57:
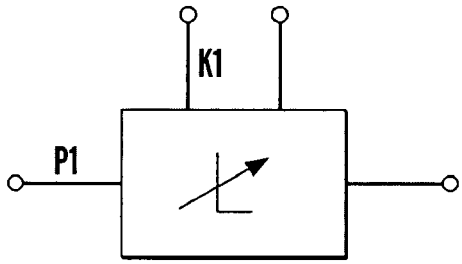
FIG. 57 illustrates a proposal for a block schematic symbol for the voltage connector.

FIG. 56 illustrates a proposal for an electro-technical schematic symbol for the voltage connector according to the invention. FIG. 57 illustrates a proposal for a block schematic symbol for the voltage connector.

Figure 58:
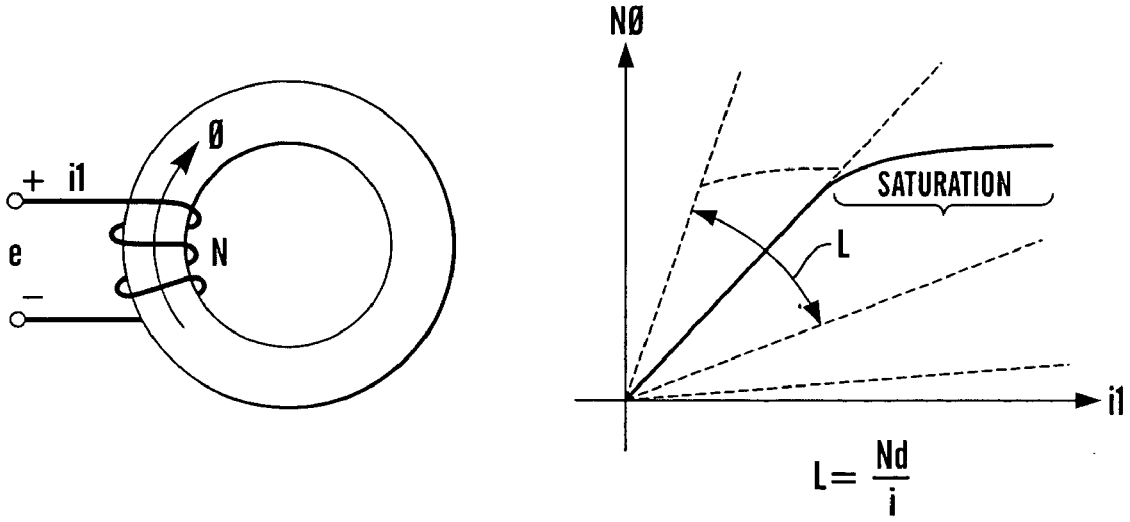
FIG. 58 illustrates a magnetic circuit where the control winding and control flux are not included.

FIG. 58 illustrates a magnetic circuit where the control winding 4 and control flux B2 (H2) are not included.

Figure 59:
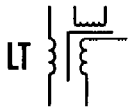
In FIGS. 59 and 60 there are proposals for electro-technical schematic symbols for the voltage converter according to an embodiment of the invention.
Figure 59:
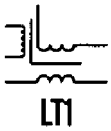
Figure 59:
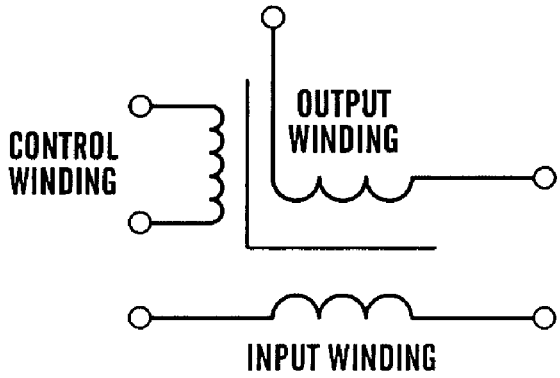
Figure 59:
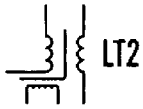
Figure 59:
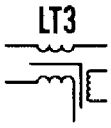
Figure 60:
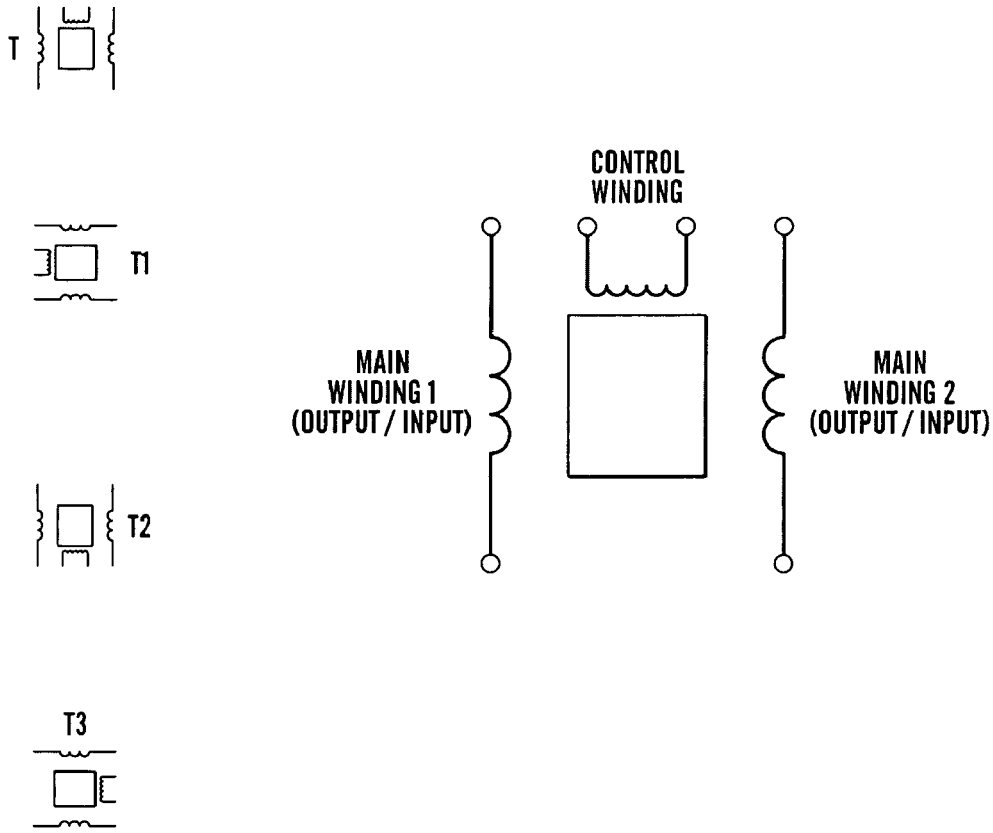

In FIGS. 59 and 60 there is a proposal for an electro-technical schematic symbol for the voltage converter where the reluctance in the control core 24 shifts magnetic flux between a core with fixed reluctance 25 and a second core with variable reluctance 24 (see for example FIG. 55).

There is, of course, no restriction to having two cores with variable reluctance. The fact that we can shift flux between two cores within the same winding will be employed in order to make a magnetic switch which can switch a voltage off and on independently of the course of magnetisation in the main core. This means that we have a switch which has the same function as a GTO, except that we can choose whatever switching time we wish.

The device according to the invention will be able to be used in many different connections and examples will now be given of applications in which it will be particularly suitable.

Figure 61:
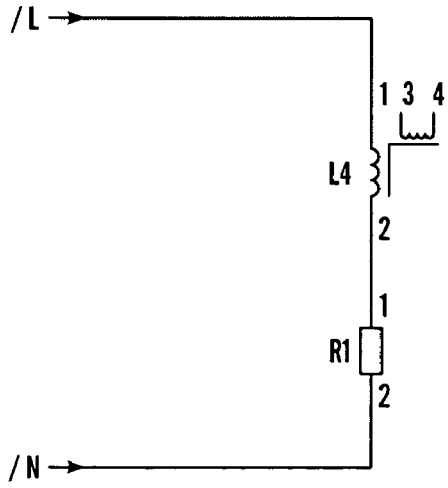
FIG. 61 illustrates the use of an embodiment of the invention in an alternating current circuit.

FIG. 61 illustrates the use of the invention in an alternating current circuit in order to control the voltage over a load RL, which may be a light source, a heat source or other load.

Figure 62:
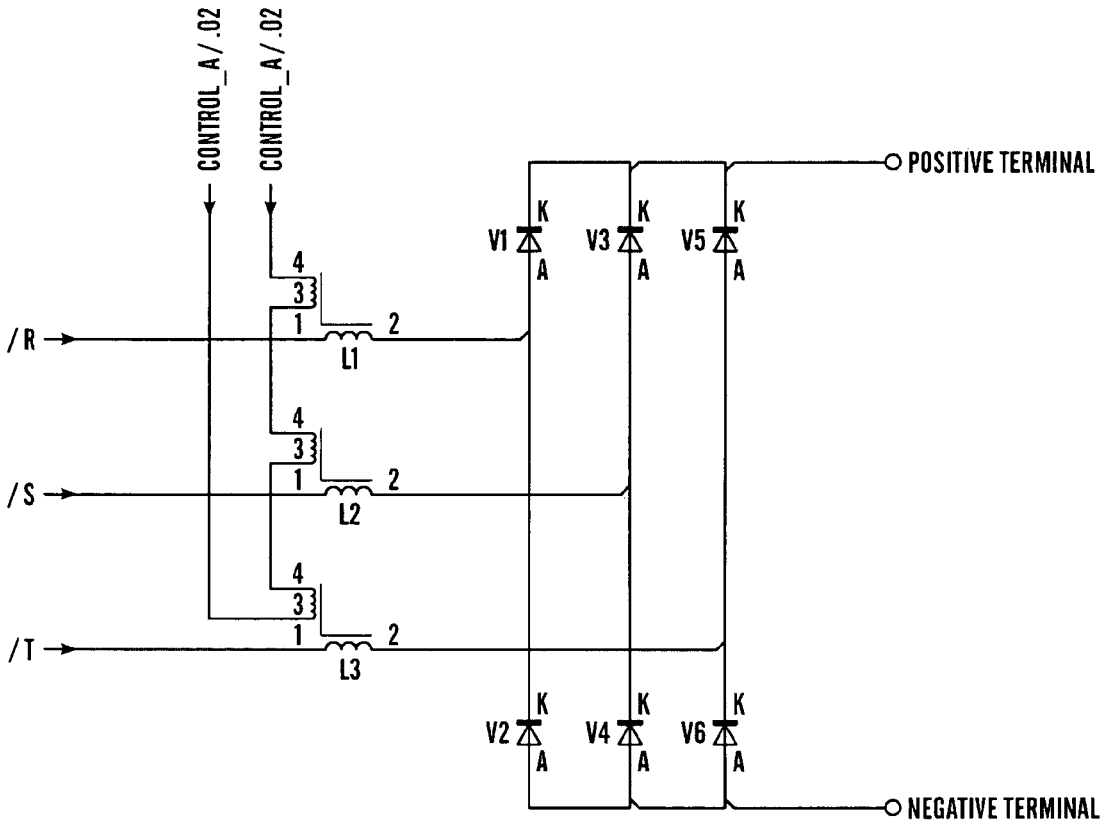
FIG. 62 illustrates the use of an embodiment of the invention in a three-phase system.
Figure 62A:
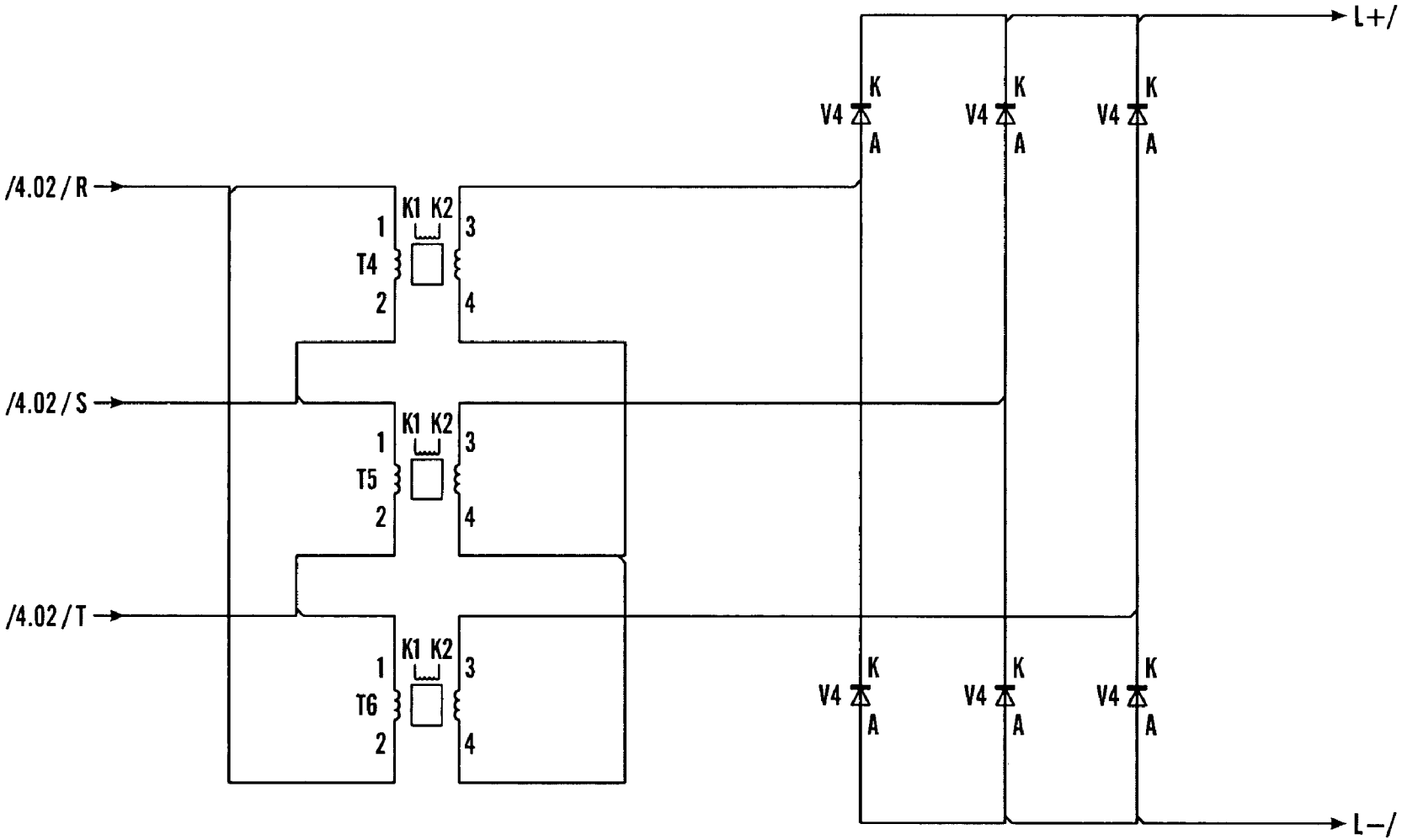

FIG. 62 illustrates the use of the invention in a three-phase system where such a voltage connector in each phase, connected to a diode bridge, is used for a linear regulation of the output voltage from the diode bridge.

Figure 63:
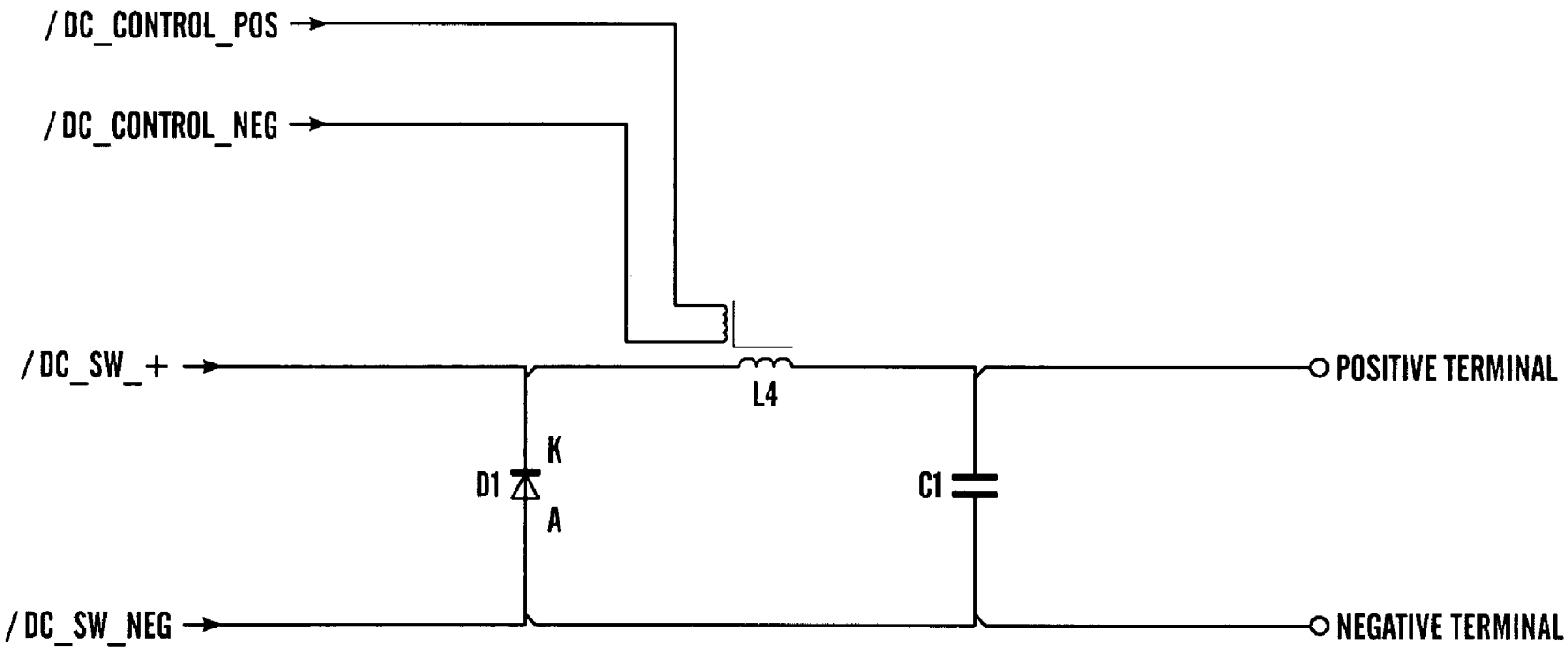
FIG. 63 illustrates a use as a variable choke in DC-DC converters.

FIG. 63 illustrates a use as a variable choke in DC-DC converters.

Figure 64A:
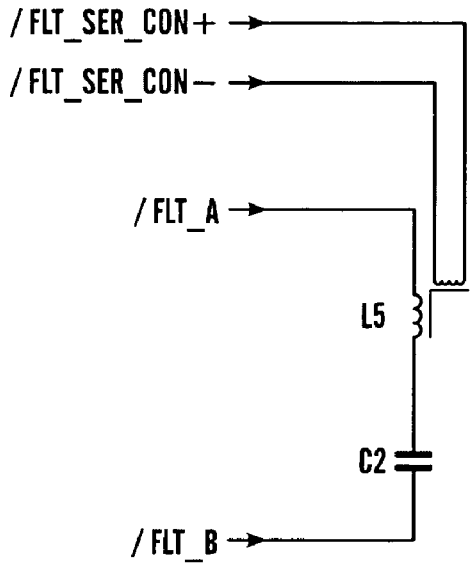
FIG. 64 illustrates a use as a variable choke in a filter together with condensers.
Figure 64B:
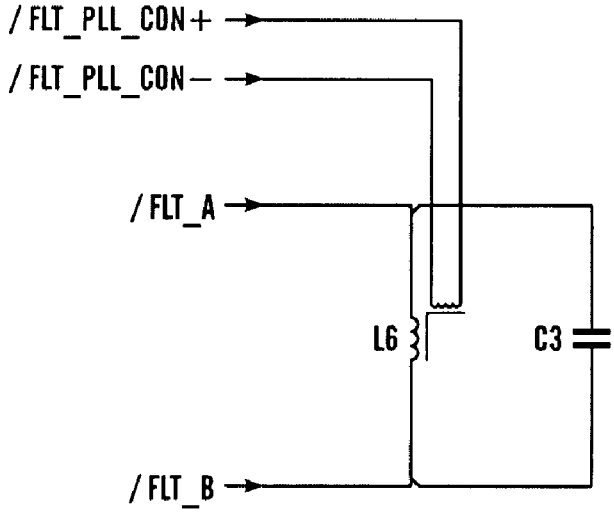

FIG. 64 illustrates a use as a variable choke in a filter together with condensers. Here we have only illustrated a series and a parallel filter (64*a* and 64*b* respectively), but it is implicit that the variable inductance can be used in a number of filter topologies.

A further application of the invention is that described inter alia in connection with FIGS. 14 and 45, where proposals for schematic symbols were given in FIG. 59. In this application, the voltage connector has a function as a voltage converter where a secondary winding is added. An application as a voltage regulator is also illustrated here, where the magnetisation current in the transformer connection and the leakage reactance are controllable via the control winding 4. The special feature of this system is that the transformer equations will apply, while at the same time the magnetisation current can be controlled by changing $\mu r$. In this case, therefore, the characteristic of the transformer can be regulated to a certain extent. If there is a DC excitation of one winding 2, it will be possible to obtain transformed energy through the transformer by varying $\mu r$ and thereby the flux in the reluctance-controlled core instead of varying the excitation. Thus it is possible in principle to generate an AC voltage from a DC voltage by means of the fact that an alteration of the magnetisation current from the DC generator into this system will be able to be transformed to a winding on the secondary side.

Another application of the invention is illustrated in FIGS. 46 and 47, where a variable reluctance as control core is surrounded or enclosed by one or more separate cores with separate windings, as well as FIG. 55 where a first reluctance-controlled core and a second core are designed as closed magnetic circuits and are juxtaposed. We also refer to FIG. 65 which illustrates an equivalent electrical circuit.

FIG. 55 illustrates how the fluxes in the invention travel in the cores. We wish to emphasise that the flux in the control core is connected to the flux in the working core via the windings enclosing both cores. In this system transformation of electrical energy will be able to be controlled by flux being connected to and disconnected from a control core and a working core. Since the fluxes between the cores are interconnected through Faraday's induction law, the functional dependence of the equations for the primary side and the equations for the secondary side will be controlled by the connection between the fluxes. In a linear application we will be able to control a transformation of voltages and currents between a primary winding and a secondary winding linearly by altering the reluctance in the control core, thus permitting us to introduce here the term reluctance-controlled transformer. For a switched embodiment we will be able to introduce the term reluctance-controlled switch.

The flux connection between the primary or first main winding 2 and the secondary winding or second main winding 3 will now be explained. Winding 2 which now encloses both the reluctance-controlled control core 24 and the main core 25 will establish flux in both cores. The self-inductance L1 to 2 tells how much flux, or how many flux turns are produced in the cores when a current is passed in I1 in 2. The mutual inductance between the primary winding 2 and the secondary winding 3 indicates how many of the flux turns established by 2 and I1 are turned about 2 and about the secondary winding 3.

We may, of course, also envisage the main core 25 being reluctance-controlled, but for the sake of simplicity we shall refer here to a system with a main core 25 where the reluctance is constant, and a control core 24 where the reluctance is variable.

The flux lines will follow the path which gives the highest permeance (where the permeability is highest), i.e. with the least reluctance.

In FIGS. 55 and 65 we have not taken into consideration the leakage fields in the main windings 2 and 3. FIG. 55 illustrates a simplified model of the transformer where the primary 2 and secondary 3 windings are each wound around a transformer leg, while in practice they will preferably be wound on the same transformer leg, and in our case, for example, the outer ring core which is the main core 25 will be wound around the secondary winding 3 distributed along the entire core 25. Similarly, the primary winding 2 will be wound around the main core 25 and the control core 24 which may be located concentrically and within the main core.

FIG. 65 illustrates a simplified reluctance model for the device according to the invention.

FIG. 65*b* illustrates a simplified electrical equivalent diagram for the connector according to the invention, where the reluctances are replaced by inductances.

A current in 2 generates flux in the cores 24 and 25:

$$\Phi=\Phi_k+\Phi_1 \qquad 40)$$

where:

$\Phi_p$=total flux established by the current in 2.

$\Phi_k$=the total flux travelling through the control core 24.

$\Phi_1$=part of the total flux travelling through the main core 25.

Since the leakage flux in main core 24 and control core 25 are disregarded, $$\Phi_1=-\Phi_2 \qquad 41)$$

In a way $\Phi_k$ may be regarded as a controlled leakage flux.

On the basis of FIG. 65 we can formulate the highly simplified electrical equivalent diagram for the magnetic circuit illustrated in FIG. 65*b*.

FIG. 65*b* therefore illustrates the principle of the reluctance-controlled connector, where the inductance $L_k$ absorbs the voltage from the primary side.

$$L_k = \frac{\lambda_k}{I} = \frac{NI^2}{R_{mk}} \qquad 42)$$

This inductance is controlled through the variable reluctance in the control core 24, with the result that the connection or the voltage division for a sinusoidal steady-state voltage applied to the primary winding will be approximately equal to the ratio between the inductance in the respective cores as illustrated in equation 43.

$$\frac{e_2}{e_1} = \frac{Lm}{L_k + Lm} \qquad 43)$$

When the control core 24 is in saturation, $L_k$ is very small compared to $L_m$ and the voltage division will be according to the ratio between the number of turns N1/N3. When the control core is in the off state, $L_k$ will be large and to the same extent will block voltage transformation to the secondary side.

The magnetisation of the cores relative to applied voltage and frequency is so rated that the main core 25 and the control core 24 can each separately absorb the entire time voltage integral without going into saturation. In our model the area of iron on the control and working cores is equal without this being considered as limiting for the invention.

Since the control core 24 is not in saturation on account of the main winding 2, we shall be able to reset the control core 24 independently of the working flux B1 (H1), thereby achieving the object by means of the invention of realising a magnetic switch. If necessary the main core 25 may be reset after an on pulse or a half on period by the necessary MMF being returned in the second half-period only in order to compensate for any distortions in the magnetisation current.

In a switched application, when the switch is off, i.e. when the flux on the primary winding 2 is distributed between the control core 24 and the working core 25, the flux connection between the primary 2 and the secondary 3 winding will be slight and very little energy transfer takes place between primary 2 and secondary 3 winding.

When the switch is on, i.e. when the reluctance in the control core 24 is very low (μr=10–50) and approaching the reluctance of an air coil, we will have a very good flux connection between primary 2 and secondary 3 winding and transfer of energy.

An important application of the invention will thus be as a frequency converter with reluctance-controlled switches and a DC-AC or AC-DC converter by employing the reluctance-controlled switch in traditional frequency converter connections and rectifier connections.

A frequency converter variant may be envisaged realised by adding bits of sinus voltages from each phase in a three-phase system, each connected to a separate reluctance-controlled core which in turn is connected to one or more adding cores which are magnetically connected to the reluctance-controlled cores through a common winding through the adding cores and the reluctance-controlled cores. Parts of sinus voltages can then be connected from the reluctance-controlled cores into the adding core and a voltage with a different frequency is generated.

A DC-AC converter may be realised by connecting a DC voltage to the main winding enclosing the working core, where this time the working core is also wound round a secondary winding where we can obtain a sinus voltage by changing the flux connection between working core and control core sinusoidally.

Figure 66:
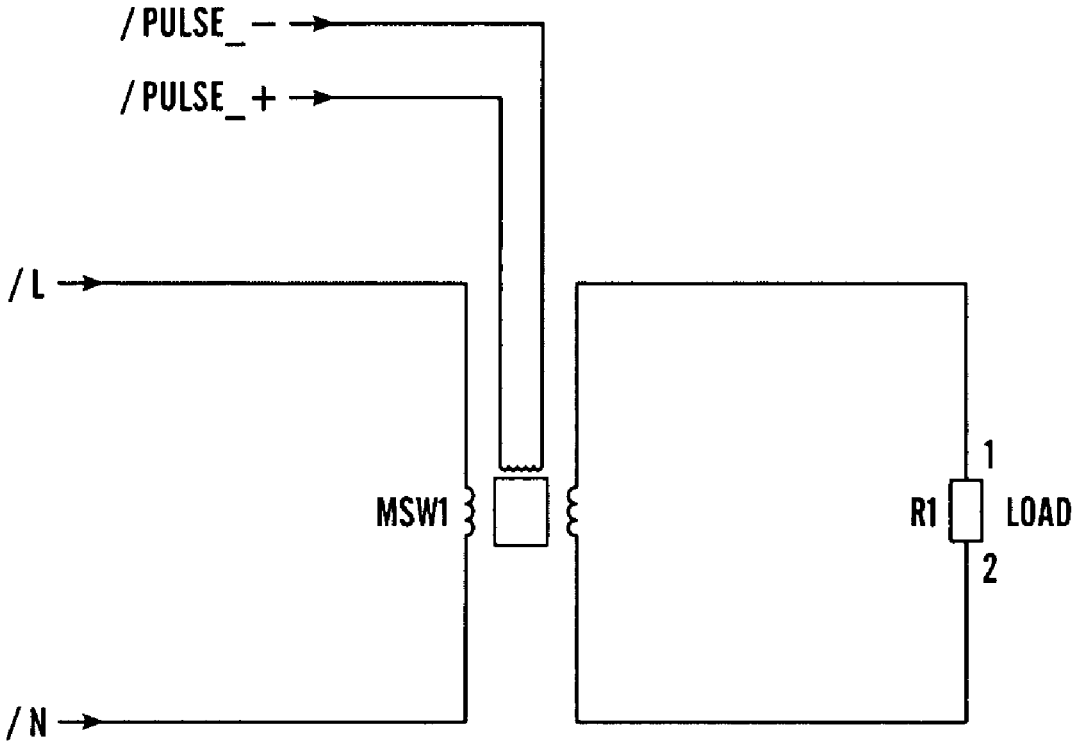
FIG. 66 illustrates the connection for a magnetic switch.

FIG. 66 illustrates the connection for a magnetic switch. This may, of course, also act as an adjustable transformer.

Figure 67:
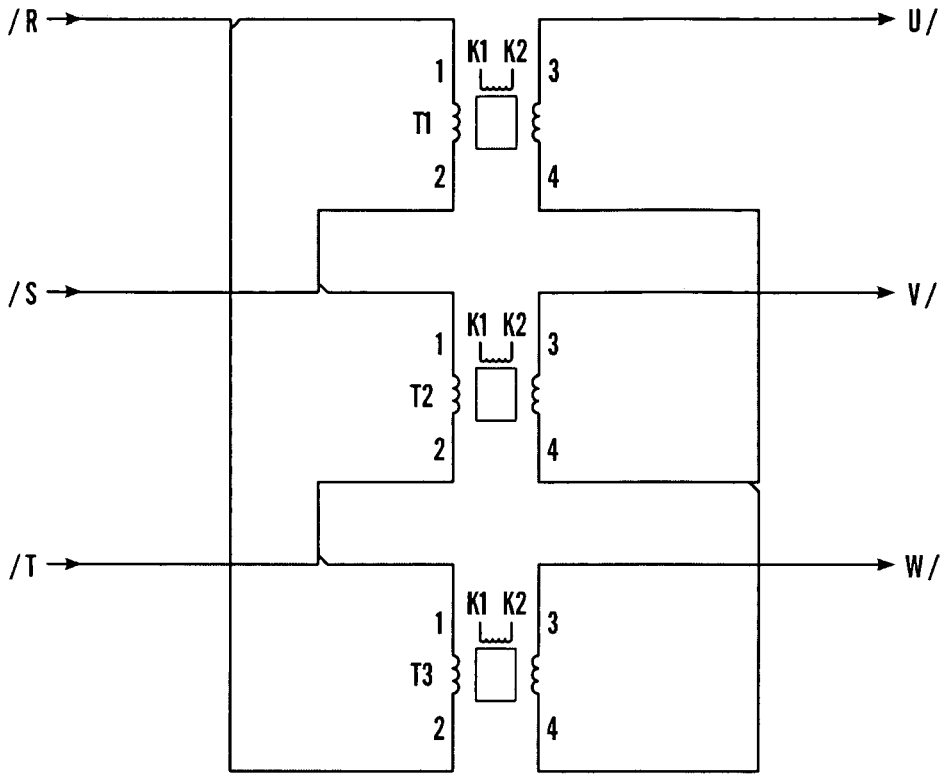
FIG. 67 illustrates examples of a three-phase use of an embodiment of the invention.
Figure 67A:
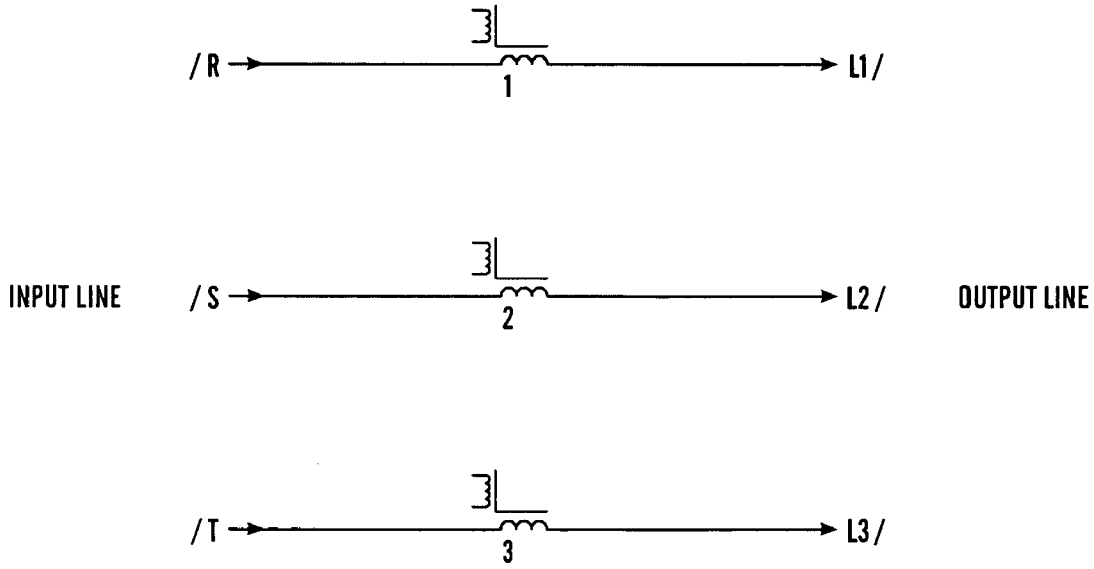

FIGS. 67 and 67*a* illustrate an example of a three-phase design. All the other three-phase rectifier connectors are, of course, also feasible. By means of connection to a diode bridge or individual diodes to the respective outlets in a 12-pulse connector, an adjustable rectifier is obtained.

In the application as an adjustable transformer, it must be emphasised that the size of the reluctance-controlled core is determined by the range of adjustment which is required for the transformer, (0–100% or 80–110%) for the voltage.

Figure 67B:
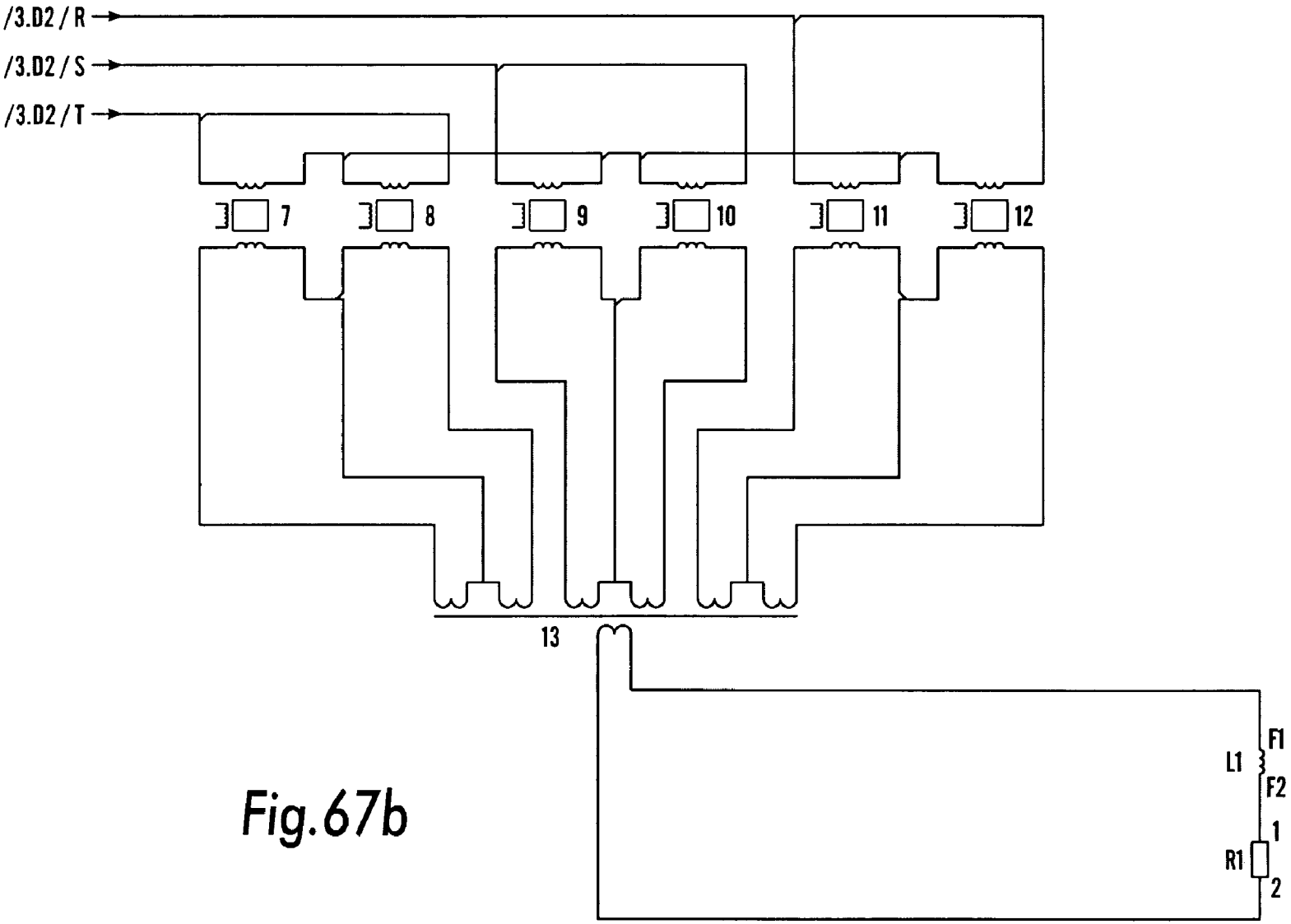

FIG. 67*b* illustrates the use of the device according to the invention as a connector in a frequency converter for converting input frequency to randomly selected output frequency and intended for operation of an asynchronous motor, for adding parts of the phase voltage generated from a 6 or 12-pulse transformer to each motor phase (FIG. 67*b*).

Figure 68:
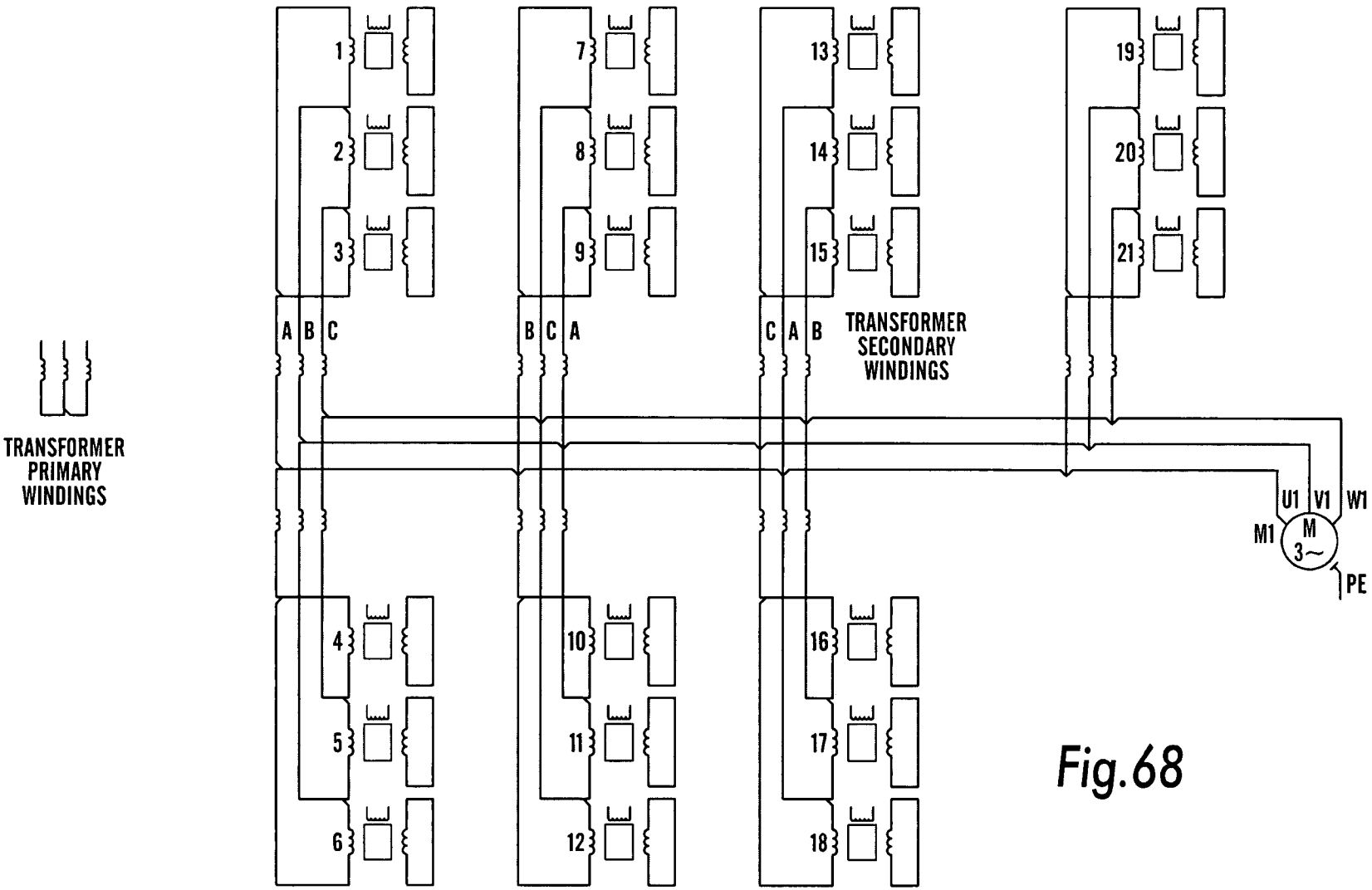
FIG. 68 illustrates the device employed as a switch.

FIG. 68 illustrates the device used as a switch in a UFC (unrestricted frequency changer with forced commutation).

Figure 69:
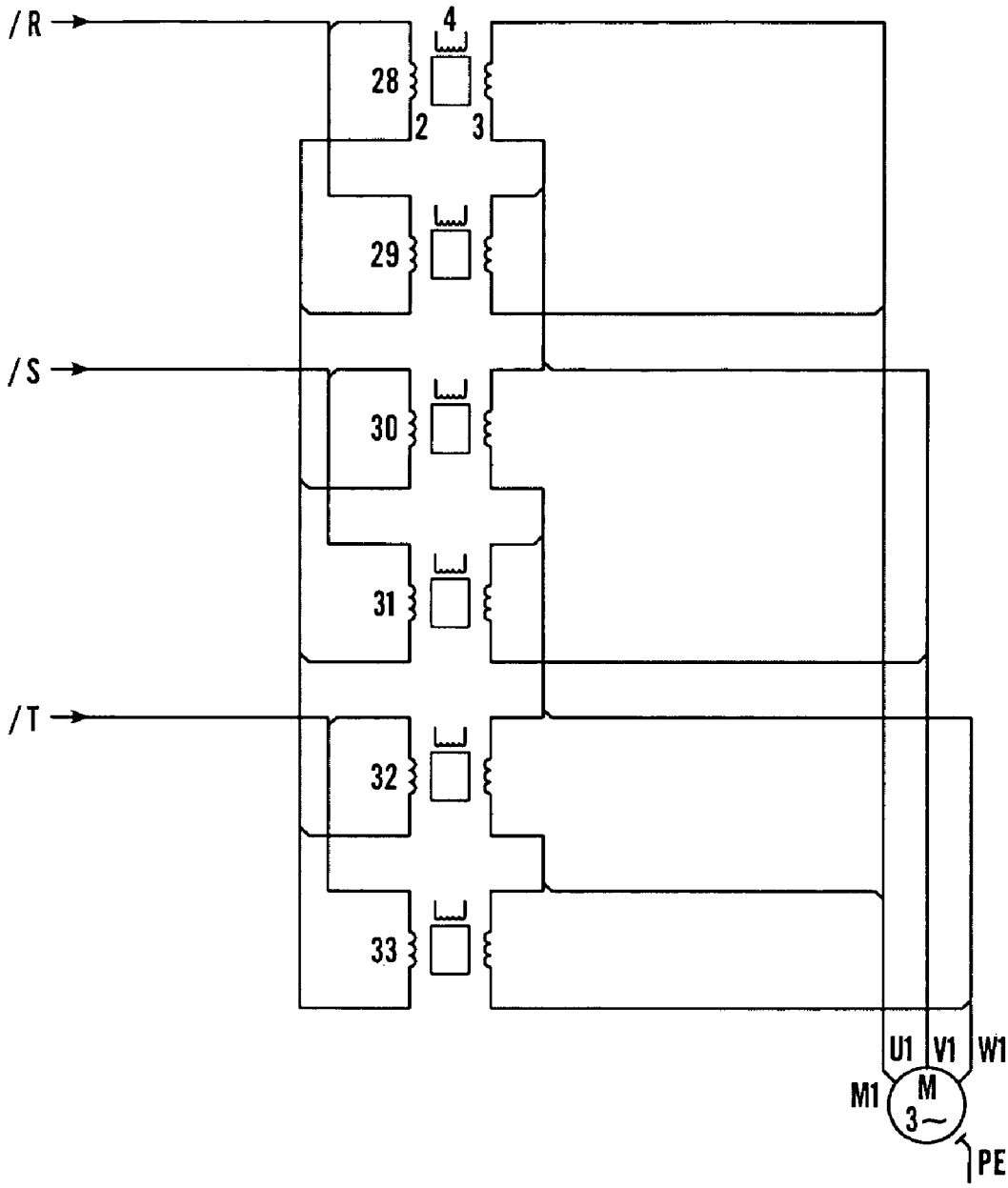
FIG. 69 illustrates a circuit comprising 6 devices according to an embodiment of the invention.

FIG. 69 illustrates a circuit comprising 6 devices 28–33 according to the invention. The devices 28–33 are employed as frequency converters where the period of the voltages generated is composed of parts of the fundamental frequency. This works by "letting through" only the positive half-periods or parts of the half-periods of a sinus voltage in order to make the positive new half-period in the new sinus voltage, and subsequently the negative half-periods or parts of the negative half-periods in order thereby to make the negative half-periods in the new sinus voltage. In this way a sinus voltage is generated with a frequency from 10% to 100% of the fundamental frequency. This converter also acts as a soft start since the voltage on the output is regulated via the reluctance control of the connection between the primary and the secondary winding.

In FIG. 69, if the first half-period is allowed through connector no. 28 (main winding 2), the current through the secondary winding (main winding 3) in the same connector will commutate to the secondary winding (main winding 3) in connector no. 29, and on from 29 to 28, etc.

Figure 70:
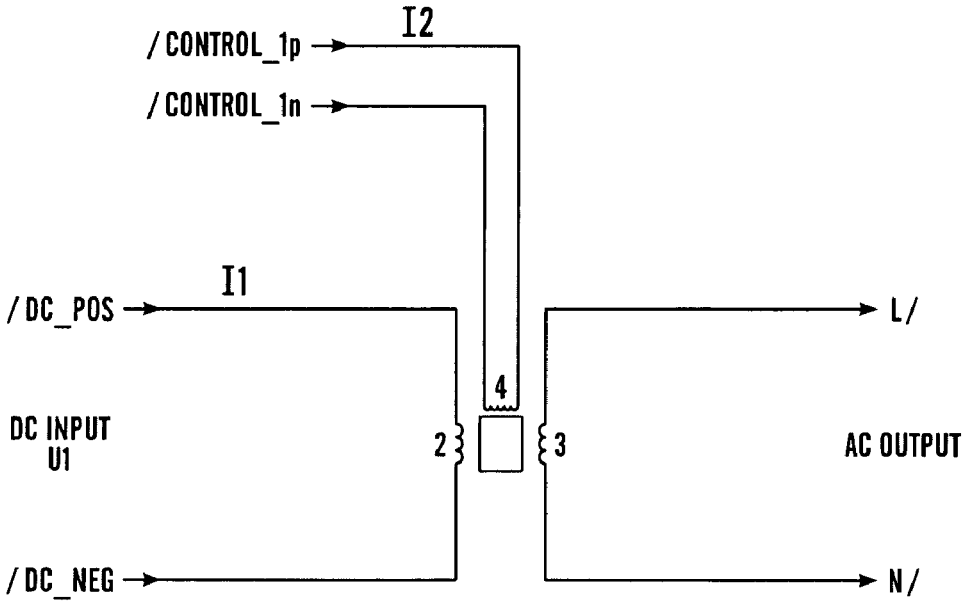
FIG. 70 illustrates the use of the device according to an embodiment of the invention as a DC-AC converter.
Figure 70A:
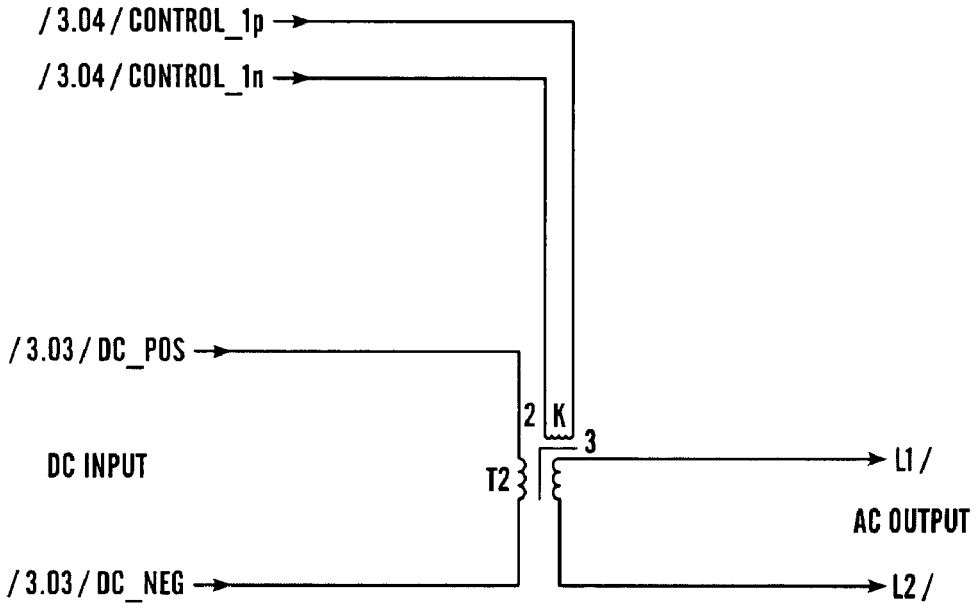

FIG. 70 illustrates the use of the device according to the invention as a DC to AC converter. Here the main winding 2 in the connector is excited by a DC voltage U1 which establishes a field H1 (B1) both in the control core 24 and in the main core 25 (these are not shown in the Figure). The number of turns N1, N2, N3 and the area of iron are designed in such a manner that none of the cores are in saturation in steady state. In the event of a control signal (i.e. excitation of the control winding 4) into the control core 24, the flux B2 (H2) therein will be transferred to the main core 25 and a change in the flux B1 (H1) in this core 25 will induce a voltage in the secondary winding (main winding 3). By having a sinusoidal control current I2, a sinusoidal voltage will be able to be generated on the secondary side (main winding 3), with the same frequency as the control voltage FIG. 70*b* illustrates the use of the invention as a converter with a change of reluctance.

Figure 71:
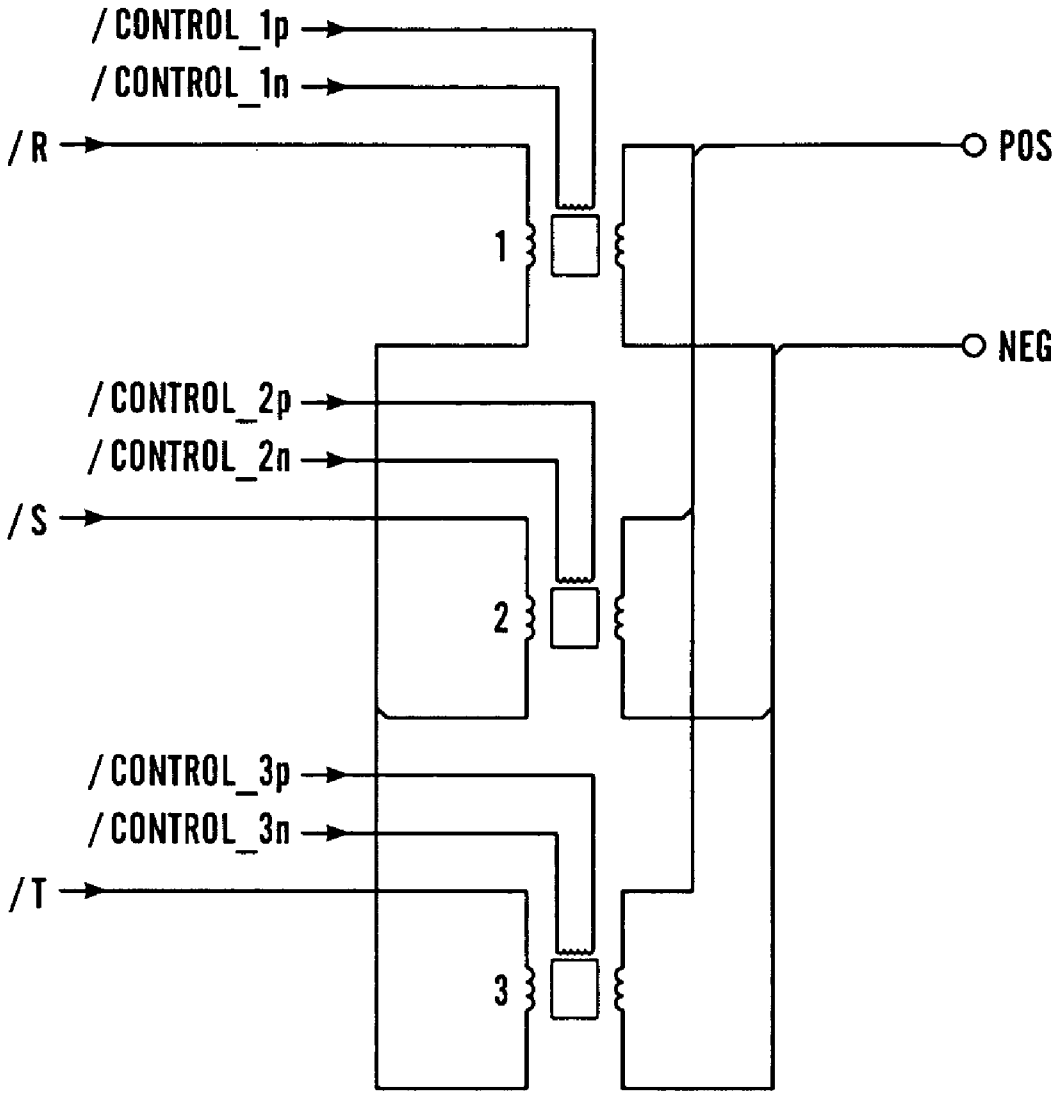
FIG. 71 illustrates a use of the device according to an embodiment of the invention as an AC-DC converter.
Figure 71A:
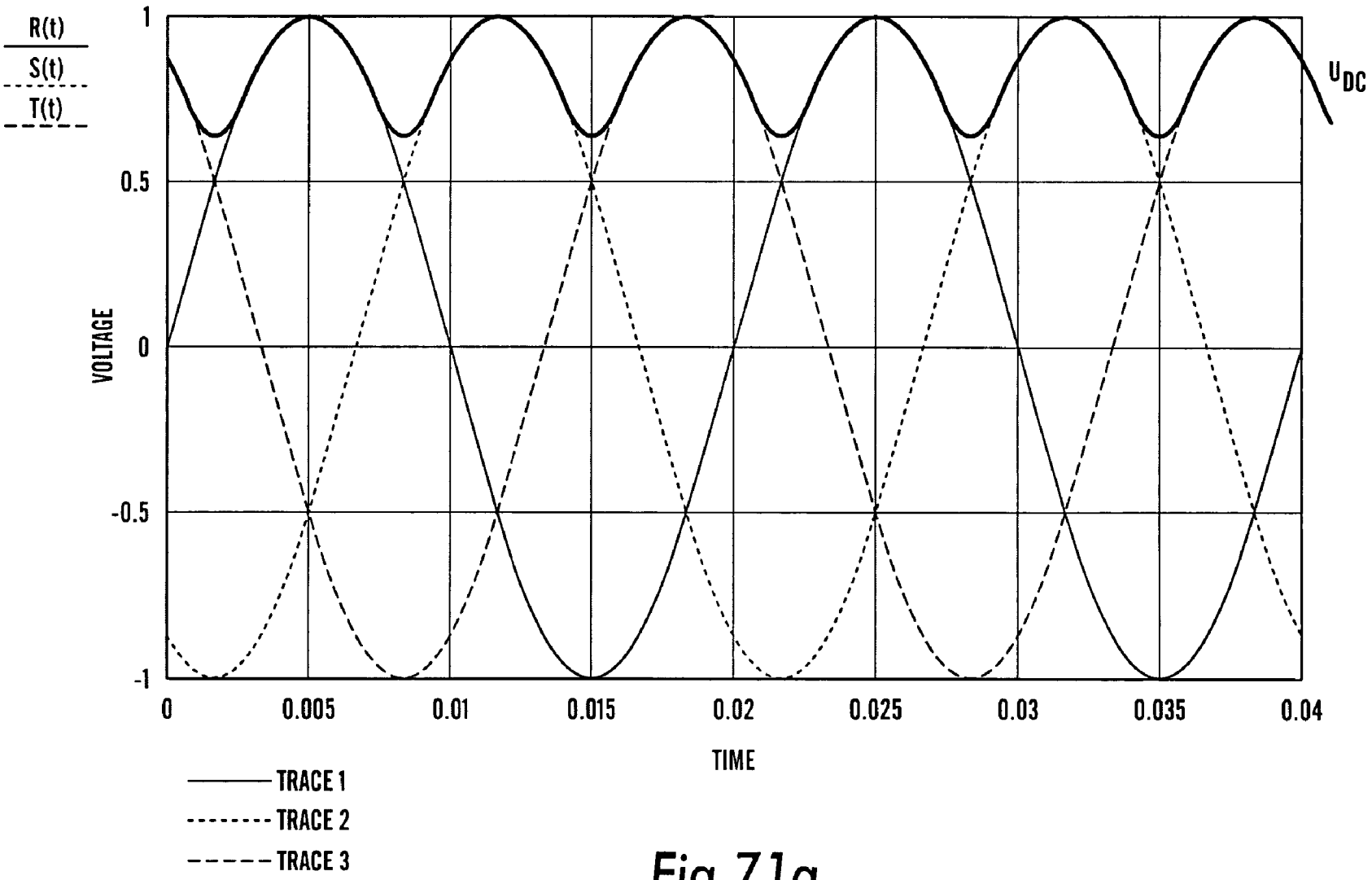

FIG. 71 illustrates a use of the device according to the invention as an AC-DC converter. The same control principle is used here as that explained above in the description of a frequency converter in FIG. 69. FIG. 71*b* illustrates a diagram of the time of the device's input and output voltage.

As mentioned previously, the voltage connector according to the invention is substantially without movable parts for the absorption of electrical voltage between a generator and a load. The function of the connector is to be able to control the voltage between the generator and the load from 0–100% by means of a small control current. A second function will be purely as a voltage switch. A further function could be forming and transforming of a voltage curve.

The new technology according to the invention will be capable of being used for upgrading existing diode rectifiers, where there is a need for regulation. In connection with 12-pulse or 24-pulse rectifier systems, it will be possible to balance voltages in the system in a simple manner while having controllable rectification from 0–100%.

With regard to the magnetic materials involved in the invention, these will be chosen on the basis of a cost/benefit function. The costs will be linked to several parameters such as availability on the market, produceability for the various solutions selected, and price. The benefit functions are based on which electro-technical function the material requires to have, including material type and magnetic properties. Magnetic properties considered to be important include hysteresis loss, saturation flux level, permeability, magnetisation capacity in the two main directions of the material and magnetostriction. The electrical units frequency, voltage and power to the energy sources and users involved in the invention will be determining for the choice of material. Suitable materials include the following:

a) Iron—silicon steel: produced as a strip of a thickness approximately 0.1 mm–0.3 mm and width from 10 mm to 1100 mm and rolled up into coils. Perhaps the most preferred for large cores on account of price and already developed production technology. For use at low frequencies.

b) Iron—nickel alloys (permalloys) and/or iron—cobalt alloys (permendur) produced as a strip rolled up into coils. These are alloys with special magnetic properties with subgroups where very special properties have been cultivated.

c) Amorphous alloys, METGLAS: produced as a strip of a thickness of approximately 20 μm–50 μm, width from 4 mm to 200 mm and rolled up into coils. Very high permeability, very low loss, can be made with almost 0 magnetostriction. Exists in a countless number of variants, iron-based, cobalt-based, etc. Fantastic properties but high price.

d) Soft ferrites: Sintered in special forms developed for the converter industry. Used at high frequencies due to small loss. Low flux density. Low loss. Restrictions on physically realisable size.

e) Compressed powder cores: Compressed iron powder alloy in special shapes developed for special applications. Low permeability, maximum approximately 400–600 to-day. Low loss, but high flux density. Can be produced in very complicated shapes.

All sintered and press-moulded cores can implement the topologies which are relevant in connection with the invention without the need for special magnetic field connectors, since the actual shape is made in such a way that closed magnetic field paths are obtained for the relevant fields.

If cores are made based on rolled sheet metal, they will have to be supplemented by one or more magnetic field connectors.

In another embodiment, sheet strip material is used in production of magnetic cores. These cores can be made for example, by rolling a sheet of material into a cylinder or by stacking several sheets together and then cutting the elements which will form the core. It is possible to define at least two directions in the material used to produce the "rolled" cores, for example, the rolling direction ("RD") and the axial direction ("AD").

Figure 72:
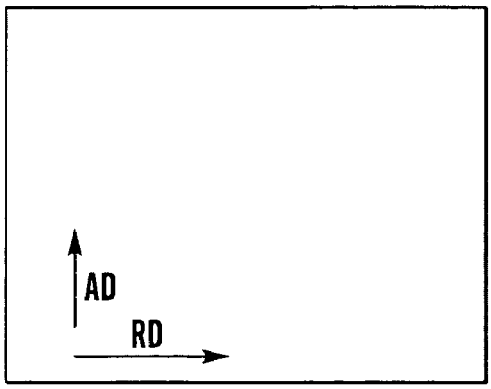
FIG. 72 shows a sheet of magnetic material and the relative position of the rolling and axial direction.
Figure 73:
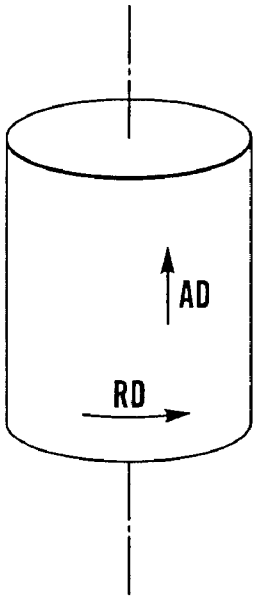
FIG. 73 shows a rolled core and the rolling and axial directions defined in it.

FIGS. 72 and 73 show a sheet of magnetic material and a rolled core respectively. The rolling and the axial direction (RD, AD) are shown in these Figures. As shown in FIG. 73, the rolling direction of a rolled core follows the cylinder's periphery and the axial direction coincides with the cylinder's axis.

Figure 74:
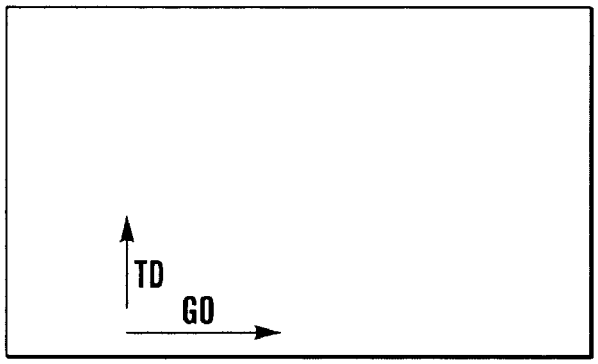
FIG. 74 shows a sheet of grain oriented material and the grain and transverse directions defined in it.
Figure 75:
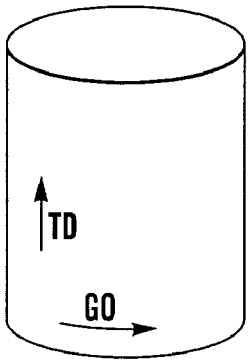
FIG. 75 shows a rolled core of grain oriented material, and the grain and transverse directions defined in it.

Material that has magnetic characteristics that vary depending upon the direction in the material is referred to as anisotropic. FIGS. 74 and 75 show directions defined in a sheet of grain-oriented anisotropic material. Grain oriented ("GO") material is manufactured by rolling a mass of material between rollers in several steps, together with the heating and cooling of the resulting sheet. During manufacture, the material is coated with an insulation layer, which affects a domain reduction and a corresponding loss reduction in the material. The material's deformation process results in a material where the grains (and consequently the magnetic domains) are oriented mainly in one direction. The magnetic permeability reaches a maximum in this direction. In general, this direction is referred to as the GO direction. The direction orthogonal to the GO direction is referred to as the transverse direction ("TD"). UNISIL and UNISIL-H, for example, are types of magnetic anisotropic materials. In one embodiment, the grain oriented material provides a substantially high percentage of domains available for rotation in the transverse direction. As a result, the material has low losses and allows for improved control of the permeability in the grain oriented direction via the application of a control field in the TD.

Other types of anisotropic material are the amorphous alloys. The common characteristic for all these materials is that one can define an "easy" or "soft" magnetization direction (high permeability) and a "difficult" or "hard" magnetization direction (low permeability). The magnetization in the direction of high permeability is achieved by domain wall motion, while in the low permeability direction, magnetization is achieved by rotation of the domain magnetization in the field direction. The result is a square m-h loop in the high permeability direction and a linear m-h loop in the low permeability direction (where m is the magnetic polarization as a function of the field strength h). Further, in one embodiment, the m-h loop in the transverse direction does not show coercivity and has zero remanence. In this description, the term GO is used when referring to the high permeability direction while the term transverse direction ("TD") is used when referring to the low permeability direction. These terms will be used not only for grain oriented materials but for any anisotropic material used in the core according to the invention. In one embodiment, the GO direction and the RD are in the same direction. In a further embodiment, the TD and the AD are in the same direction. In another embodiment, the anisotropic material is selected from a group of amorphous alloy consisting of METGLAS Magnetic Alloy 2605SC, METGLAS Magnetic Alloy 2605SA1, METGLAS Magnetic Alloy 2605CO, METGLAS Magnetic Alloy 2714A, METGLAS Magnetic Alloy 2826MB, and Nanokristallin R102. In still a further embodiment, the anisotropic material is selected from a group of amorphous alloys consisting of iron based alloys, cobalt-based alloys, and iron-nickel based alloys.

Although the use of anisotropic material is described, other materials may be used provided that they have a suitable combination of the following characteristics: 1) high peak magnetic polarization and permeability in the RD; 2) low losses; 3) low permeability in the TD; 4) low peak magnetic polarization in the TD; and 5) rotation magnetization in the transverse direction. Table 1 includes a partial list of materials in which the sheet strip may be implemented and some of the characteristics of the materials that are relevant to one or more embodiments of the invention.

TABLE 1

| Material | Bmax at 800 A/m | Loss at 1.5 T, 50 Hz | Material Type | Thickness |
|---|---|---|---|---|
| Unisil-H 103-27-P5 | 1.93 T | 0.74 W/kg | grain oriented | 0.27 mm |
| Unisil-H 105-30-P5 | 1.93 T | 0.77 W/kg | grain oriented | 0.30 mm |
| NO 20 grade | 1.45 T | 2.7 W/kg | non-oriented | 0.2 mm |
| Unisil M 140-30- S5 | 1.83 T | 0.85 W/kg Max permeability is approx. 6000 | grain oriented | 0.3 mm |
| Unisil 140-30-S5, AC magnetization curve in the transverse direction | 1.4 T (1.15 T at 120 A/m) | Max permeability is approx. 800 | | |

Figure 76:
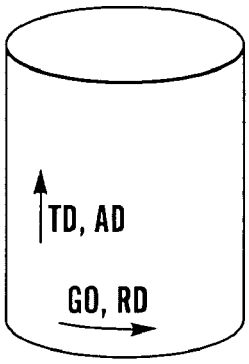
FIG. 76 shows the relative positions of the different directions in a pipe element.

FIG. 76 shows an embodiment of a pipe element in a variable inductance according to the invention. Because this element is made by rolling a sheet of anisotropic material, one can define the rolling direction (RD), the axial direction (AD), the high permeability (GO) direction, and the low permeability (TD) direction. The relative positions of these directions in the element are shown in FIG. 76. The pipe element can have any cross section because the shape of the cross section will simply depend on the shape of the element around which the sheet is rolled. For example, if the sheet is rolled on a parallellepiped with square cross section, the pipe element will have a square cross section. Similarly, a sheet rolled on a pipe with an oval cross section will be formed into a pipe with an oval cross section. In one embodiment, the pipe element is a cylinder.

Figure 77:
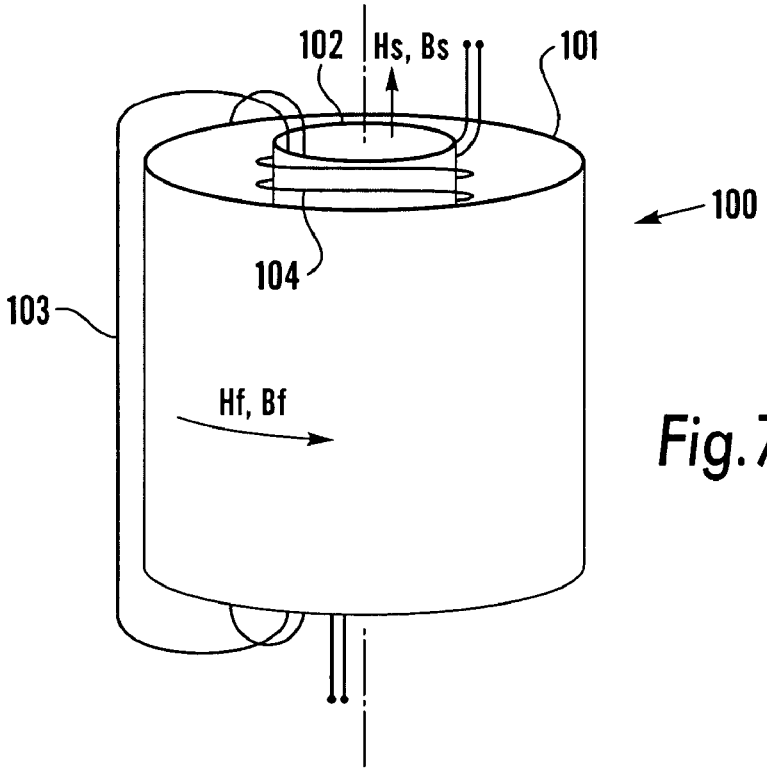
FIG. 77 shows schematically a part of a device according to an embodiment of the invention.

FIG. 77 shows schematically a part of an embodiment of a device 100 according to the invention. This device 100 comprises a first pipe element 101 and a second pipe element 102, where the elements are connected to one another at both ends by means of magnetic end couplers. For clarity, the magnetic end couplers are not shown in this figure. A first winding 103 is wound around elements 101 and 102 with a winding axis perpendicular to the elements' axes. The magnetic field (Hf, Bf) created by this winding when activated will have a direction along the element's periphery, i.e., an annular direction relative to the elements' axes. A second winding 104 is wound around element 102 with a winding axis parallel to the elements' axes. The magnetic field created by this winding when activated (Hs, Bs) will have a direction parallel to the elements' axes, i.e., an axial direction relative to the elements' axes. In one embodiment, the winding axis of the second winding 104 is coincident the elements' axes. In another embodiment, the elements' axes are not coincident to one another.

If we combine the windings and magnetic fields of FIG. 77 with the rolled material core of FIG. 76, a device 100 according to one embodiment of the invention results. In a version of this embodiment, the magnetic permeability in the direction of a magnetic field (Hf, Bf) introduced by the first winding 103 (i.e., the direction of GO, RD) is significantly higher than the magnetic permeability in the direction of a magnetic field (Hs, Bs) introduced by the second winding 104 (i.e., the direction of TD, AD).

In one embodiment, the first winding 103 constitutes the main winding and the second winding 104 constitutes the control winding. In a version of this embodiment, the main field (Hf, Bf) is generated in the high permeability direction (GO, RD) and the control field (Hs, Bs) is generated in the low permeability direction (TD, AD).

Minimum losses result when anisotropic material is used to provide the device 100 as described with reference to FIGS. 76 and 77. These results are achieved regardless of whether the device 100 is employed in a linear application or a switched application. In a linear application, the device 100 is switched on and remains in a circuit as an inductance. In a switched application, the device 100 is used for connecting and disconnecting another device to a power source.

Low losses allow the device 100 to be employed in high power applications, for example, applications in circuits that can employ transformers ranging from a few hundred kVA to several MVA in size.

As shown in Equation 44) the power handling capacity of the core is dependent on the maximum blocking voltage Ub at high permeability and the maximum magnetizing current Im at the minimum value of the controlled permeability.

$$Ps = Ub \cdot Im \qquad 44)$$

If the magnetizing current and the blocking voltage are expressed as functions of the magnetic field density Bm, the apparent power Ps can be expressed as:

$$Ps = \pi \cdot f \cdot Bm^2 \cdot \frac{Vj}{\mu_0 \cdot \mu_r} \qquad 45)$$

Where Vj is the volume of the main flux path in the core, $\mu_o$ is the permeability of free space, and $\mu_r$ is the relative permeability of the core. Equation 45) shows that the power handling capacity is related to both the volume of the core and the relative permeability of the core. At very high permeability the magnetizing current is at its lowest level and only a small amount of power is being conducted.

It is clear from Equation 45) that the apparent power Ps per volume unit of the core is related to the relative permeability $\mu_r$. For two similar cores, where the minimum relative permeability of the first core is half the minimum relative permeability of a second core, the first core's apparent power is twice as large as the second core. Thus, the power handling of a given core volume is limited by the minimum relative permeability of the core volume.

Accordingly, in one embodiment, the volume of the magnetic end couplers is approximately 10–20% of the main core but the magnetic end coupler volume can be further lowered to ½ or ¼ of that depending on the construction of the core, and the necessary power handling capacity. In one such embodiment, the volume of magnetic end couplers is 5%–10% of the volume of the main core. In yet another embodiment, the volume of the magnetic end couplers is 2.5%–5% of the volume of the main core.

A phenomenological theory of the magnetization curves and hysteresis losses in grain oriented (GO) laminations is described in an article entitled, "Comprehensive Model of Magnetization Curve, Hysteresis Loops, and Losses in Any Direction in Grain-Oriented Fe—Si", by Fiorillo et al. which published in IEEE Transactions on Magnetics, vol. 38, NO. 3, May 2002 (hereinafter "Fiorillo et al."). Fiorillo et al. provides theoretical and experimental proof of the fact that the volume that evolves with magnetization in the transverse direction is occupied for magnetization in the rolling direction. Thus, the article demonstrates that it is possible to control permeability in one direction by means of a field in another direction.

Figure 88B:
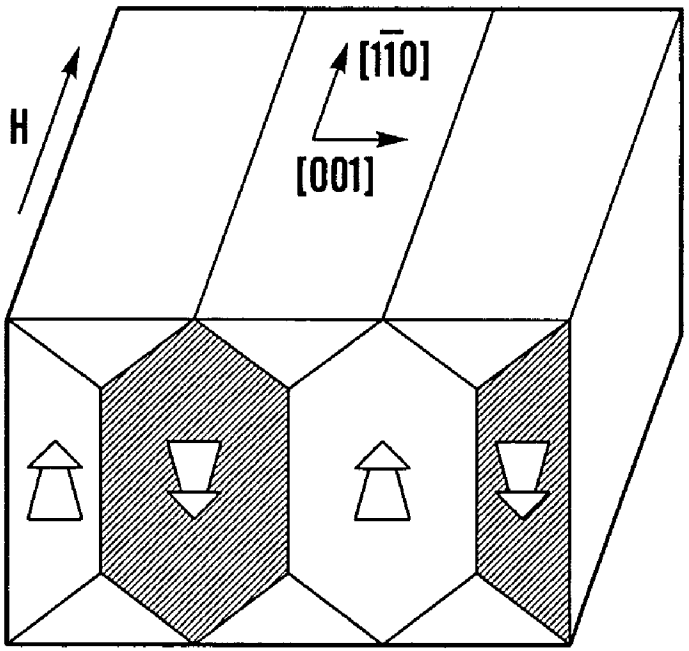
FIG. 88 shows the domain structure in grain oriented material.
Figure 88A:
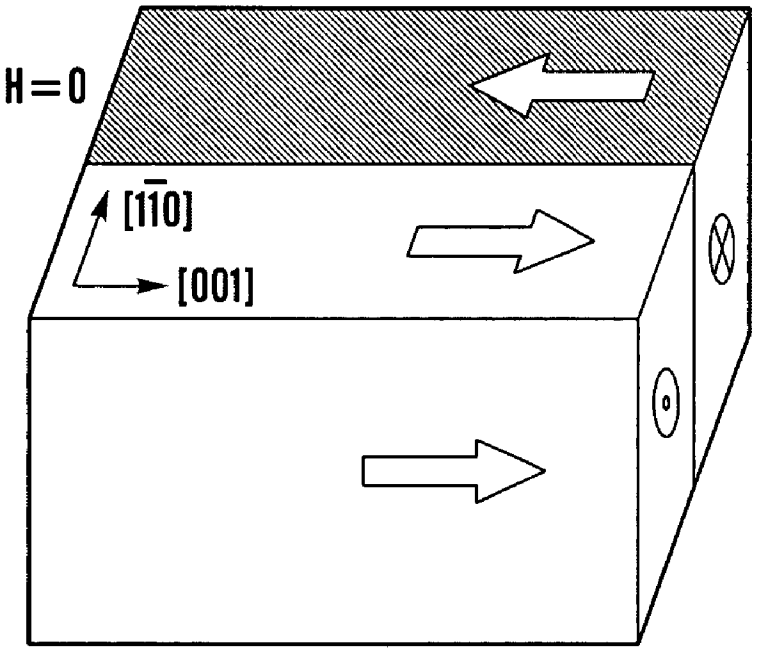

Fiorillo et al. also provides a model of the processes in a GO material. It presents, for example, a model that includes magnetization curves, hysteresis loops, and energy losses in any direction in a GO lamination. The model is based on the single crystal approximation and describes that the domains evolve in a complex fashion when a field is applied along the TD. Referring to FIG. 88, a GO sheet comprises a pattern of 180° domain walls basically directed along the RD. The demagnetized state (FIG. 88*a*) is characterized by magnetization Js directed along [001] and [00$\bar{1}$]. When a field is applied in the TD (FIG. 88*b*), the basic 180° domains transform, through 90° domain wall processes, into a pattern made of bulk domains, having the magnetization directed along [100] and [0$\bar{1}$0] (i.e. making an angle of 45° with respect to the lamination plane). When this new domain structure occupies a fractional sample volume the macroscopic magnetization value is:

$$J_{90} = \frac{J_s}{\sqrt{2}} \cdot v_{90} \qquad 46)$$

$J_{90}$=Magnetization in TD $J_s$=Magnetization in RD $v_{90}$=Fractional sample volume The maximum magnetization obtainable at the end of the magnetization process is $J_{90}$=1.42 Tesla and further increase is obtained by moment rotations of domains.

Fiorillo et al. also shows that the volume of the sample occupied by 180° domains decreases because of the growth of the 90° domains. Thus, permeability or flux conduction for fields applied in the rolling direction can be controlled with a control field and controlled domain displacement in the transverse direction.

The magnetization behavior in the transverse direction in GO steel is described in "Magnetic Domains" by Hubert et al., Springer 2000, pages 416–417 and 532–533. Control of the domain displacement in the transverse direction to control permeability in the rolling direction is most favorable primarily because motions of the 180° walls are avoided when a field is applied perpendicular to the 180° walls. Thus, the main field does not affect the orthogonal control field, in already TD magnetized volumes.

In contrast to GO steel where the magnetization mechanism in GO direction and the TD differ, the magnetization of non-oriented steel consists primarily of 180° domain wall displacements; therefore, the controlled volume is continuously affected by both the main field and the control field in nonoriented steel.

Figure 78:
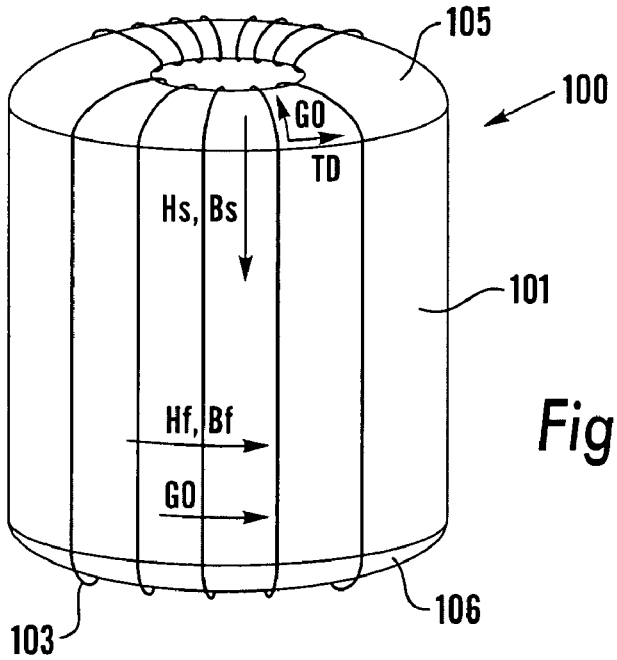
FIG. 78 shows the device according to the embodiment of FIG. 77.

FIG. 78 shows an embodiment of the device 100 according to the invention. The Figure shows first pipe element 101, first winding 103, and the magnetic end couplers 105, 106. The anisotropic characteristic of the magnetic material for the pipe elements has already been described, it consists of the material having the soft magnetization direction (GO) in the rolling direction (RD).

The pipe elements are manufactured by rolling a sheet of GO material. In one embodiment, the GO material is high-grade quality steel with minimum losses, e.g., Cogent's Unisil HM105-30P5.

The permeability of GO steel in the transverse direction is approximately 1–10% of the permeability in the GO direction, depending on the material. As a result, the inductance for a winding which creates a field in the transverse direction is only 1–10% of the inductance in the main winding, which creates a field in the GO direction, provided that both windings have the same number of turns. This inductance ratio allows a high degree of control over the permeability in the direction of the field generated by the main winding. Also, with control flux in the transverse direction, the peak magnetic polarization is approx. 20% lower than in the GO direction. As a result, the magnetic end couplers in the device according to an embodiment of the invention are not saturated by the main flux or by the control flux, and are able to concentrate the control field in the material at all times.

To prevent eddy current losses and secondary closed paths for the control field, in one embodiment, an insulation layer is sandwiched between adjacent layers of sheet material. This layer is applied as a coating on the sheet material. In one embodiment, the insulation material is selected from a group consisting of MAGNITE and MAGNITE-S. However, other insulating material such C-5 and C-6, manufactured by Rembrandtin Lack Ges.m.b.H, and the like may be employed provided they are mechanically strong enough to withstand the production process, and also have enough mechanical strength to prevent electrical short circuits between adjacent layers of foil. Suitability for stress relieving annealing and poured aluminium sealing are also advantageous characteristics for the insulating material. In one embodiment, the insulation material includes organic/inorganic mixed systems that are chromium free. In another embodiment, the insulation material includes a thermally stable organic polymer containing inorganic fillers and pigments.

Figure 79:
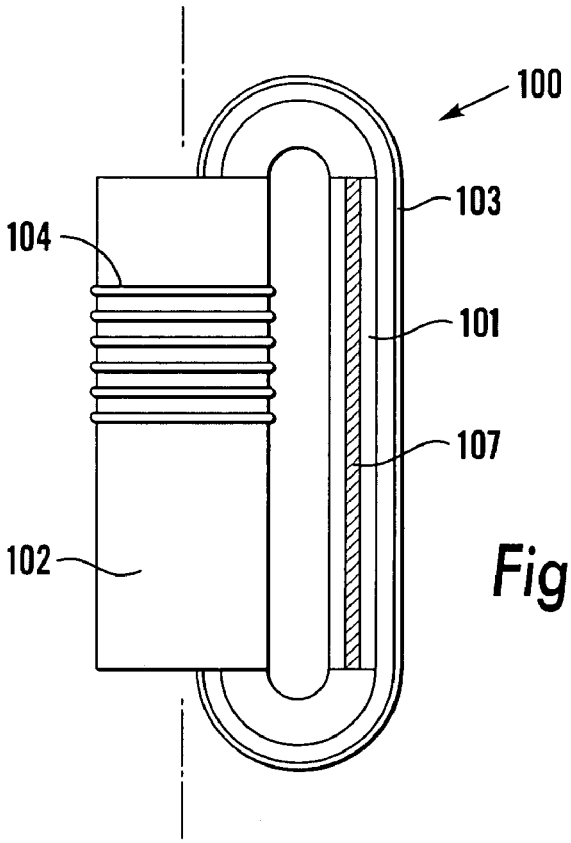
FIG. 79 shows sectional view of the device shown in FIG. 78.

FIG. 79 is a sectional view of an embodiment of the device 100 according to the invention. In this embodiment, the first pipe element 101 comprises a gap 107 in the element's axial direction located between a first layer and a second layer of the first pipe layer. The main function of gap 107 is to adapt the power handling capacity and volume of material to a specific application. The presence of an air gap in the core's longitudinal direction will cause a reduction in the core's remanence. This will cause a reduction in the harmonic contents of the current in the main winding when the permeability of the core is lowered by means of a current in the control winding. A thin insulation layer is situated in the gap 107 between the two parts of element 101. In a version of this embodiment, the magnetic end couplers are not divided into two parts.

FIGS. 80–87 relate to different embodiments of the magnetic end couplers. In one embodiment, the material used for the magnetic end couplers is anisotropic. In a version of this embodiment, the magnetic end couplers provide a hard magnetization (low permeability) path for the main magnetic field Hf, that is created by the first winding 103. The control field Hs, the field created by the second winding 104 (not shown in FIG. 78), will meet a path with high permeability in the magnetic end couplers and low permeability in the pipe elements.

The magnetic end couplers or control-flux connectors can be manufactured from GO-sheet metal or wires of magnetic material with the control field in the GO direction and the main field in the transverse direction. The wires may be either single wires or stranded wires.

In one embodiment, the magnetic couplers are made of GO-steel to ensure that the end couplers do not get saturated before the pipe elements or cylindrical cores in the TD, but instead, concentrate the control flux through the pipe elements. In another embodiment, the magnetic couplers are made of pure iron.

We will now describe the magnetic field behavior in the end couplers in an embodiment of the device corresponding to FIG. 78. Initially, that is, when the second winding or control winding 104 is not activated, only a very small fraction (approx. 0.04–0.25%) of the main field Hf enters the magnetic end couplers' volume because of the very low permeability in the main field direction (TD) in the magnetic end coupler. The permeability in the main field direction Hf, TD is from 8 to 50 through the end coupler depending on the construction and material used. As a result, the main flux Bf goes in the volume of the pipe elements or cylindrical cores 101, 102. Additionally, the concentration of the main flux allows the main cores' 101, 102 permeability to be adjusted downward to approximately 10.

The control flux-path (Bs in FIGS. 77 and 78) goes up axially within one of the pipe elements' 101, 102 core wall and down within the other element's core wall and is closed by means of magnetic end couplers 105, 106 at each end of the concentric pipe elements 101, 102.

Figure 80:
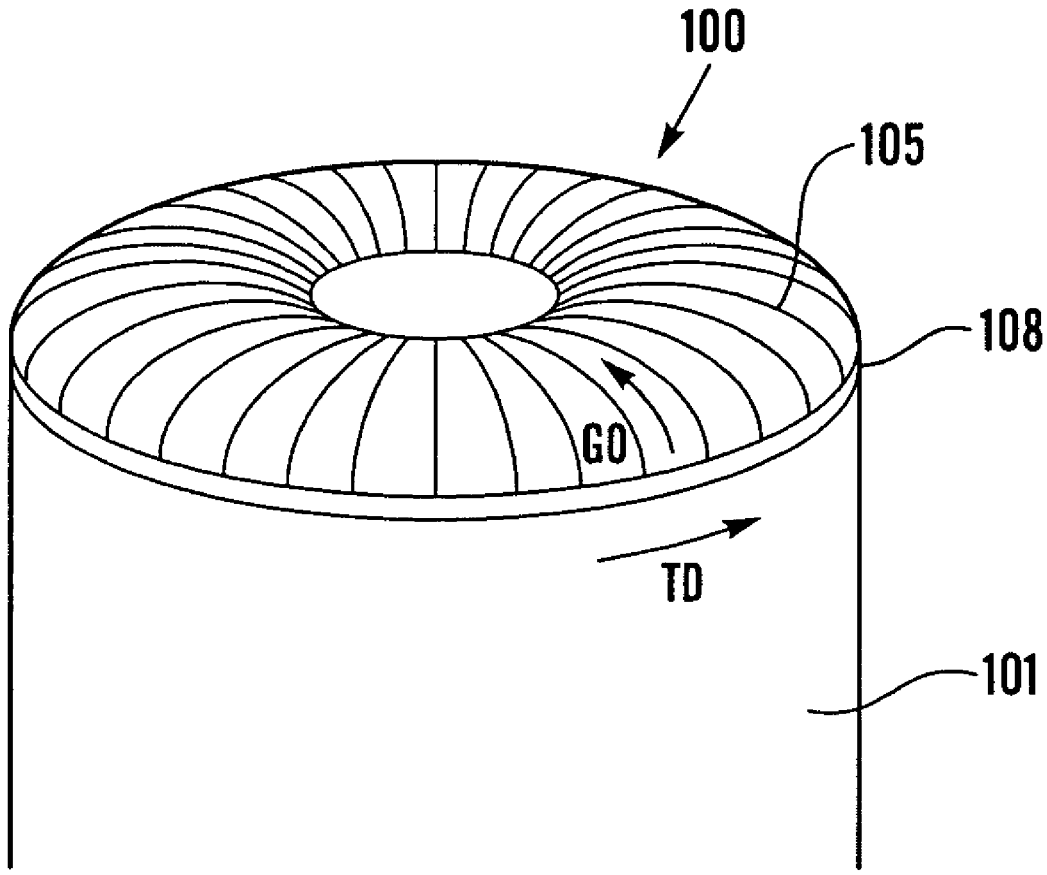
FIG. 80 shows the position of thin insulation sheets between the magnetic end couplers and the cylindrical cores of a device according to an embodiment of the invention.

The control flux (B) path has very small air gaps provided by thin insulation sheets 108 between the magnetic end couplers 105, 106 and the circular end areas of the cylindrical cores (FIG. 80). This is important to prevent creation of a closed current path for the transformer action from the first winding 103 through the "winding" made by the first and the second pipe elements 101,102 and the magnetic end couplers 105, 106.

Figure 81:
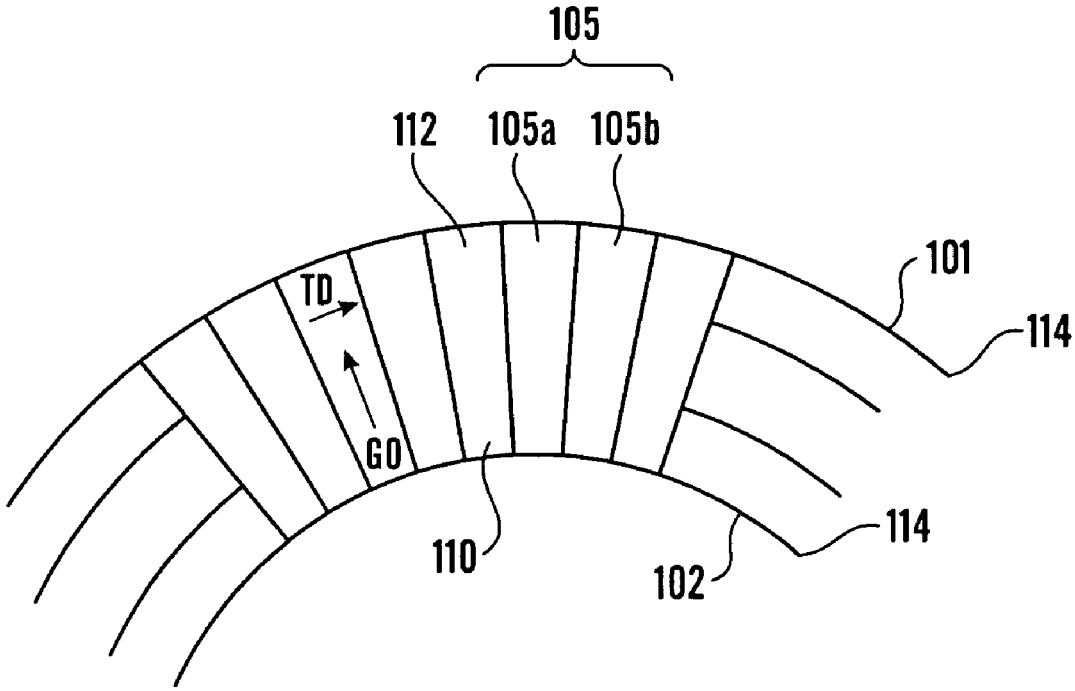
FIG. 81 shows production of magnetic end couplers based on magnetic sheet material.
Figure 82:
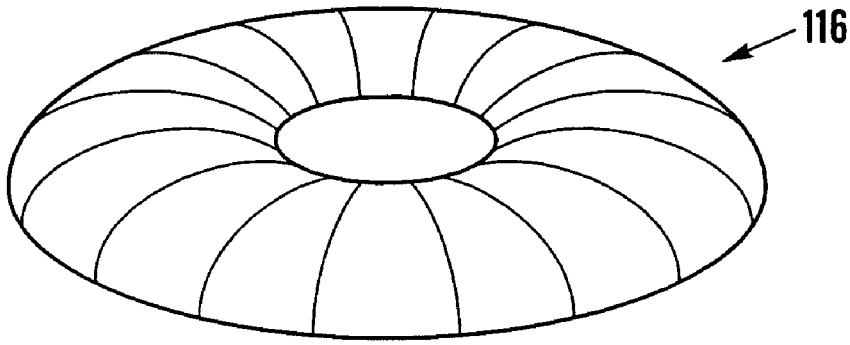
FIG. 82 shows a torus for production of magnetic end couplers based on strands of magnetic material.
Figure 84:
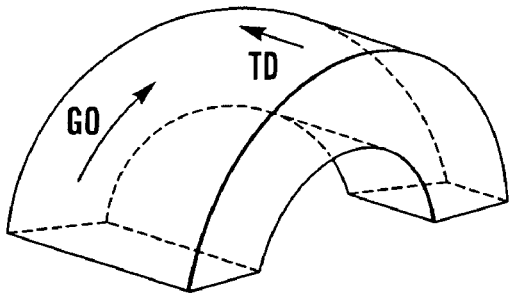
FIG. 84 shows the grain and transverse direction in magnetic end couplers according to an embodiment of the invention.
Figure 85:
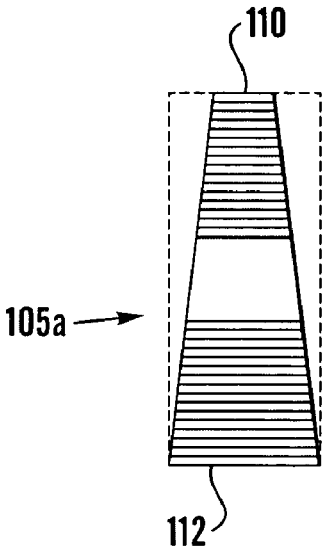
FIG. 85 shows a view of a torus for production of magnetic end couplers whose shape is adjusted to fit pipe elements in accordance with an embodiment of the invention.
Figure 83:
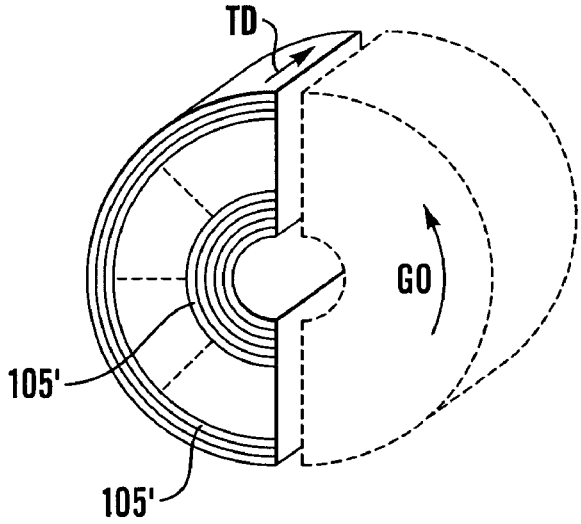
FIG. 83 shows a cross section of torus shaped magnetic material for production of magnetic end couplers according to an embodiment of the invention.

As previously mentioned, the magnetic end couplers according to one embodiment of the invention are made of several sheets of magnetic material (laminations). The embodiment is shown in FIGS. 81–85. FIG. 81 shows the magnetic end coupler 105 of GO sheet steel and the pipe elements 101 and 102 seen from above. Each segment of the end coupler 105 (for example, segments 105*a* and 105*b*) is tapered from a radially inward end 110 to a radially outward end 112, where the radially inward end 110 is narrower than the radially outward end 112. Directions GO and TD are shown in FIG. 81 as they apply to each segment 105*a*, 105*b* of the end coupler. A portion of the end coupler 105 on the left and the right sides of FIG. 81 has been removed to show sheet ends 114 of the inner core 102 and the outer core 101. FIG. 82 shows a torus shaped member 116, which when cut into two parts, provides the magnetic end couplers. FIG. 83 shows a cross section of the torus and the relative position of the sheets (e.g., laminations) 105' of magnetic material. FIGS. 83 and 84 show the GO direction in the magnetic end couplers, which coincides with the direction of the main field. FIG. 85 shows how the size and shape of the magnetic coupler segment 105*a* is adjusted to insure that the coupler connects the first pipe element 101 (outer cylindrical core) to the second pipe element 102 (inner cylindrical core) at each end. In FIG. 85 radially inward end 110 is narrower than radially outward end 112.

Figure 86:
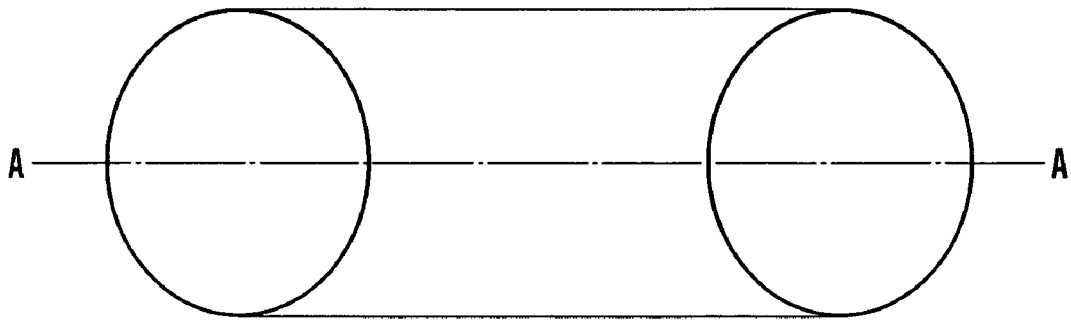
FIG. 86 shows a torus produce with magnetic wire according to an embodiment of the invention.
Figure 87:
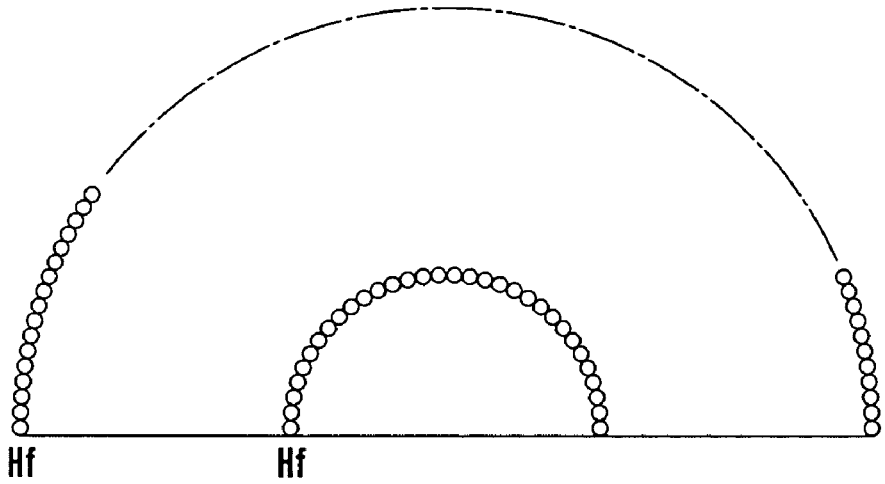
FIG. 87 shows a crossectional view of the torus of FIG. 86.

In another embodiment of the invention, shown in FIG. 86, the same type of segments is made using magnetic wire. Production of end couplers using stranded or single wire magnetic material. The toroidal shape formed by the magnetic material is cut into two halves as indicated by cross section A—A in FIG. 86. FIG. 87 shows how the ends of the magnetic wires provide entry and exit areas for the magnetic field Hf. Each wire provides a path for the magnetic field Hf.

To be able to increase the power handled by the controllable inductive device, the core can be made of laminated sheet strip material. This will also be advantageous in switching where rapid changes of permeability are required.

Variations, modifications, and other implementations of what is described herein will occur to those of ordinary skill in the art without departing from the spirit and scope of the invention as claimed. Accordingly, the invention is to be defined not by the preceding illustrative description but instead by the spirit and scope of the following claims.

What is claimed is:

1. A controllable inductor, comprising:

first and second coaxial and concentric magnetic pipe elements comprising anisotropic material, wherein said elements are connected to one another at both ends by means of magnetic end couplers;

a first winding wound around both said magnetic pipe elements; and a second winding wound around at least one of said magnetic pipe elements, wherein a winding axis for the first winding is perpendicular to an axis of at least one of the magnetic pipe elements, wherein a winding axis of the second winding coincides with the axis, wherein, when energized, the first winding generates a magnetic field in a first direction that coincides to a direction of a first magnetic permeability, wherein, when energized, the second winding generates a magnetic field in a second direction that coincides to a direction of a second magnetic permeability, and wherein the first magnetic permeability is substantially higher than the second magnetic permeability.

2. The controllable inductor according to claim 1, wherein the anisotropic material is selected from a group consisting of grain oriented silicon steel and domain controlled high permeability grain oriented silicon steel.

3. The controllable inductor according to claim 1, wherein the magnetic end couplers are made of an anisotropic material and provide a low permeability path for the magnetic field created by the first winding and a high permeability path for the magnetic field created by the second winding.

4. The controllable inductor according to claim 1, further comprising a thin insulation sheet situated between magnetic pipe element edges and the end couplers.

5. The controllable inductor according to claim 1, wherein a volume of the magnetic end couplers is 10–20% of the volume of the magnetic pipe elements.

6. The controllable inductor according to claim 1, wherein a volume of the magnetic end couplers is 25–50% of the volume of the magnetic pipe elements.

7. The controllable inductor of claim 1 wherein the magnetic field direction introduced by the first winding is in an annular direction relative to the axis of at least one of the elements.

8. The controllable inductor of claim 1 wherein the magnetic field direction introduced by the second winding is in a radial direction relative to the axis of at least one of the elements.

* * * * *